US010916176B2

(12) United States Patent
Kitamura et al.

(10) Patent No.: US 10,916,176 B2
(45) Date of Patent: Feb. 9, 2021

(54) SYSTEM AND METHOD FOR DISPLAY POWER REDUCTION

(71) Applicant: Synaptics Japan GK, Tokyo (JP)

(72) Inventors: Kota Kitamura, Tokyo (JP); Makoto Kimura, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 28 days.

(21) Appl. No.: 16/046,478

(22) Filed: Jul. 26, 2018

(65) Prior Publication Data

US 2019/0043410 A1 Feb. 7, 2019

(30) Foreign Application Priority Data

Aug. 1, 2017 (JP) ..... 2017-149235

(51) Int. Cl.
*G09G 3/3225* (2016.01)
*G09G 3/36* (2006.01)
(Continued)

(52) U.S. Cl.
CPC ..... *G09G 3/2007* (2013.01); *G09G 3/3225* (2013.01); *G09G 3/3275* (2013.01);
(Continued)

(58) Field of Classification Search
CPC .. G09G 3/2007; G09G 3/3225; G09G 3/3648; G09G 3/3688; G09G 3/3275; G09G 3/3677; G09G 3/3614; G09G 3/2074; G09G 3/3696; G09G 3/2096; G09G 3/3685; G09G 3/3291; G09G 3/3283; G09G 3/2092; G09G 3/3607; G09G 3/20; G09G 2300/0828; G09G 2300/0833; G09G 2300/0814; G09G 2310/027; G09G 2310/0297; G09G 2310/0291; G09G 2310/08; G09G 2310/0232; G09G 2310/0278; G09G 2310/0289; G09G 2310/0256; G09G 2310/0272; G09G 2310/0275; G09G 2310/04; G09G 2310/0264; G09G 2310/0243; G09G 2320/0626;
(Continued)

(56) References Cited

U.S. PATENT DOCUMENTS

2005/0134546 A1* 6/2005 Woo ..... G09G 3/3688 345/100
2006/0050037 A1* 3/2006 Maki ..... G09G 3/3696 345/89
(Continued)

*Primary Examiner* — Nitin Patel
*Assistant Examiner* — Amen Woldesenbet Bogale
(74) *Attorney, Agent, or Firm* — Ferguson Braswell Fraser Kubasta PC

(57) ABSTRACT

A display driver includes a plurality of source amplifiers configured to drive a plurality of source lines of a display panel, and an amplifier control system configured to control the source amplifiers. Each of the source amplifiers is configured to drive a source line with a drive voltage corresponding to a grayscale value specified by an image data associated with each of the source amplifiers. The amplifier control system is configured to control execution and stopping of an amplifying operation of each of the source amplifiers based on the image data associated with each of the source amplifiers is a grayscale value corresponding to black portions of the display panel.

20 Claims, 26 Drawing Sheets

(51) Int. Cl.
*G09G 3/3275* (2016.01)
*G09G 3/20* (2006.01)

(52) U.S. Cl.
CPC ..... *G09G 3/3648* (2013.01); *G09G 3/3688* (2013.01); *G09G 2310/027* (2013.01); *G09G 2310/0291* (2013.01); *G09G 2310/0297* (2013.01); *G09G 2310/08* (2013.01); *G09G 2320/0626* (2013.01); *G09G 2330/021* (2013.01); *G09G 2330/028* (2013.01); *G09G 2360/16* (2013.01)

(58) Field of Classification Search
CPC ..... G09G 2320/0673; G09G 2320/106; G09G 2320/103; G09G 2320/0238; G09G 2320/0276; G09G 2320/0261; G09G 2330/028; G09G 2330/021; G09G 2330/022; G09G 2330/023; G09G 2330/02; G09G 2330/027; G09G 2340/0407; G09G 2340/0428; G09G 2360/16
See application file for complete search history.

(56) References Cited

U.S. PATENT DOCUMENTS

2007/0018939 A1* 1/2007 Chen ..... G09G 3/3696 345/100
2009/0213042 A1* 8/2009 Hagino ..... G09G 3/3696 345/55
2010/0207934 A1* 8/2010 Kato ..... H04N 9/312 345/214
2011/0234560 A1* 9/2011 Shin ..... G09G 3/003 345/208
2013/0321382 A1* 12/2013 Nagao ..... G06F 3/0445 345/212
2016/0133179 A1* 5/2016 Choi ..... G09G 3/2092 345/212
2017/0061869 A1* 3/2017 Bae ..... G09G 3/3688
2017/0287429 A1* 10/2017 Kong ..... G09G 3/3688
2017/0309219 A1* 10/2017 Kong ..... G09G 3/2003
2018/0061320 A1* 3/2018 Kim ..... H01L 51/50
2018/0261150 A1* 9/2018 Tamura ..... G09G 3/20

* cited by examiner

Fig. 6A

POSITIVE GRAYSCALE VOLTAGE

| GRAYSCALE VALUE SPECIFIED BY IMAGE DATA | GRAYSCALE VOLTAGE |
|---|---|
| FFh | +5.0V |
| FEh | +4.9V |
| FDh | +4.7V |
| FCh | +4.5V |
| | ⋮ |
| 02h | +0.5V |
| 01h | +0.3V |
| 00h | GND |

NEGATIVE GRAYSCALE VOLTAGE

| GRAYSCALE VALUE SPECIFIED BY IMAGE DATA | GRAYSCALE VOLTAGE |
|---|---|
| FFh | −5.0V |
| FEh | −4.9V |
| FDh | −4.7V |
| FCh | −4.5V |
| | ⋮ |
| 02h | −0.5V |
| 01h | −0.3V |
| 00h | GND |

Fig. 6B

POSITIVE GRAYSCALE VOLTAGE

| GRAYSCALE VALUE SPECIFIED BY IMAGE DATA | GRAYSCALE VOLTAGE |
|---|---|
| FFh | +0.2V |
| FEh | +0.3V |
| FDh | +0.5V |
| FCh | +0.7V |
| | ⋮ |
| 02h | +4.7V |
| 01h | +4.9V |
| 00h | VSP |

NEGATIVE GRAYSCALE VOLTAGE

| GRAYSCALE VALUE SPECIFIED BY IMAGE DATA | GRAYSCALE VOLTAGE |
|---|---|
| FFh | −0.2V |
| FEh | −0.3V |
| FDh | −0.5V |
| FCh | −0.7V |
| | ⋮ |
| 02h | −4.7V |
| 01h | −4.9V |
| 00h | VSN |

Fig. 21A

| GRAYSCALE VALUE SPECIFIED BY IMAGE DATA | GRAYSCALE VOLTAGE |
|---|---|
| FFh | V0 |
| FEh | V1 |
| FDh | V2 |
| FCh | V3 |
| | ⋮ |
| 02h | V253 |
| 01h | V254 |
| 00h | V255(=GND) |

V0>V1> ··· >253>V254>V255(=GND)

Fig. 21B

| GRAYSCALE VALUE SPECIFIED BY IMAGE DATA | GRAYSCALE VOLTAGE |
|---|---|
| FFh | V255 |
| FEh | V254 |
| FDh | V253 |
| FCh | V252 |
| | ⋮ |
| 02h | V2 |
| 01h | V1 |
| 00h | V0(=ELVDD) |

V0(=ELVDD)>V1> ··· >253>V254>V255

SYSTEM AND METHOD FOR DISPLAY POWER REDUCTION

CROSS REFERENCE

This application claims priority to Japanese Patent Application No. 2017-149235, filed on Aug. 1, 2017, the disclosure of which is incorporated herein by reference in its entirety.

TECHNICAL FIELD

The present disclosure relates to a display driver and a display device, more particularly to a technique for power consumption reduction of a display driver and/or a display device.

BACKGROUND

In a display device featuring always-on display (AOD) functionality, images are always displayed on a display panel when the AOD is executed. The images may contain information such as the current time or the date. In some instances, because only minimum information is displayed, a black display region often occupies an increased portion of the display panel. Thus, there is a need to reduce power consumption utilized to display the black display region to further reduce the power consumption of the display device or a display driver that drives the display panel of the display device.

SUMMARY

In one embodiment, a display driver includes a plurality of source amplifiers and an amplifier control system. Each of the source amplifiers is configured to drive a source line with a drive voltage corresponding to a grayscale value specified by image data associated with each of the source amplifiers. The amplifier control system is configured to control execution and stop of an amplifying operation of each of the source amplifiers, based on the image data associated with each of the source amplifiers.

In another embodiment, a display device includes: a display panel including a plurality of source lines; and a display driver. The display driver includes a plurality of source amplifiers and an amplifier control system. Each of the source amplifiers is configured to drive a source line with a drive voltage corresponding to a grayscale value specified by image data associated with each of the source amplifiers. The amplifier control system is configured to control execution and stop of an amplifying operation of each of the source amplifiers, based on the image data associated with each of the source amplifiers.

In still another embodiment, a method includes: driving a plurality of source lines of a display panel based on image data associated with source amplifiers; and controlling execution and stop of an amplifying operation of each of the source amplifiers, based on the image data associated with each of the source amplifiers.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

FIG. 6A illustrates a table indicating the relationship between the grayscale values according to one or more embodiments;

FIG. 6B illustrates a table indicating the relationship between the grayscale values according to one or more embodiments;

FIG. 21A illustrates a table indicating grayscale values according to one or more embodiments;

FIG. 21B illustrates a table indicating the correspondence relationship between the grayscale values according to one or more embodiments;

DETAILED DESCRIPTION

In one or more embodiments, a source amplifier that supplies a drive voltage to a pixel circuit that performs black display stops the amplifying operation thereof. Stopping the amplifying operation is achieved by stopping the operation of a current source included in the source amplifier. This operation effectively reduces the power consumption in performing black display.

It should be noted that "black" displayed when a source amplifier performing the amplifying operation may be different from "black" displayed when the source amplifier stops the amplifying operation, if the amplifying operation of the source amplifier is simply stopped.

Figure 1:
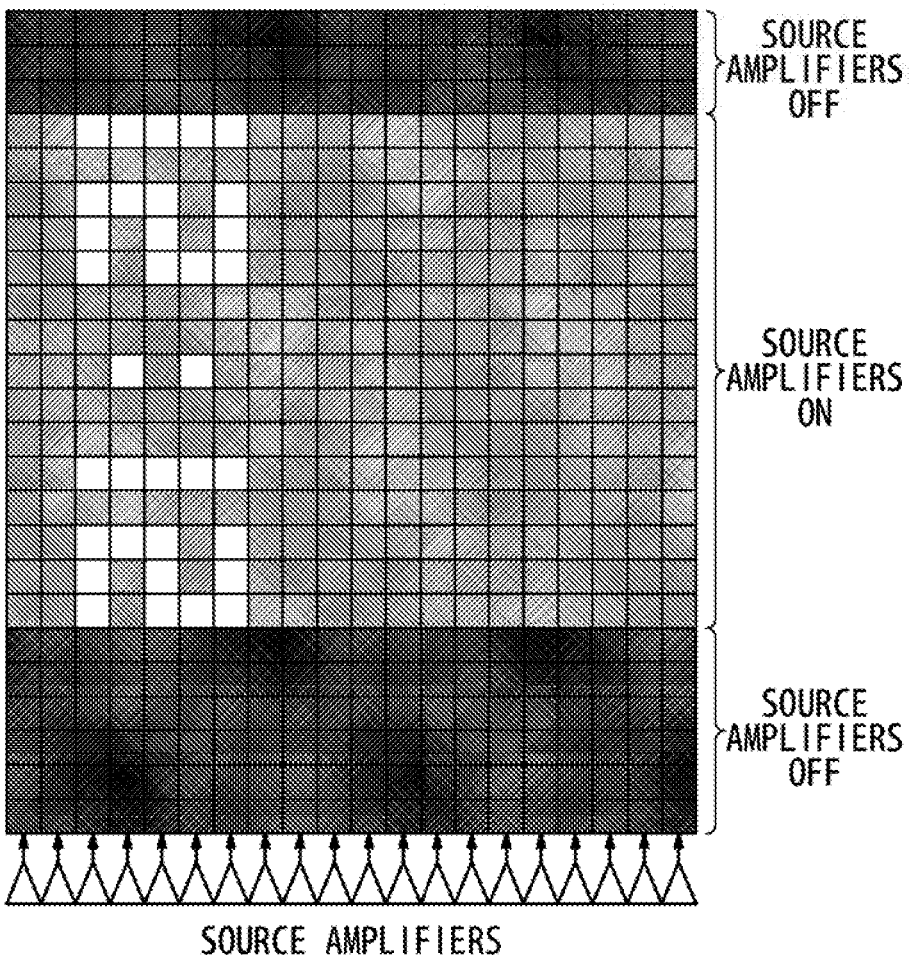
FIG. 1 illustrates an example image according to one or more embodiments.

FIG. 1 illustrates one example of an image in which this phenomenon occurs. Illustrated in FIG. 1 is one example of a display image in the case when source amplifiers stop the amplifying operations in supplying pixel circuits positioned in regions near the upper and lower ends of the display panel and the source amplifiers perform the amplifying operations in supplying pixel circuits positioned in the central region of the display panel.

In a normally black liquid crystal display panel, for example, black display may be achieved by driving pixel electrodes of pixel circuits to a voltage close to the common voltage level VCOM. The common voltage level VCOM is often different from the circuit ground level of the source amplifiers. A source amplifier may be configured to be able only to output a selected one of the power supply voltage, often referred to as power supply voltage VSP or VSN, and the circuit ground level GND when the amplifying operation thereof is stopped. In this case, the voltage level on the pixel electrode may be different between "black" for the case when the amplifying operation is performed in the source amplifier and "black" for the case when the amplifying operation is stopped, and this causes a difference in the brightness level.

In one or more embodiments, the drive voltage outputted to display "black" when the amplifying operation is provided by a source amplifier, that is, the drive voltage corresponding to black display is set to the power supply voltage or the circuit ground level. In one or more embodiments, the source amplifier is configured to stop the operation of a current source and output the drive voltage corresponding to black display, when the amplifying operation of the source amplifier is stopped. This effectively reduces the power consumption, while avoiding the problem of the difference in the brightness level of "black".

In the following, a description is given of various embodiments of the present disclosure with reference to the attached drawings. The same or corresponding components may be denoted by the same or corresponding reference numerals in the following description. It should be also noted that suffixes may be attached to reference numerals to distinguish the same components from each other.

Figure 2:
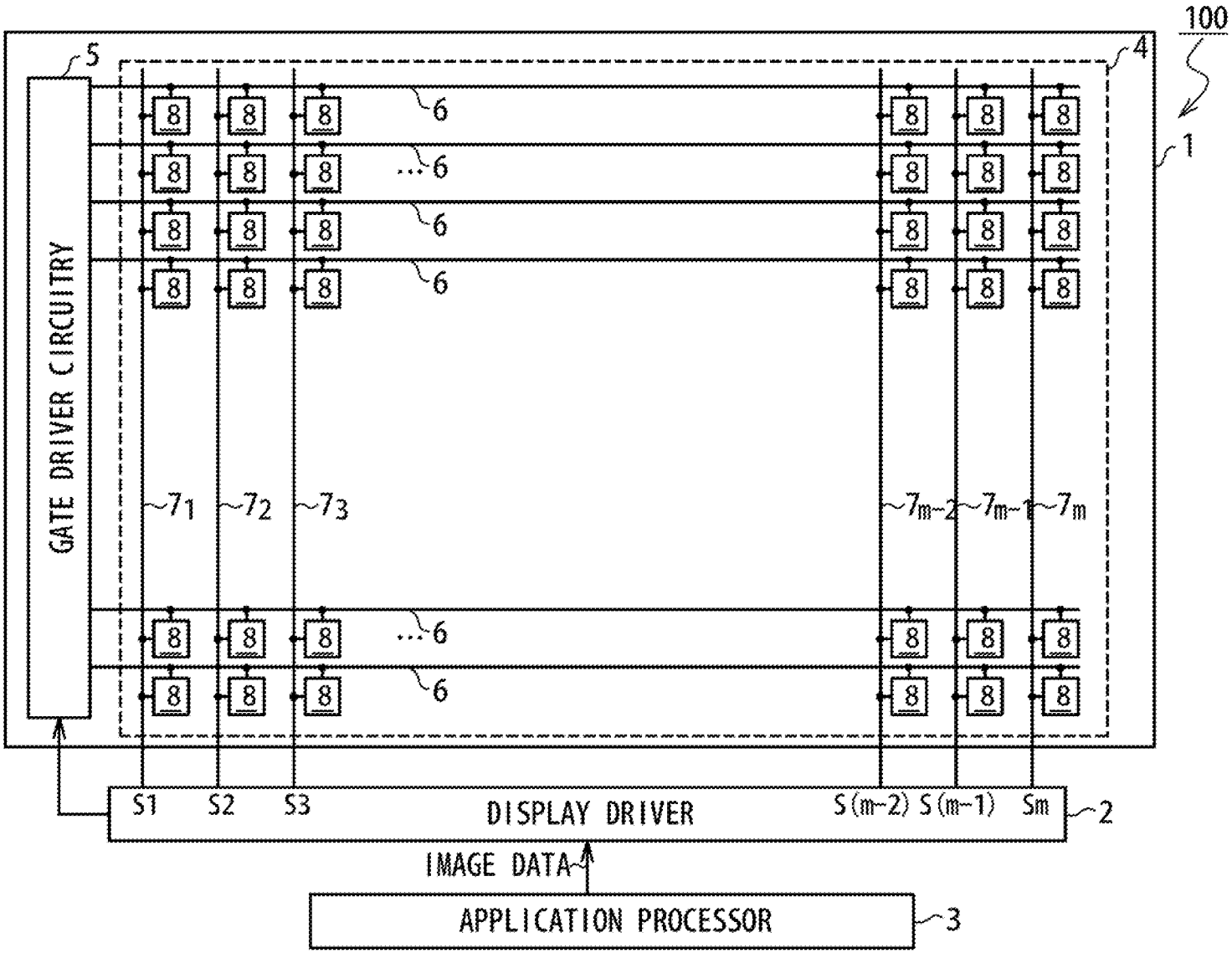
FIG. 2 is a block diagram schematically illustrating the configuration of a display device according to one or more embodiments.

FIG. 2 is a block diagram schematically illustrating the configuration of a display device 100 in one or more embodiments. The display device 100 includes a display panel 1 and a display driver 2. The display device 100 is configured to receive image data from an application processor 3, and display an image corresponding to the received image data on the display panel 1.

The display panel 1 includes a display region 4 and gate driver circuitry 5. Arranged in the display region 4 are a plurality of gate lines 6, a plurality of source lines 7 and a plurality of pixel circuits 8. The pixel circuits 8 are arrayed in rows and columns and each pixel circuit 8 is disposed at an intersection of the corresponding gate line 6 and source line 7. The gate driver circuitry 5 is configured to select a gate line 6 in response to gate control signals received from the display driver 2 and drive the selected gate line 6.

Figure 3:
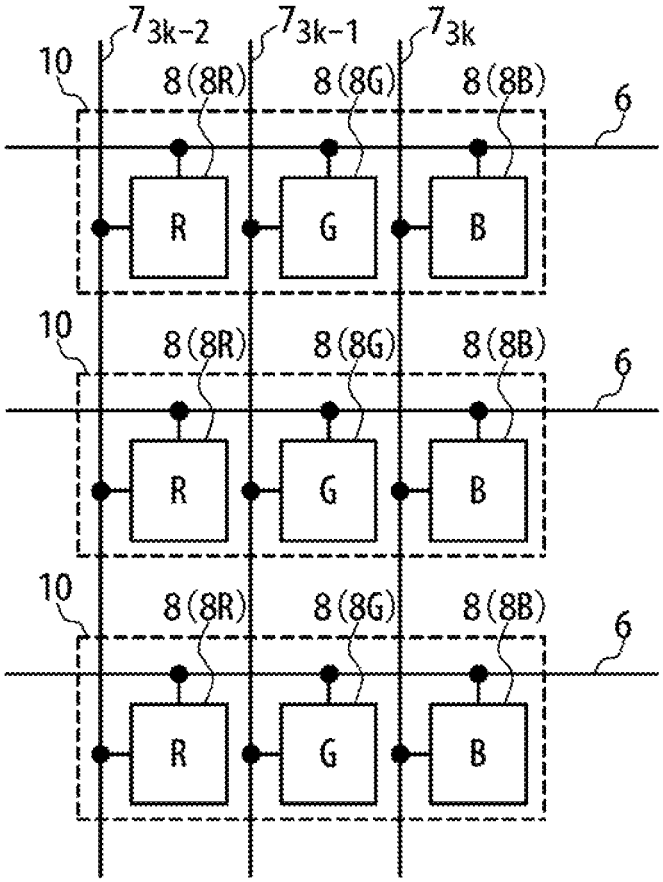
FIG. 3 illustrates the configuration of pixels according to one or more embodiments.

FIG. 3 illustrates the configuration of each pixel 10 of the display panel 1. Each pixel 10 includes three pixel circuits 8 that display red (R), green (G) and blue (B), respectively. A pixel circuit 8 displaying red is used as an R subpixel. Similarly, a pixel circuit 8 displaying green is used as a G subpixel, and a pixel circuit 8 displaying blue is used as a B subpixel. In this embodiment, each source line 7 is connected to pixel circuits 8 displaying the same color. In this embodiment, the number m of the source lines 7 is a multiple of six. For k being any natural number equal to or less than m/3, the $(3k-2)^{th}$ source line 7 is connected to pixel circuits 8 displaying red, the $(3k-1)^{th}$ source line 7 is connected to pixel circuits 8 displaying green, and the $(3k)^{th}$ source line 7 is connected to pixel circuits 8 displaying blue. In the following, a pixel circuit 8 displaying red may be referred to as R subpixel 8R. Similarly, pixel circuits 8 displaying green and blue may be referred to as G subpixel 8G and B subpixel 8B, respectively. The arrangement of the R subpixel 8R, the G subpixel 8G and the B subpixel 8B in a pixel 10 is not limited to that illustrated in FIG. 3. Some of the pixel circuits 8 or subpixels may be configured to display a color other than red, blue and green, such as white and yellow.

Figure 4:
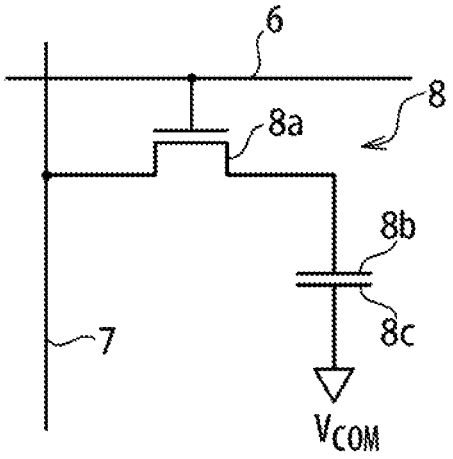
FIG. 4 is a circuit diagram illustrating the configuration of pixel circuits according to one or more embodiments.

In this embodiment, a liquid crystal display panel is used as the display panel 1. FIG. 4 is a circuit diagram illustrating the configuration of each pixel circuit 8 in this embodiment. Each pixel circuit 8 includes a select transistor 8*a* and a pixel electrode 8*b* in this embodiment. The pixel electrode 8*b* is disposed opposed to a common electrode 8*c* and the space between the pixel electrode 8*b* and the common electrode 8*c* is filled with liquid crystal. The common electrode 8*c* is kept at the common voltage level VCOM. In general, one common electrode 8*c* is provided for multiple pixel circuits 8; in one embodiment, one common electrode 8*c* is provided for all the pixel circuits 8.

The display panel 1 operates in a normally black mode or normally while mode, depending on the characteristics of the liquid crystal filled between the pixel electrode 8*b* and the common electrode 8*c*. Normally black is a mode in which a pixel circuit 8 displays black, that is, the brightness level of the pixel circuit 8 is set to the allowed lowest brightness level, when the potential difference between the pixel electrode 8*b* and the common electrode 8*c* is zero in the pixel circuit 8. Normally white is a mode in which a pixel circuit 8 displays while, that is, the brightness level of the pixel circuit 8 is set to the allowed highest brightness level, when the potential difference between the pixel electrode 8*b* and the common electrode 8*c* is zero in the pixel circuit 8.

Referring back to FIG. 2, the source lines 7 of the display panel 1 are connected to the source outputs $S_1$ to $S_m$ of the display driver 2, respectively. In this embodiment, in which the number m of the source lines 7 is a multiple of six, the number of the source outputs $S_1$ to $S_m$ is also the multiple of six. In the following, the source line 7 connected to the source output Si may be referred to as the source line 7*i*, where "i" is a natural number equal to or less than m.

The display driver 2 drives the source lines $7_1$ to $7_m$ connected to the source outputs $S_1$ to $S_m$ in response to the image data received from the application processor 3. The display driver 2 also has the function of controlling the gate driver circuitry 5 of the display panel 1 by supplying the gate control signals to the gate driver circuitry 5.

It should be noted that, the display driver 2 may has the function of touch sensing to sense a contract of a conductive body, such as a human finger and a stylus, with the display panel 1 in addition to the functions of driving the display panel 1 and controlling the gate driver circuitry 5. In such an embodiment, a touch panel may be placed on the display panel 1. Alternatively, sensing capacitors used for touch sensing may be incorporated in the display panel 1.

Figure 5:
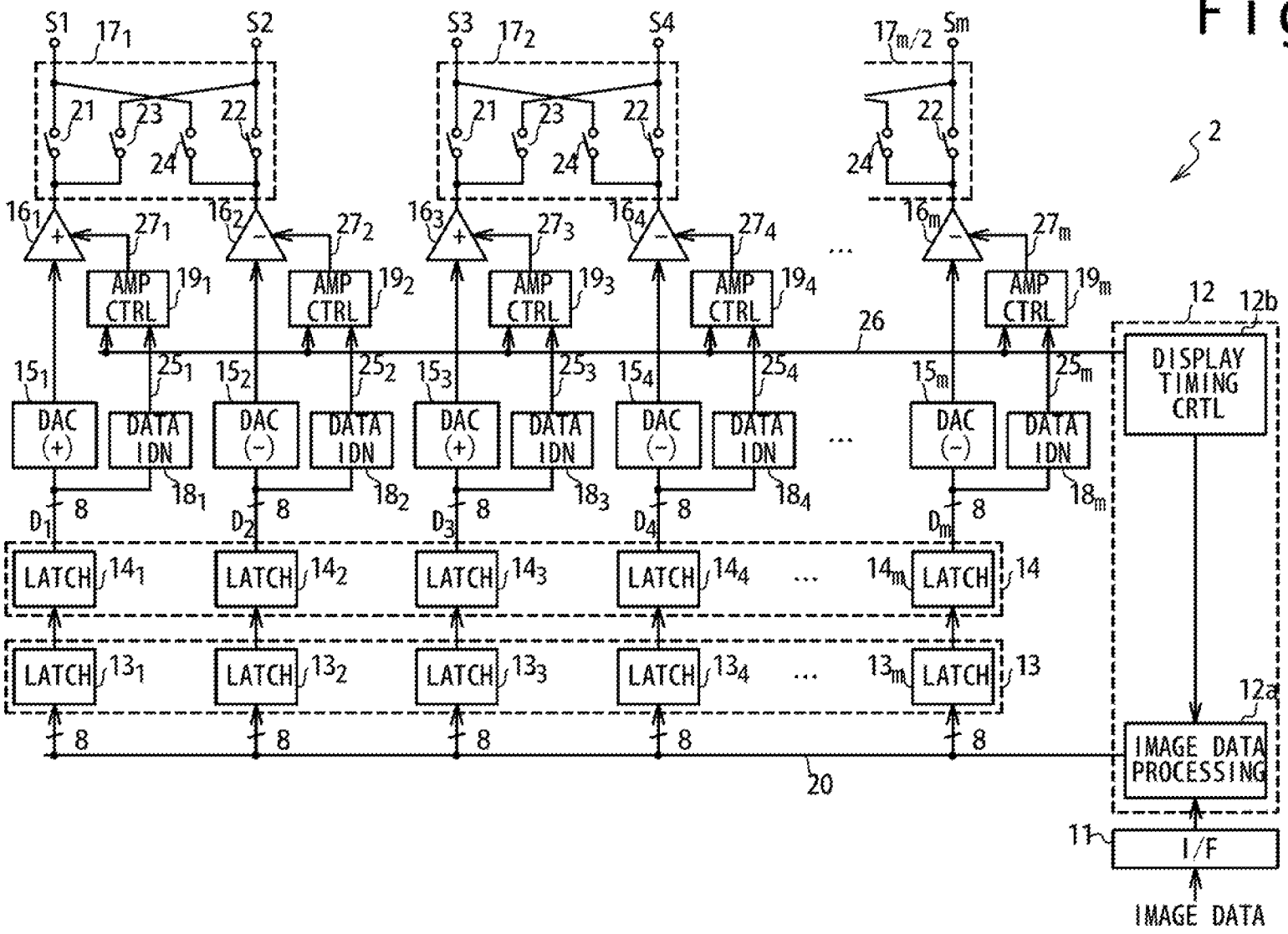
FIG. 5 is a block diagram illustrating the configuration of a display driver according to one or more embodiments.

FIG. 5 is a block diagram illustrating the configuration of the display driver 2 according to one or more embodiments. Illustrated in FIG. 5 is the configuration of circuitry of the display driver 2 related to the driving of the source lines 7.

The display driver 2 includes an interface 11, a logic module 12, initial stage line latch circuitry 13, output stage line latch circuitry 14, DA converters (DACs) $\mathbf{15}_1$ to 15*m*, source amplifiers $\mathbf{16}_1$ to 16*m*, output switch circuitries $\mathbf{17}_1$ to $\mathbf{17}_{(m/2)}$, data identification circuitries $\mathbf{18}_1$ to $\mathbf{18}_m$ and amplifier control circuitries $\mathbf{19}_1$ to 19*m*.

The interface 11 receives image data from the application processor 3 and forwards the received image data to the logic module 12. A display memory (not illustrated) may be disposed between the interface 11 and the logic module 12. In such an embodiment, the image data received by the interface 11 are temporarily stored in the display memory and the image data stored in the display memory are forwarded to the logic module 12.

The logic module 12 includes image data processing circuitry 12*a* and a display timing controller 12*b*. The image data processing circuitry 12*a* performs image data processing on the image data received from the interface 11, and sequentially forwards the image data obtained by the image data processing to the initial stage line latch circuitry 13 via a line latch bus 20. The display timing controller 12*b* controls the operation timing of the display driver 2.

The initial stage line latch circuitry 13 sequentially receives the image data from the image data processing circuitry 12*a* and forwards the received image data to the output stage line latch circuitry 14. The initial stage line latch circuitry 13 includes latches $\mathbf{13}_1$ to $\mathbf{13}_m$ storing image data to be supplied to the DA converters $\mathbf{15}_1$ to 15*m*, respectively. In this embodiment, the image data stored in the latches $\mathbf{13}_1$ to $\mathbf{13}_m$ are 8-bit data.

The output stage line latch circuitry 14 receives the image data from the initial stage line latch circuitry 13 and forwards the received image data to the DA converters $\mathbf{15}_1$ to 15*m*. The output stage line latch circuitry 14 includes latches $\mathbf{14}_1$ to $\mathbf{14}_m$ associated with the DA converters $\mathbf{15}_1$ to $\mathbf{15}_m$, respectively. The latches $\mathbf{14}_1$ to $\mathbf{14}_m$ latches the image data from the latches $\mathbf{13}_1$ to $\mathbf{13}_m$ of the initial stage line latch circuitry 13 at the beginning of each horizontal sync period, and forwards the latched image data to the DA converters $\mathbf{15}_1$ to $\mathbf{15}_m$, respectively. The output stage line latch circuitry 14 stores image data actually used to drive the source lines 7 in each horizontal sync period. In the following, the image data supplied from the latch 14*i* to the DA converter 15*i* is referred to as the image data Di. In other words, the latches $\mathbf{14}_1$ to $\mathbf{14}_m$ supplies the image data $D_1$ to $D_m$ to the DA converters $\mathbf{15}_1$ to 15*m*, respectively. In this embodiment, the image data $D_1$ to $D_m$ are each 8-bit data.

The DA converters $\mathbf{15}_1$ to $\mathbf{15}_m$ perform digital-analog conversion on the image data $D_1$ to $D_m$ received from the latches $\mathbf{14}_1$ to $\mathbf{14}_m$, respectively, and output grayscale voltages corresponding to the grayscale values specified by the image data $D_1$ to $D_m$. In this embodiment, the odd-numbered DA converter $\mathbf{15}_{2k-1}$ is configured to output a positive grayscale voltage for k being any natural number equal to or less than m/2, and the even-numbered DA converter $\mathbf{15}_{2k}$ is configured to output a negative grayscale voltage. The terms "positive" and "negative" referred herein are defined with respect to the voltage level of the circuit ground of the display driver 2, that is, the circuit ground level GND.

The source amplifiers $\mathbf{16}_1$ to $\mathbf{16}_m$ output drive voltages corresponding to the grayscale voltages received from the DA converters $\mathbf{15}_1$ to $\mathbf{15}_m$, respectively. Operational amplifiers are used as the source amplifiers $\mathbf{16}_1$ to $\mathbf{16}_m$. In this embodiment, the odd-numbered source amplifier $\mathbf{16}_{2k-1}$ is configured to receive a positive grayscale voltage from the DA converter $\mathbf{15}_{2k-1}$ and output a positive drive voltage corresponding to the received grayscale voltage, for k being any natural number equal to or less than m/2. The even-numbered source amplifier $\mathbf{16}_{2k}$ is configured to receive a negative grayscale voltage from the DA converter $\mathbf{15}_{2k}$ and output a negative drive voltage corresponding to the received grayscale voltage. In this embodiment, the source amplifiers $\mathbf{16}_1$ to $\mathbf{16}_m$ are configured as voltage followers, and output drive voltages having the same voltage levels as those of the grayscale voltages received from the DA converters $\mathbf{15}_1$ to $\mathbf{15}_m$.

FIGS. 6A and 6B illustrate tables indicating the correspondence relationship between the grayscale values specified by the image data and the grayscale voltages output from the DA converters 15. In one or more embodiments, a black display corresponds to a minimum brightness grayscale level. In the embodiments of FIGS. 6A and 6B, the grayscale value "00h" corresponds to black, that is, the lowest brightness level, and "FFh" corresponds to white, that is, the highest brightness level. FIG. 6A illustrates the correspondence relationship for the case when the display panel 1 operates in the normally black mode and FIG. 6B illustrates the correspondence relationship for the case when the display panel 1 operates in the normally white mode. In this embodiment, in which the source amplifiers $\mathbf{16}_1$ to $\mathbf{16}_m$ are configured to output drive voltages having the same voltage levels as those of the grayscale voltages received from the DA converters $\mathbf{15}_1$ to $\mathbf{15}_m$, the correspondence relationship between the drive voltages and the grayscale values specified by the image data illustrated in FIGS. 6A and 6B can be considered as the same as that between the grayscale voltages and the grayscale values specified by the image data.

As illustrated in FIG. 6A, the grayscale voltage corresponding to the grayscale value "00h", which corresponds to black, is set to the circuit ground level GND, when the display panel 1 operates in the normally black mode. The voltage levels of the positive grayscale voltages are defined so that the voltage levels of the positive grayscale voltages are increased as the grayscale values specified by the image data are increased. In contrast, the voltage levels of the negative grayscale voltages are defined so that the voltage levels of the negative grayscale voltages are decreased as the grayscale values specified by the image data are increased.

When the display panel 1 operates in the normally white mode, on the other hand, the positive grayscale voltage corresponding to the grayscale value "00h", which corresponds to black, is set to the power supply voltage VSP, which is a positive power supply voltage supplied to the source amplifiers 16 configured to output positive drive voltages, that is, the odd-numbered source amplifiers 16. Additionally, the voltage levels of the positive grayscale voltages are defined so that the voltage levels of the positive grayscale voltages are decreased as the grayscale values specified by the image data are increased. This implies that the positive grayscale voltage is set to the highest voltage level when the image data specifies the grayscale value "00h", which corresponds to black.

On the other hand, the negative grayscale voltage corresponding to the grayscale value "00h", which corresponds to black, is set to the power supply voltage VSN, which is a negative power supply voltage supplied to the source amplifiers 16 configured to output negative drive voltages, that is, the even-numbered source amplifiers 16. Additionally, the voltage levels of the negative grayscale voltages are defined so that the voltage levels of the negative grayscale voltages are increased as the grayscale values specified by the image data are increased. This implies that the negative grayscale voltage is set to the lowest voltage level when the image data specifies the grayscale value "00h", which corresponds to black.

Referring back to FIG. 5, the output switch circuitries $\mathbf{17}_1$ to $\mathbf{17}_{(m/2)}$ are disposed to switch connections between the source amplifiers $\mathbf{16}_1$ to $\mathbf{16}_m$ and the source outputs $S_1$ to $S_m$ and to thereby achieve inversion drive, such as dot inversion drive and column inversion drive. Each output switch circuitry 17*k* includes straight switches 21, 22 and cross switches 23 and 24, and is configured to connect one of the outputs of the source amplifiers $\mathbf{16}_{2k-1}$ and $\mathbf{16}_{2k}$ to the source output $S_{(2k-1)}$ and the other to the source output S(2*k*).

The data identification circuitries $\mathbf{18}_1$ to $\mathbf{18}_m$ and the amplifier control circuitries $\mathbf{19}_1$ to $\mathbf{19}_m$ constitute an amplifier control system configured to control activation and deactivation of the source amplifiers $\mathbf{16}_1$ to $\mathbf{16}_m$, together with the display timing controller 12*b* of the logic module 12. In various embodiments, when an image data supplied to a DA converter 15 specifies the grayscale value "00h", which corresponds to black, the amplifier control system stops the operation of the source amplifier 16 connected to the DA converter 15, which drives the source line 7 associated with the image data. This operation effectively reduces the power consumption in displaying an image which includes an increased number of subpixels which display black.

In one embodiment, the data identification circuitries $\mathbf{18}_1$ to $\mathbf{18}_m$ respectively identify whether the image data $D_1$ to Dm supplied to the DA converters $\mathbf{15}_1$ to $\mathbf{15}_m$ specify the grayscale value "00h", which corresponds to black, and output data identification signals $\mathbf{25}_1$ to $\mathbf{25}_m$ indicative of the identification results. In one embodiment, the data identification signal 25*i* is set to "0" when the image data Di supplied to the DA converter 15*i* specifies the grayscale value "00h", and otherwise the data identification signal 25*i* is set to "1".

The amplifier control circuitries $\mathbf{19}_1$ to $\mathbf{19}_m$ generate individual amplifier control signals $\mathbf{27}_1$ to $\mathbf{27}_m$, respectively, in response to the data identification signals $\mathbf{25}_1$ to $\mathbf{25}_m$ received from the data identification circuitries $\mathbf{18}_1$ to $\mathbf{18}_m$ and the amplifier control signal 26 received from the display timing controller 12*b*.

The amplifier control signal 26 supplied from the display timing controller 12*b* is used to totally stop the amplifying operations of all of the source amplifiers 16. When the amplifying operations of all of the source amplifiers 16 are configured to be totally stopped, the amplifier control signal 26 is deactivated. In such an embodiment, the amplifier control circuitries $\mathbf{19}_1$ to $\mathbf{19}_m$ stop the amplifying operations of all of the source amplifiers 16, independently of the data identification signals $\mathbf{25}_1$ to $\mathbf{25}_m$.

When the display panel 1 is driven to display an image, the amplifier control signal 26 is activated. In such an embodiment, the amplifier control circuitries $\mathbf{19}_1$ to $\mathbf{19}_m$ generate the individual amplifier control signals $\mathbf{27}_1$ to $\mathbf{27}_m$ in response to the data identification signals $\mathbf{25}_1$ to 25*m*, respectively, to thereby control the execution and stop of the amplifying operations of the source amplifiers $\mathbf{16}_1$ to 16*m*, respectively. In one embodiment, the amplifier control circuitry 19*i* generates the individual amplifier control signals 27*i* so that the source amplifier 16*i* performs the amplifying operation, when the data identification signal 25*i* is set to "1", that is, when the image data Di supplied to the DA converter 15*i* does not specify the grayscale value "00h". When the data identification signal 25*i* is set to "0", that is, when the image data Di supplied to the DA converter 15*i* specifies the grayscale value "00h", on the other hand, the amplifier control circuitry 19*i* generates the individual amplifier control signals 27*i* so that the source amplifier 16*i* stops the amplifying operation, It should be noted that the execution and stop of the amplifying operations of the source amplifiers $\mathbf{16}_1$ to $\mathbf{16}_m$ can be individually controlled.

Figure 7A:
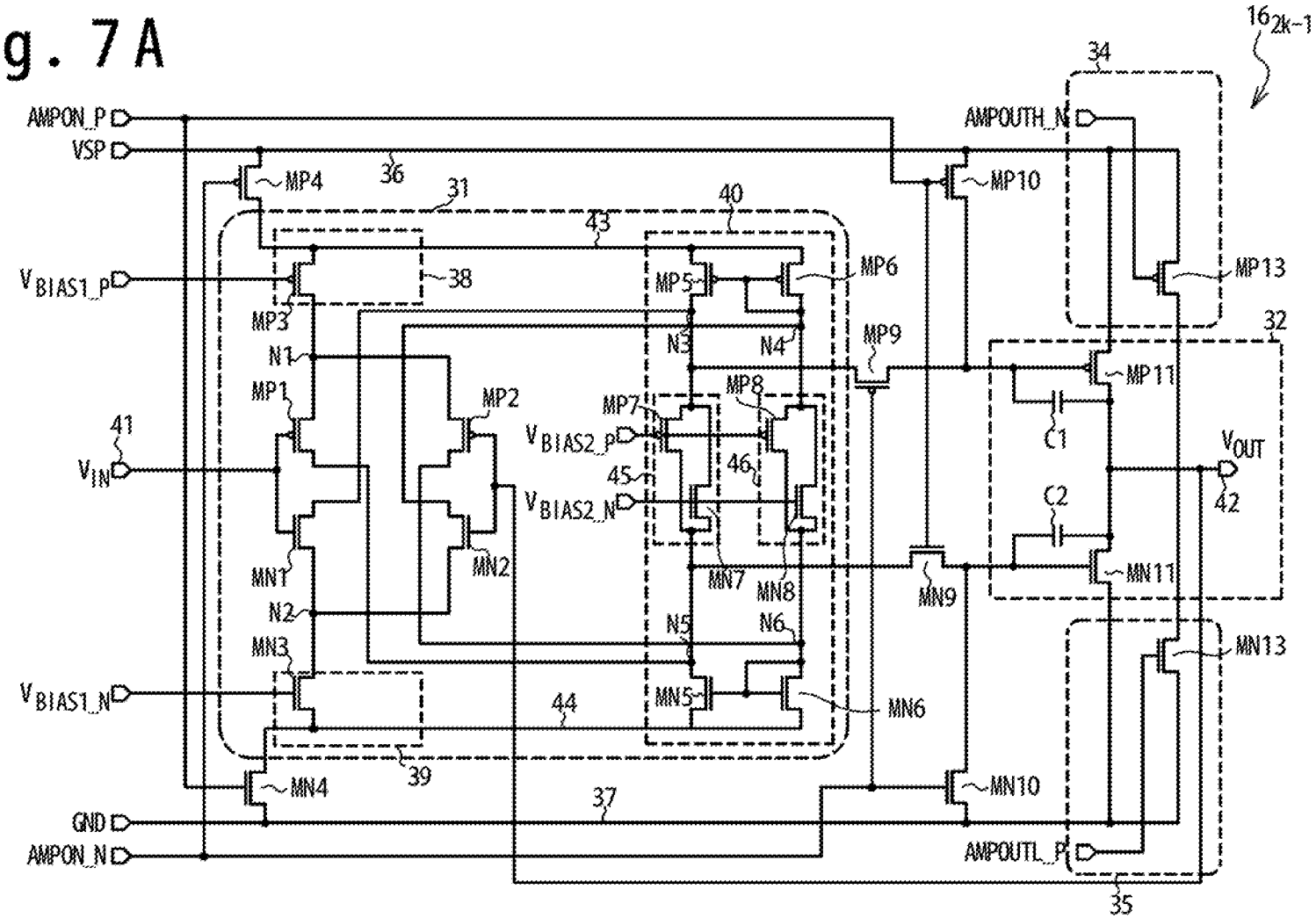
FIG. 7A is a circuit diagram of a source amplifier according to one or more embodiments.
Figure 7B:
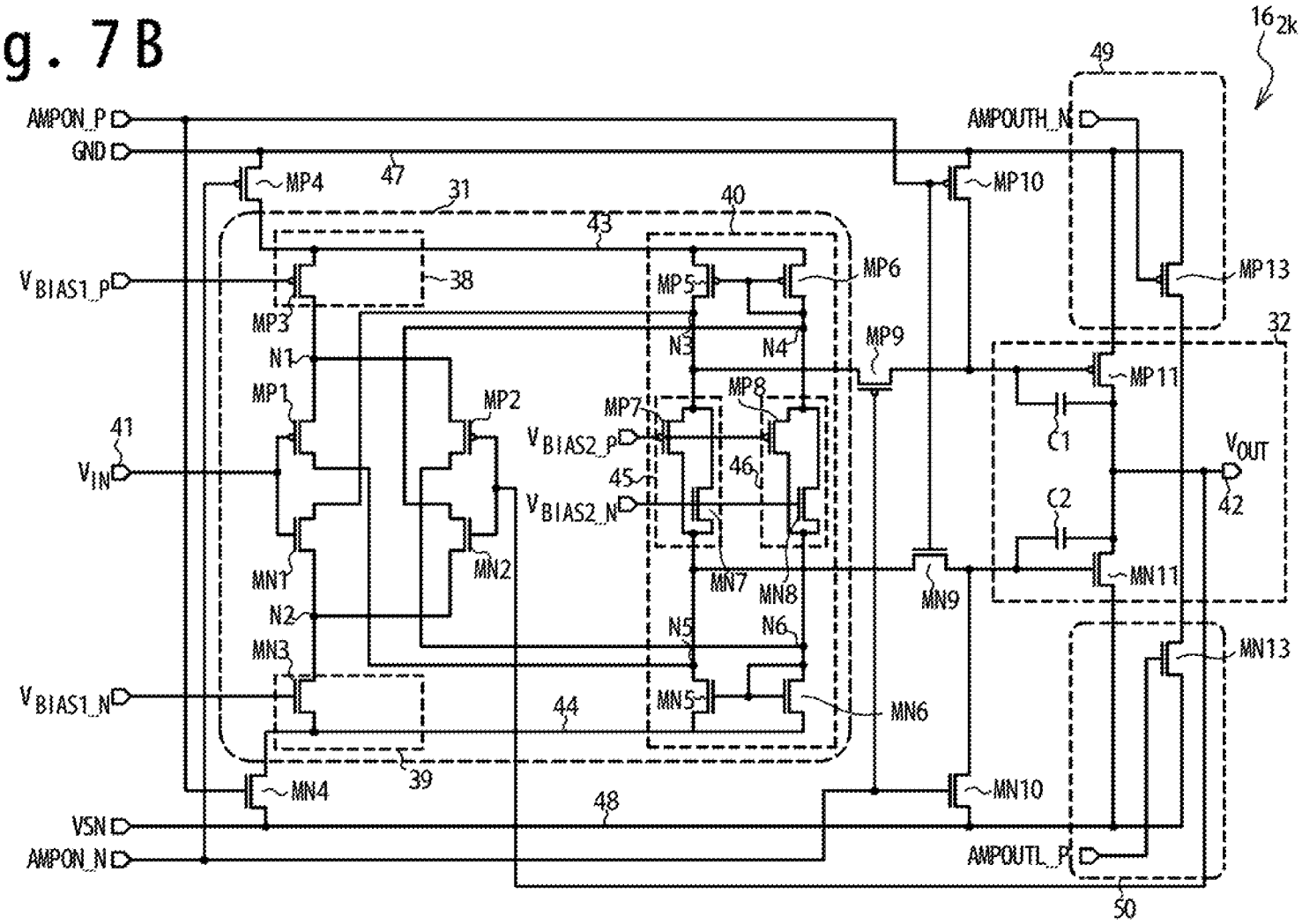
FIG. 7B is a circuit diagram of a source amplifier according to one or more embodiments.

FIG. 7A is a circuit diagram illustrating an example of the configuration of an odd-numbered source amplifier $\mathbf{16}_{2k-1}$, which is configured to output a positive drive voltage, and FIG. 7B is a circuit diagram illustrating an example of the configuration of an even-numbered source amplifier $\mathbf{16}_{2k}$, which is configured to output a negative drive voltage, where k is any natural number equal to or less than m/2. Each source amplifier 16 is configured to output from an output terminal 42 a drive voltage having the same voltage level as that of the grayscale voltage supplied from the corresponding DA converter 15 to an input terminal 41. In FIGS. 7A and 7B, the grayscale voltage supplied to the relevant source amplifier 16 is denoted by the symbol "VIN" and the drive voltage supplied outputted from the relevant source amplifier 16 is denoted by the symbol "VOUT".

The individual amplifier control signals 27 supplied to each source amplifier 16 include amplifier turn-on signals AMPON_P and AMPON_N and output control signals AMPOUTH_N and AMPOUTL_P.

The amplifier turn-on signals AMPON_P and AMPON_N are control signals to allow and stop the amplifying operation of the source amplifier 16. The amplifier turn-on signals AMPON_P and AMPON_N are complementary each other and the source amplifier 16 performs the amplifying operation when the amplifier turn-on signals AMPON_P and AMPON_N are activated. In this embodiment, the amplifier turn-on signal AMPON_P is high active and the amplifier turn-on signal AMPON_N is low active. Accordingly, when the amplifier turn-on signals AMPON_P and AMPON_N are activated, the amplifier turn-on signal AMPON_P is set to the high level and the amplifier turn-on signal AMPON_N is set to the low level.

The output control signals AMPOUTH_N and AMPOUTL_P are a pair of control signals specifying the drive voltage to be outputted from the output terminal 42 when the amplifying operation is stopped. The output control signal AMPOUTH_N is a low-active signal and the output control signal AMPOUTL_P is a high-active signal. When the output control signals AMPOUTH_N and AMPOUTL_P are activated, the output control signal AMPOUTH_N is set to the low level and the output control signal AMPOUTL_P is set to the high level. Each source amplifier 16 operates in response to the amplifier turn-on signals AMPON_P, AMPON_N and the output control signals AMPOUTH_N and AMPOUTL_P.

Referring to FIG. 7A, the odd-numbered source amplifier $\mathbf{16}_{2k-1}$, which is configured to output a positive drive voltage, includes a differential stage 31, an output stage 32, a VSP output switch 34, a GND output switch 35, a power line 36 supplied with the power supply voltage VSP and a ground line 37 supplied with the circuit ground level GND. The power supply voltage VSP is a positive power supply voltage, which is higher than the circuit ground level GND.

The differential stage 31 includes PMOS transistors MP1, MP2, NMOS transistors MN1, MN2, constant current sources 38, 39, active load circuitry 40, an internal power line 43 and an internal ground line 44.

The PMOS transistors MP1 and MP2 have sources commonly connected to a node $N_1$ to form a PMOS differential pair. The gate of the PMOS transistor MP1 is connected to the input terminal 41, and the gate of the PMOS transistor MP2 is connected to the output terminal 42. The drain of the PMOS transistor MP1 is connected to a node N5 in the active load circuitry 40, and the drain of the PMOS transistor MP2 is connected to a node N6 in the active load circuitry 40.

The NMOS transistors MN1 and MN2 have sources commonly connected to a node $P_1$ to form an NMOS differential pair. The gate of the NMOS transistor MN1 is connected to the input terminal 41, and the gate of the NMOS transistor MN2 is connected to the output terminal 42. The drain of the NMOS transistor MN1 is connected to a node N3 of the active load circuitry 40, and the drain of the NMOS transistor MN2 is connected to a node N4 of the active load circuitry 40.

The constant current source 38 is configured to supply a constant bias current to the node N1 and the constant current source 39 is configured to withdraw a constant bias current from the node N2. In this embodiment, the constant current source 38 includes a PMOS transistor MP3 having a source connected to the internal power line 43 and a drain connected to the node N1. A bias voltage VBIAS1_P is supplied to the gate of the PMOS transistor MP3. The constant current source 39 includes an NMOS transistor MN3 having a source connected to the internal ground line 44 and a drain connected to the node N2. A bias voltage VBIAS1_N is supplied to the gate of the NMOS transistor MN3.

The active load circuitry 40 includes PMOS transistors MP5, MP6, NMOS transistors MN5, MN6, and floating current sources 45 and 46.

The PMOS transistors MP5 and MP6 constitute a current mirror. The sources of the PMOS transistors MP5 and MP6 are commonly connected to the internal power line 43, and the drains of the PMOS transistors MP5 and MP6 are connected to the nodes N3 and N4, respectively. The gates of the PMOS transistors MP5 and MP6 are commonly connected to the drain of the PMOS transistor MP6, that is, the node N4.

NMOS transistors MN5 and MN6 constitute another current mirror. The sources of the NMOS transistors MN5 and MN6 are commonly connected to the internal ground line 44 and the drains of the NMOS transistors MN5 and MN6 are connected to the nodes N5 and N6, respectively. The gates of the NMOS transistors MN5 and MN6 are commonly connected to the drain of the NMOS transistor MP6, that is, the node N6.

The floating current source 45 is connected between the nodes N3 and N5 and configured to generate a constant bias current flowing from the node N3 to node N5. The floating current source 45 includes a PMOS transistor MP7 and an NMOS transistor MN7. The PMOS transistor MP7 has a source connected to the node N3, a drain connected to the node N5 and a gate supplied with a bias voltage VBIAS2_P. The NMOS transistor MN7 has a source connected to the node N5, a drain connected to the node N3 and a gate supplied with a bias voltage VBIAS2_N.

The floating current source 46 is connected between the node N4 and the node N6 and configured to generate a constant current flowing from the node N4 to the node N6. The floating current source 46 includes a PMOS transistor MP8 and an NMOS transistor MN8. The PMOS transistor MP8 has a source connected to the node N4, a drain connected to the node N6 and a gate supplied with the bias voltage VBIAS2_P. The NMOS transistor MN8 has a source connected to the node N6, a drain connected to the node N4 and a gate supplied with the bias voltage VBIAS2_N.

A switch element, in this embodiment, a PMOS transistor MP4 is disposed between the power line 36 and the internal power line 43 of the differential stage 31, and another switch element, in this embodiment, an NMOS transistor MN4 is disposed between the ground line 37 and the internal ground line 44 of the differential stage 31. The PMOS transistors MP4 and the NMOS transistor MN4 are disposed to control the supply of the power supply voltage VSP and the circuit ground level GND to the differential stage 31.

The output stage 32 is configured to output a drive voltage VOUT in response to the potentials on the nodes N3 and N5 of the active load circuitry 40. The output stage 32 includes a PMOS transistor MP11, an NMOS transistor MN11 and capacitors C1 and C2. The PMOS transistor MP11 and the NMOS transistor MN11 both operate as an output transistor.

The PMOS transistor MP11 has a source connected to the power line 36 and a drain connected to the output terminal 42. The gate of the PMOS transistor MP11 is connected to the node N3 of the active load circuitry 40 of the differential stage 31 via a switch element, in this embodiment, a PMOS transistor MP9. The gate of the PMOS transistor MP11 is further connected to the power line 36 via the PMOS transistor MP10. The gate of the PMOS transistor MP9 is supplied with the amplifier turn-on signal AMPON_N, and the gate of the PMOS transistor MP10 is supplied with the amplifier turn-on signal AMPON_P.

The NMOS transistor MN11 has a source connected to the ground line 37 and a drain connected to the output terminal 42. The gate of the NMOS transistor MN11 is connected to the node N5 of the active load circuitry 40 of the differential stage 31 via a switch element, in this embodiment, an NMOS transistor MN9. The gate of the NMOS transistor MN11 is also connected to the ground line 37 via the NMOS transistor MN10. The gate of the NMOS transistor MN9 is supplied with the amplifier turn-on signal AMPON_P and the gate of the NMOS transistor MN10 is supplied with the amplifier turn-on signal AMPON_N.

The capacitors C1 and C2 provide phase compensation of the drive voltage outputted from the output terminal 42. The capacitor C1 is connected between the drain and gate of the PMOS transistor MP11, and the capacitor C2 is connected between the drain and gate of the NMOS transistor MN11.

The VSP output switch 34 is used to pull up the output terminal 42 to the power supply voltage VSP. In this embodiment, the VSP output switch 34 includes a PMOS transistor MP13. The PMOS transistor MP13 has a source connected to the power line 36 and a drain connected to the output terminal 42. The gate of the PMOS transistor MP13 is supplied with the output control signal AMPOUTH_N.

The GND output switch 35 is used to pull down the output terminal 42 to the circuit ground level GND. In this embodiment, the GND output switch 35 includes an NMOS transistor MN13. The NMOS transistor MN13 has a source connected to the ground line 37 and a drain connected to the output terminal 42. The gate of the NMOS transistor MN13 is supplied with the output control signal AMPOUTL_P.

When the source amplifier $16_{2k-1}$ illustrated in FIG. 7A performs the amplifying operation, the amplifier turn-on signals AMPON_N and AMPON_P are activated and the output control signals AMPOUTH_N and AMPOUTL_P are deactivated. When the amplifier turn-on signals AMPON_N and AMPON_P are activated, the PMOS transistor MP4 and the NMOS transistor MN4 are turned on to supply the power supply voltage VSP and the circuit ground level GND to the differential stage 31 from the power line 36 and the ground line 37. This allows the constant current sources 38, 39 and the floating current sources 45 and 46 to generate the bias currents to operate the differential stage 31. Additionally, when the amplifier turn-on signals AMPON_N and AMPON_P are activated, the PMOS transistor MP9 and the NMOS transistor MN9 are turned on to connect the differential stage $\mathbf{3}_1$ to the output stage 32. This allows the source amplifier $\mathbf{16}_{2k-1}$ to perform the amplifying operation. In this embodiment, the output terminal 42 is connected to the gate of the PMOS transistor MP2 of the PMOS differential pair of the differential stage 31 and the gate of the NMOS transistor MN2 of the NMOS differential pair, and accordingly the source amplifier $\mathbf{16}_{2k-1}$ operates as a voltage follower.

When the amplifier turn-on signals AMPON_N and AMPON_P are deactivated, the source amplifier $\mathbf{16}_{2k-1}$ stops the amplifying operation. In one embodiment, the PMOS transistor MP4 and the NMOS transistor MN4 are turned off in response to the deactivation of the amplifier turn-on signals AMPON_N and AMPON_P to stop supplying the power supply voltage VSP and the circuit ground level GND from the power line 36 and the ground line 37 to the differential stage 31. In this state, the constant current sources 38, 39 and the floating current sources 45 and 46 do not generate the bias currents, and therefore the differential stage 31 stops operating. Additionally, when the amplifier turn-on signals AMPON_N and AMPON_P are deactivated, the PMOS transistor MP9 and the NMOS transistor MN9 are turned off to disconnect the differential stage 31 from the output stage 32. In one or more embodiments, the PMOS transistor MP10 and the NMOS transistor MN10 are turned on to fix the gates of the PMOS transistor MP11 and the NMOS transistor MN11 to the power supply voltage VSP and the circuit ground level GND, respectively. This causes the source amplifier $\mathbf{16}_{2k-1}$ to stop the amplifying operation.

The drive voltage outputted from the output terminal 42 is controllable on the output control signals AMPOUTH_N and AMPOUTL_P, when the source amplifier $\mathbf{16}_{2k-1}$ does not perform the amplifying operation. When the output control signal AMPOUTH_N is activated and the output control signal AMPOUTL_P is deactivated, the PMOS transistor MP13 of the VSP output switch 34 is turned on to output the power supply voltage VSP from the output terminal 42. When the output control signal AMPOUTL_P is activated and the output control signal AMPOUTH_N is deactivated, the NMOS transistor MN13 of the GND output switch 35 is turned on to output the circuit ground level GND from the output terminal 42.

With reference to FIG. 7B, an even-numbered source amplifier 162*k*, which is configured to output a negative drive voltage, is configured similarly to the odd-numbered source amplifier $\mathbf{16}_{2k-1}$, except for that the power line 36 supplied with the power supply voltage VSP is replaced with a ground line 47 fixed to the circuit ground level GND and the ground line 37 fixed to the circuit ground level GND is replaced with a power line 48 supplied with a power supply voltage VSN, which is a negative power supply voltage.

In the even-numbered source amplifier $\mathbf{16}_{2k}$, which is configured to output a negative drive voltage, the PMOS transistor MP13 operates as a GND output switch 49 configured to output the circuit ground level GND to the output terminal 42 in response to the output control signal AMPOUTH_N. In one or more embodiments, the NMOS transistor MN13 operates as a VSN output switch 50 configured to output the power supply voltage VSN to the output terminal 42 in response to the output control signal AMPOUTL_P.

The configuration of the source amplifiers 16 may be variously modified. It should be noted however that commonly-used amplifiers include a current source generating a bias current and are configured to be able to stop the amplifying operation by stopping the operation of the current source. Also when differently-configured operational amplifiers are used as the source amplifiers 16, the source amplifiers 16 are configured to be able to stop the operation of a current source generating a bias current in response to the individual amplifier control signals 27 or the amplifier turn-on signals AMPON_N and AMPON_P.

In the following, the operation of the display device 100 according to one or more embodiments is described. First, a description is given of the case when the display panel 1 is operated in the normally black mode. In such an embodiment, the correspondence relationship between the grayscale values specified by the image data supplied to each DA converter 15 and the grayscale voltage outputted from the DA converter 15 is as illustrated in FIG. 6A. It should be noted that each DA converter 15 is configured to output the circuit ground level GND as the grayscale voltage, when an image data supplied thereto specifies the grayscale value "00h", which corresponds to black. This means that a source amplifier 16 associated with an image data that specifies the grayscale value "00h" should output the circuit ground level GND.

In one or more embodiments, the straight switches 21 and 22 of the output switch circuitries $\mathbf{17}_1$ to $\mathbf{17}_m$ are turned on and the outputs of the source amplifiers $\mathbf{16}_1$ to $\mathbf{16}_m$ are connected to the source outputs $S_1$ to $S_m$, respectively. Although the output switch circuitries $\mathbf{17}_1$ to $\mathbf{17}_m$ switch connections between the source amplifiers $\mathbf{16}_1$ to $\mathbf{16}_m$ and the source outputs $S_1$ to $S_m$ at a given cycle period when an inversion drive scheme is used, the execution of the inversion drive is of less importance in the technique disclosed in this specification.

Additionally, the amplifier control signal 26 is assumed to be activated by the display timing controller 12*b*. When an image is displayed on the display panel 1, the amplifier control signal 26 is activated to place the amplifier control circuitries $\mathbf{19}_1$ to $\mathbf{19}_m$ into a state in which the amplifier control circuitries $\mathbf{19}_1$ to $\mathbf{19}_m$ generate the individual amplifier control signals $\mathbf{27}_1$ to $\mathbf{27}_m$ in response to the data identification signals $\mathbf{25}_1$ to $\mathbf{25}_m$ received from the data identification circuitries $\mathbf{18}_1$ to $\mathbf{18}_m$.

Overall, the display device 100 of this embodiment operates as follows. In the display device 100 of this embodiment, the amplifying operation of a source amplifier 16 that supplies a drive voltage to a pixel circuit 8 which displays black is stopped, when the drive voltage is written into the pixel circuit 8. The stopping of the amplifying operation is achieved by stopping the operations of current sources included in the source amplifier 16, in this embodiment, the constant current sources 38, 39 and the floating current sources 45 and 46. This operation effectively reduces the power consumption when performing black display. Additionally, the source amplifier 16 is configured to output the drive voltage corresponding to black display, when the amplifying operation of the source amplifier 16 is stopped. A detailed description is given below of the operation of the display device 100 of this embodiment.

Figure 8:
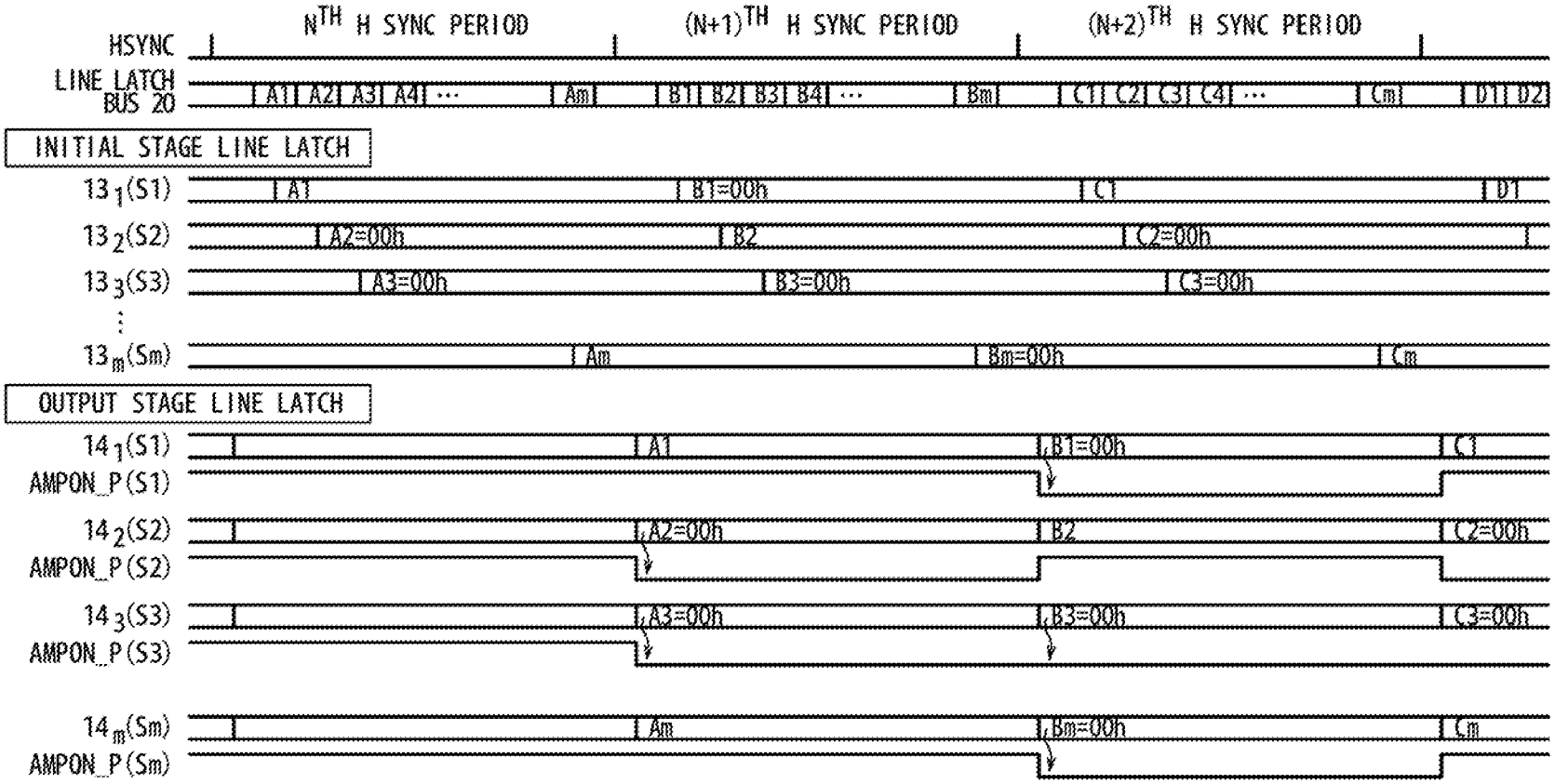
FIG. 8 is a timing chart illustrating the operation of the display device according to one or more embodiments.

FIG. 8 is a timing chart illustrating an example of the operation of the display device 100 of this embodiment. Illustrated in FIG. 8 is the operation of the display device 100 of this embodiment in the Nth to $(N+2)^{th}$ horizontal sync period. In FIG. 8, the legend "HSYNC" represents a horizontal sync signal, which is activated at the timing when each horizontal sync period begins.

In the Nth horizontal sync period, image data are sequentially transferred from the image data processing circuitry 12*a* of the logic module 12 to the initial stage line latch circuitry 13 via the line latch bus 20. In FIG. 8, the image data sequentially transferred to the initial stage line latch circuitry 13 in the $N^{th}$ horizontal sync period are denoted by the legends "A1" to "Am". The image data $A_1$ to Am are stored in the latches $\mathbf{13}_1$ to $\mathbf{13}_m$ of the initial stage line latch circuitry 13.

In one or more embodiments, the image data $A_2$ and $A_3$ stored in the latches $\mathbf{13}_2$ and $\mathbf{13}_3$ of the initial stage line latch circuitry 13 specify the grayscale value "00h", which corresponds to black, in the Nth horizontal sync period. In various embodiments, the image data $A_2$ and $A_3$ specify the grayscale values with respect to the drive voltages outputted from the source outputs $S_2$ and $S_3$.

In the $(N+1)^{th}$ horizontal sync period, the pixel circuits 8 are driven in response to the image data $A_1$ to $A_m$, which have been transferred to the initial stage line latch circuitry 13 in the Nth horizontal sync period.

In one embodiment, when the $(N+1)^{th}$ horizontal sync period starts, the gate line 6 associated with the pixel circuits 8 to be driven in the (N+1) horizontal sync period is activated and the image data $A_1$ to $A_m$ are transferred from the initial stage line latch circuitry 13 to the output stage line latch circuitry 14. The image data $A_1$ to $A_m$ are latched by the latches $\mathbf{14}_1$ to $\mathbf{14}_m$ of the output stage line latch circuitry 14, and this allows supplying the image data $A_1$ to $A_m$ to the DA converters $\mathbf{15}_1$ to $\mathbf{15}_m$. The DA converters $\mathbf{15}_1$ to $\mathbf{15}_m$ generate the grayscale voltages corresponding to the grayscale values specified by the image data $A_1$ to $A_m$, and supply the grayscale voltages thus generated.

Since the image data $A_2$ and $A_3$ specify the grayscale value "00h", which corresponds to black, the data identification signals $\mathbf{25}_2$ and $\mathbf{25}_3$ are set to "0" by the data identification circuitries $\mathbf{18}_2$ and $\mathbf{18}_3$ and the amplifier control circuitries $\mathbf{19}_2$ and $\mathbf{19}_3$ generate the individual amplifier control signals $\mathbf{27}_2$ and $\mathbf{27}_3$ so as to stop the amplifying operations of the source amplifiers $\mathbf{16}_2$ and $\mathbf{16}_3$ in response to the data identification signals $\mathbf{25}_2$ and $\mathbf{25}_3$. In other words, the amplifier turn-on signals AMPON_P and AMPON_N of the individual amplifier control signals $\mathbf{27}_2$ and $\mathbf{27}_3$, which are supplied to the source amplifiers $\mathbf{16}_2$ and $\mathbf{16}_3$, are deactivated. As described above, when the amplifier turn-on signals AMPON_P and AMPON_N are deactivated, the operations of the current sources of the source amplifiers $\mathbf{16}_2$ and $\mathbf{16}_3$, that is, the constant current sources 38, 39 and the floating current sources 45 and 46 in this embodiment, are stopped to stop the amplifying operations of the source amplifiers $\mathbf{16}_2$ and $\mathbf{16}_3$. In FIG. 8, the legend "AMPON_P (S2)" indicates the waveform of the amplifier turn-on signal AMPON_P supplied to the source amplifier $\mathbf{16}_2$ and the legend "AMPON_P(S3)" indicates the waveform of the amplifier turn-on signal AMPON_P supplied to the source amplifier $\mathbf{16}_3$.

In one or more embodiments, the amplifier control circuitry $\mathbf{19}_2$ activates the output control signal AMPOUTH_N of the individual amplifier control signals $\mathbf{27}_2$ and deactivates the output control signal AMPOUTL_P. In response to the activation of the output control signal AMPOUTH_N, the source amplifier $\mathbf{16}_2$, which is configured to output a negative drive voltage, sets the drive voltage outputted to the source output S2 to the circuit ground level GND. Similarly, the amplifier control circuitry $\mathbf{19}_3$ activates the output control signal AMPOUTL_P of the individual amplifier control signals $\mathbf{27}_3$ and deactivates the output control signal AMPOUTH_N. In response to the activation of the output control signal AMPOUTL_P, the source amplifier $\mathbf{16}_3$, which is configured to output a positive drive voltage, sets the drive voltage outputted to the source output S3 to the circuit ground level GND. It should be noted that the grayscale voltage and the drive voltage corresponding to the grayscale value "00h", which corresponds to black, are the circuit ground level GND, when the display panel 1 operates in the normally black mode. The source amplifiers $\mathbf{16}_2$ and $\mathbf{16}_3$ are controlled to stop the amplifying operations thereof, while outputting the drive voltages corresponding to the grayscale value "00h".

The data identification signals 25 outputted from the data identification circuitries 18 other than the data identification circuitries $\mathbf{18}_2$ and $\mathbf{18}_3$ are set to "1". Accordingly, the amplifier control circuitries 19 other than the amplifier control circuitries $\mathbf{19}_2$ and $\mathbf{19}_3$ generate the individual amplifier control signals 27 to allow the associated source amplifiers 16 to perform the amplifying operations. The source amplifiers 16 other than the source amplifiers $\mathbf{16}_2$ and $\mathbf{16}_3$ operate as voltage followers to output the drive voltages having the same voltage levels as those of the grayscale voltages received from the associated DA converters 15.

This operation effectively reduces the power consumption, since the source amplifiers $\mathbf{16}_2$ and $\mathbf{16}_3$ stop the amplifying operations, which are associated with the image data $A_2$ and $A_3$ specifying the grayscale value "00h", which corresponds to black. In this operation, the source amplifiers $\mathbf{16}_2$ and $\mathbf{16}_3$ are placed into the state in which the source amplifiers $\mathbf{16}_2$ and $\mathbf{16}_3$ output the drive voltages corresponding to the grayscale value "00h".

In parallel to the above-described operation in the (N+1) horizontal sync period, image data are sequentially transferred to the initial stage line latch circuitry 13 from the image data processing circuitry 12*a* via the line latch bus 20. The image data sequentially transferred to the initial stage line latch circuitry 13 in the $(N+1)^{th}$ horizontal sync period are denoted by the legends "B1" to "Bm" in FIG. 8. The image data $B_1$ to $B_m$ are stored in the latches $\mathbf{13}_1$ to $\mathbf{13}_m$ of the initial stage line latch circuitry 13, respectively.

In one or more embodiments, the image data $B_1$, $B_3$ and $B_m$ transferred in the $(N+1)^{th}$ horizontal sync period to the latches $\mathbf{13}_1$, $\mathbf{13}_3$ and $\mathbf{13}_m$ of the initial stage line latch circuitry 13 specify the grayscale value "00h", which corresponds to black. The image data $B_1$, $B_3$ and $B_m$ specify the grayscale values with respect to the drive voltages outputted from the source outputs $S_1$, $S_3$ and $S_m$, respectively.

In the $(N+2)^{th}$ horizontal sync period, the pixel circuits 8 are driven in response to the image data $B_1$ to Bm, which have been transferred to the initial stage line latch circuitry 13 in the $(N+1)^{th}$ horizontal sync period. The pixel circuits 8 are driven in the $(N+2)^{th}$ horizontal sync period similarly to the (N+1)th horizontal sync period, except for that the image data B1 to Bm are used in place of the image data $A_1$ to Am. Since the image data $B_1$, $B_3$ and $B_m$ specify the grayscale value "00h", which corresponds to black, the amplifying operation of the source amplifiers $\mathbf{16}_1$, $\mathbf{16}_3$ and $\mathbf{16}_m$ are stopped in the $(N+2)^{th}$ horizontal sync period.

In one embodiment, the data identification signals $\mathbf{25}_1$, $\mathbf{25}_3$ and $\mathbf{25}_m$ are set to "0" by the data identification circuitries $\mathbf{18}_1$, $\mathbf{18}_3$ and $\mathbf{18}_m$ and the amplifier control circuitries $\mathbf{19}_1$, $\mathbf{19}_3$ and $\mathbf{19}_m$ generate the individual amplifier control signals $\mathbf{27}_1$, $\mathbf{27}_3$ and $\mathbf{27}_m$ so as to stop the amplifying operations of the source amplifiers $\mathbf{16}_1$, $\mathbf{16}_3$ and $\mathbf{16}_m$ in response to the data identification signals $\mathbf{25}_1$, $\mathbf{25}_3$ and $\mathbf{25}_m$. In other words, the amplifier turn-on signals AMPON_P and AMPON_N of the individual amplifier control signals $27_1$, $27_3$ and $27_m$, which are supplied to the source amplifiers $16_1$, $16_3$ and $16_m$, are deactivated. As described above, when the amplifier turn-on signals AMPON_P and AMPON_N are deactivated, the operations of the current sources of the source amplifiers $16_1$, $16_3$ and $16_m$, that is, the constant current sources 38, 39 and the floating current sources 45 and 46 in this embodiment, are stopped to stop the amplifying operation of the source amplifiers $16_1$, $16_3$ and $16_m$. In FIG. 8, the legend "AMPON_P(S1)", "AMPON_P(S3)" and "AMPON_P(Sm)" indicate the waveforms of the amplifier turn-on signals AMPON_P supplied to the source amplifier $16_1$, $16_3$ and $16_m$, respectively.

In one or more embodiments, the amplifier control circuitry $19_1$, $19_3$ and $19_m$ generate the individual amplifier control signals $27_1$, $27_3$ and $27_m$ so that the drive voltages supplied from the source amplifiers $16_1$, $16_3$ and $16_m$ to the source outputs $S_1$, $S_3$ and $S_m$ are set to the circuit ground level GND. In one embodiment, the amplifier control circuitries $19_1$ and $19_3$ activate the output control signals AMPOUTL_P of the individual amplifier control signals $27_1$ and $27_3$ and deactivate the output control signals AMPOUTH_N. The amplifier control circuitries $19m$, on the other hand, activates the output control signals AMPOUTH_N of the individual amplifier control signals $27_m$ and deactivates the output control signals AMPOUTL_P. This allows the source amplifiers $16_1$, $16_3$ and $16_m$ to stop the amplifying operation while outputting the drive voltages corresponding to the grayscale value "00h", which corresponds to black.

The data identification signals 25 outputted from the data identification circuitries 18 other than the data identification circuitries $18_1$, $18_3$ and $18_m$ are set to "1". Accordingly, the amplifier control circuitries 19 other than the amplifier control circuitries $19_1$, $19_3$ and $19_m$ generate the individual amplifier control signals 27 to allow the associated source amplifiers 16 to perform the amplifying operations. The source amplifiers 16 other than the source amplifiers $16_1$, $16_3$ and $16_m$ operate as voltage followers to output the drive voltages having the same voltage levels as those of the grayscale voltages received from the associated DA converters 15.

A similar operation is performed when the display panel 1 operates in the normally white mode. In such an embodiment, the correspondence relationship between the grayscale value specified by the image data supplied to each DA converter 15 and the grayscale voltage outputted from the DA converter 15 is modified as illustrated in FIG. 6B and the drive voltage outputted from a source amplifier 16 when the source amplifier 16 stops the amplifying operation is accordingly modified.

In one embodiment, as illustrated in FIG. 6B, when an image data supplied to an odd-numbered DA converter $15_{2k-1}$, which is configured to generate a positive grayscale voltage, specifies the grayscale value "00h", which corresponds to black, the grayscale voltage outputted from the DA converter 15 is set to the power supply voltage VSP. When an image data supplied to an even-numbered DA converter $15_{2k}$, which is configured to generate a negative grayscale voltage, specifies the grayscale value "00h", the grayscale voltage outputted from the DA converter 15 is set to the power supply voltage VSN.

Additionally, the odd-numbered source amplifier $16_{2k-1}$ outputs the power supply voltage VSP when the amplifying operation of the source amplifier 16 is stopped, and the even-numbered source amplifier $16_{2k-1}$ outputs the power supply voltage VSN when the amplifying operation of the source amplifier 16 is stopped.

In one embodiment, the data identification circuitry $18_{2k-1}$ associated with the odd-numbered source amplifier $16_{2k-1}$ sets the data identification signal $25_{2k-1}$ to "0", when the image data $D_{2k-1}$ supplied to the odd-numbered DA converter $15_{2k-1}$ specifies the grayscale value "00h", which corresponds to black. The amplifier control circuitry $19_{2k-1}$ generates the individual amplifier control signals $27_{2k-1}$ so as to stop the amplifying operation of the source amplifier $16_{2k-1}$ in response to the data identification signal $25_{2k-1}$ being set to "0". In other words, the amplifier turn-on signals AMPON_P and AMPON_N of the individual amplifier control signals $27_{2k-1}$ supplied to the source amplifier $16_{2k-1}$ are deactivated. As described above, when the amplifier turn-on signals AMPON_P and AMPON_N are deactivated, the operation of the current sources of the differential stage 31, that is, the constant current sources 38, 39 and the floating current sources 45 and 46, of the source amplifier $16_{2k-1}$ is stopped to stop the amplifying operation of the source amplifier $16_{2k-1}$.

In one or more embodiments, the amplifier control circuitry $19_{2k-1}$ activates the output control signal AMPOUTH_N and deactivates the output control signal AMPOUTL_P. The source amplifier $16_{2k-1}$ sets the drive voltage outputted therefrom to the power supply voltage VSP in response to the activation of the output control signal AMPOUTH_N; also see FIG. 7A. It should be noted that the positive grayscale voltage and the positive drive voltage that correspond to the grayscale value "00h", which corresponds to black, are the power supply voltage VSP when the display panel 1 operates in the normally white mode. This implies that the source amplifier $16_{2k-1}$ is placed into the state in which the source amplifier $16_{2k-1}$ stops the amplifying operation and outputs the drive voltage corresponding to the grayscale value "00h".

In one or more embodiments, the data identification circuitry $18_{2k}$ associated with the even-numbered source amplifier $16_{2k}$ sets the data identification signal $25_{2k}$ to "0", when the image data $D_{2k}$ supplied to the even-numbered DA converter $15_{2k}$ specifies the grayscale value "00h", which corresponds to black. The amplifier control circuitry $19_{2k}$ generates the individual amplifier control signals $27_{2k}$ so as to stop the amplifying operation of the source amplifier $16_{2k}$ in response to the data identification signal 252*k*. In other words, the amplifier turn-on signals AMPON_P and AMPON_N of the individual amplifier control signals $27_{2k}$ supplied to the source amplifier $16_{2k}$ are deactivated. As described above, when the amplifier turn-on signals AMPON_P and AMPON_N are deactivated, the operation of the current sources of the differential stage 31, that is, the constant current sources 38, 39 and the floating current sources 45 and 46 in this embodiment, of the source amplifier $16_{2k}$ is stopped to stop the amplifying operation of the source amplifier 162*k*.

In one or more embodiments, the amplifier control circuitry $19_{2k}$ activates the output control signal AMPOUTL_P and deactivates the output control signal AMPOUTH_N. In response to the activation of the output control signal AMPOUTL_P, the source amplifier $16_{2k}$ sets the drive voltage outputted therefrom to the power supply voltage VSN; also see FIG. 7B. It should be noted that the negative grayscale voltage and the negative drive voltage that correspond to the grayscale value "00h", which corresponds to black, are the power supply voltage VSN when the display panel 1 operates in the normally white mode. This implies that the source amplifier $16_{2k}$ is placed into the state in which the source amplifier $16_{2k}$ stops the amplifying operation and outputs the drive voltage corresponding to the grayscale value "00h".

Figure 9:
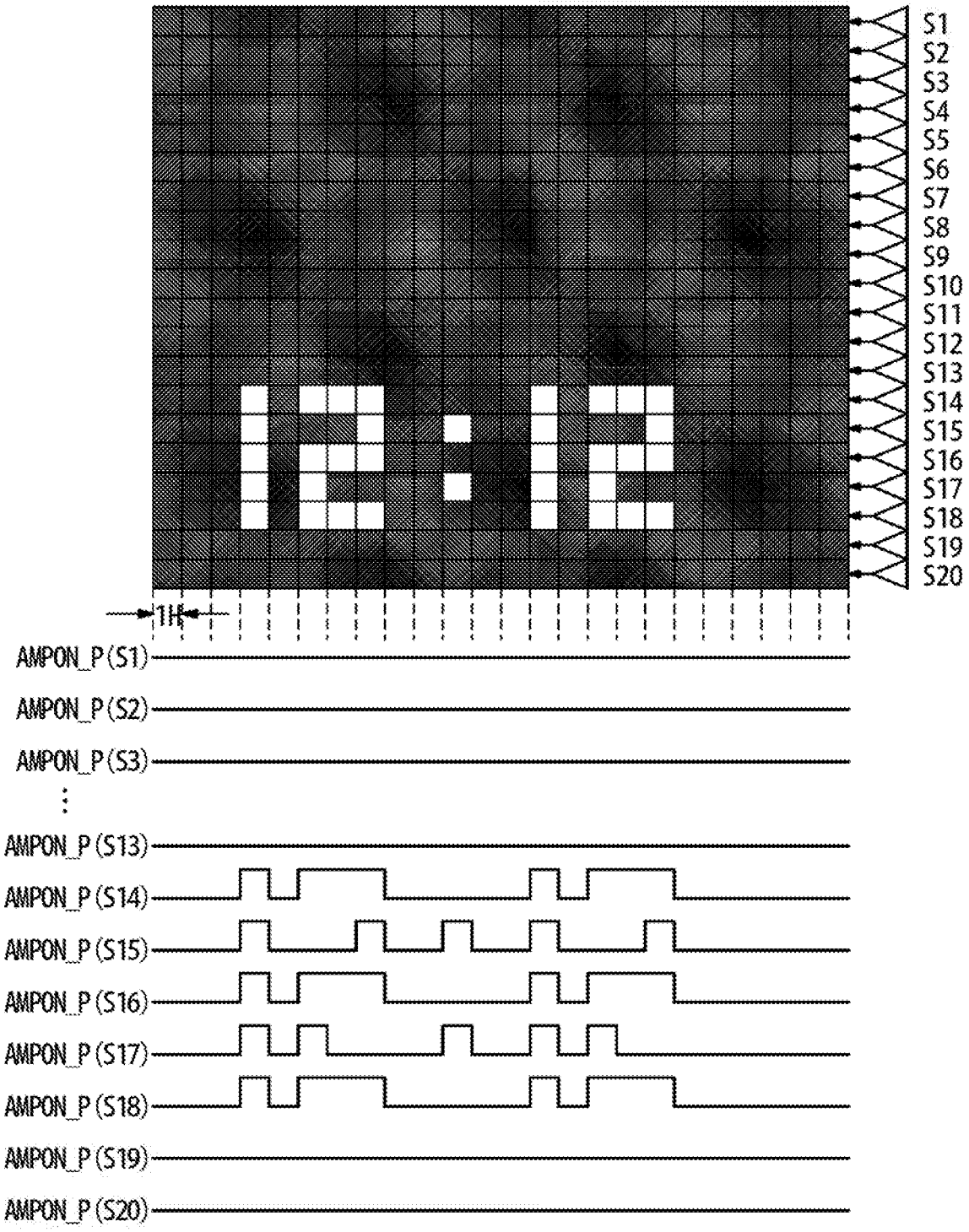
FIG. 9 illustrates amplifier turn-on signals according to one or more embodiments.

FIG. 9 schematically illustrates the correspondence between an image displayed by the display device 100 of this embodiment and the waveforms of the amplifier turn-on signals AMPON_P supplied to the source amplifiers 16. For easiness of understanding, FIG. 9 illustrates the operation of the display device 100 under an assumption that the number m of the source outputs, that is, the number of the source amplifiers 16 is 20. In the example illustrated in FIG. 9, the image displayed on the display panel 1 includes characters "12:12".

The upper part of FIG. 9 illustrates the association of the image and the source outputs $S_1$ to $S_{20}$, that is, the pixel circuits 8 of the display panel 1 and the source outputs $S_1$ to S20. The lower part of FIG. 9 illustrates the states of the amplifier turn-on signals AMPON_P supplied to the respective source amplifiers 16 at the timing when the respective pixel circuits 8 of the display panel 1 are driven. In FIG. 9, the waveforms of the amplifier turn-on signals AMPON_P are illustrated under an assumption that the pixel circuits 8 are sequentially driven from left to right of the image. The legend "1H" in FIG. 9 represents one horizontal sync period.

In one or more embodiments, the source outputs $S_1$ to S13, S19 and S20 are connected to pixel circuits 8 displayed as black during all the horizontal sync periods, and accordingly the source amplifiers 16 connected to the source outputs $S_1$ to S13, S19 and S20 stop the amplifying operations during all of the horizontal sync periods. The amplifier turn-on signals AMPON_P supplied to the source amplifiers 16 connected to the source outputs $S_1$ to S13, S19 and S20 are deactivated during all the horizontal sync periods.

The source amplifiers 16 connected to the source outputs S14 to S18 perform the amplifying operations only during horizontal sync periods during which the source amplifiers 16 are connected to pixel circuits 8 engaged to display the characters "12:12". The amplifier turn-on signals AMPON_P supplied to the source amplifiers 16 connected to the source outputs S14 to S18 are activated during the horizontal sync periods during which the source amplifiers 16 are connected to pixel circuits 8 engaged to display the characters "12:12", and deactivated during horizontal sync periods during which the source amplifiers 16 are connected to pixel circuits 8 which display black. The source amplifiers 16 connected to the source outputs S14 to S18 perform the amplifying operation only when the amplifier turn-on signals AMPON_P supplied thereto are activated. This operation effectively reduces the power consumption.

As described above, the display device 100 of this embodiment is configured so that the amplifying operations of source amplifiers 16 supplying drive voltages to pixel circuits 8 which display black are stopped, when the drive voltages are written into the pixel circuits 8. Additionally, in the display device 100 of this embodiment, the source amplifiers 16 are each configured to output the drive voltage corresponding to black when the amplifying operation thereof is stopped. This operation allows reducing the power consumption depending on the display image.

Although the data identification circuitries 18, which identify whether the image data supplied to the respective DA converters 15 specify the grayscale value corresponding to black, are provided for the respective source amplifiers 16 in the above-described embodiment, the logic module 12 may be configured to identify whether each image data specifies the grayscale value corresponding to black portions of the display panel in an alternative embodiment.

Figure 10:
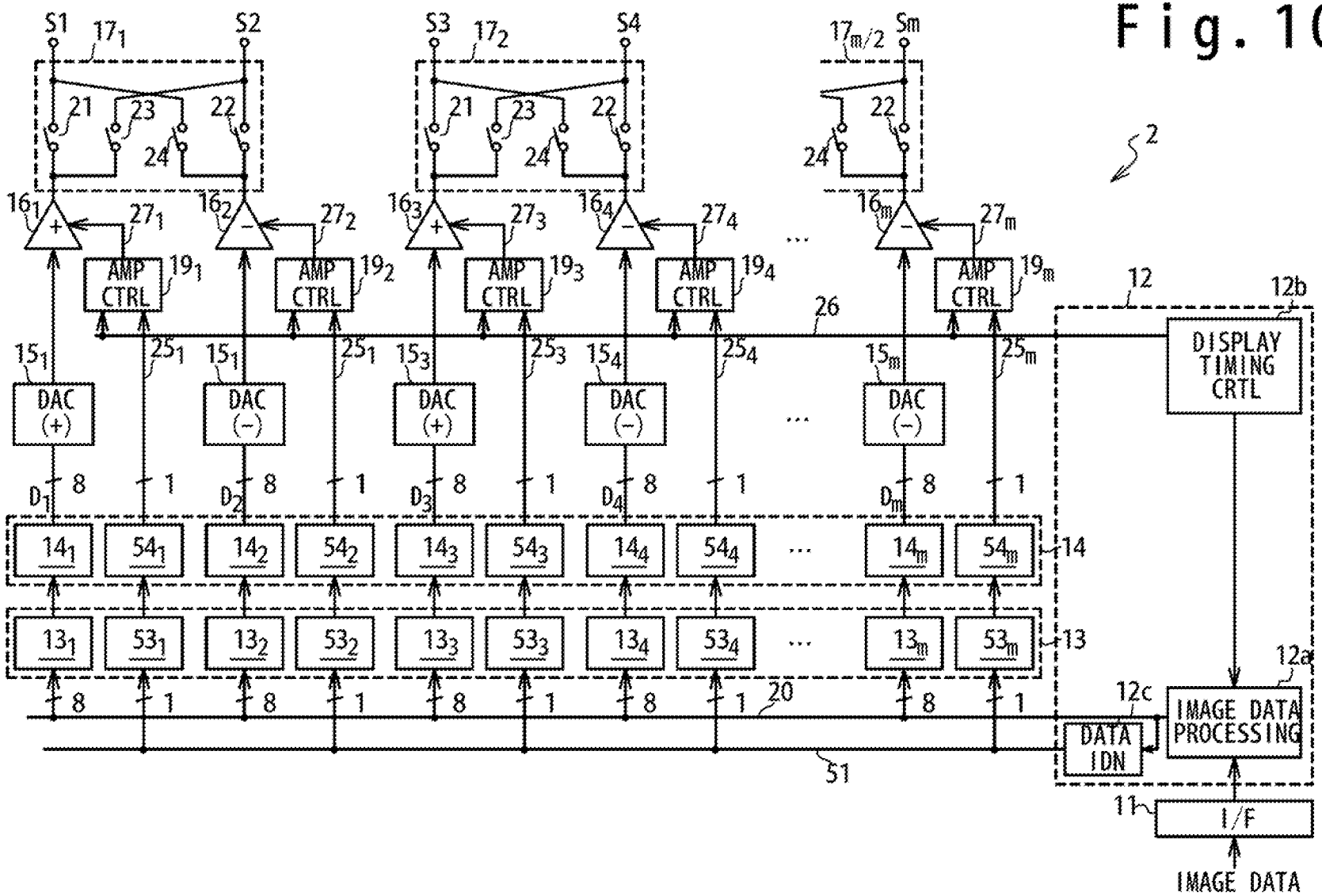
FIG. 10 is a block diagram illustrating a configuration of the display driver according to one or more embodiments.

FIG. 10 is a block diagram illustrating the configuration of the display driver 2 in which the logic module 12 is configured to identify whether each image data specifies the grayscale value "00h", which corresponds to black. In the configuration illustrated in FIG. 10, the data identification circuitries $18_1$ to 18*m* are removed and a data identification circuitry 12*c* is provided in the logic module 12. The initial stage line latch circuitry 13 includes latches $53_1$ to 53*m* in addition to the latches $13_1$ to 13*m*, which latches image data, and the output stage line latch circuitry 14 includes latches $54_1$ to 54*m* in addition to the latches $14_1$ to 14*m*, which latches image data. The data identification circuitry 12*c* is connected to the latches $53_1$ to 53*m* of the initial stage line latch circuitry 13 via an amplifier control bus 51 and the latches $53_1$ to $53_m$ are connected to the latches $54_1$ to $54_m$ of the output stage line latch circuitry 14, respectively. The outputs of the latches $54_1$ to $54_m$ are connected to the amplifier control circuitries $19_1$ to 19*m*, respectively. The output signals supplied from the latches $54_1$ to $54_m$ to the amplifier control circuitries $19_1$ to 19*m* are used as the data identification signals $25_1$ to 25*m*.

The display driver 2 illustrated in FIG. 10 schematically operates as follows. The data identification circuitry 12*c* identifies whether the image data specify the grayscale value "00h", which corresponds to black, when the image data are sequentially transferred to the initial stage line latch circuitry 13 via the line latch bus 20 and outputs a data identification bit for each of the transferred image data. Each of the data identification bits is a one-bit data indicating whether the associated image data specifies the grayscale value "00h". The data identification bits are transferred to the initial stage line latch circuitry 13 via the amplifier control bus 51 and stored in the latches $53_1$ to 53*m*. The data identification bits stored in the latches $53_1$ to $53_m$ are latched by the latches $54_1$ to $54_m$ of the output stage line latch circuitry 14. The latches $54_1$ to $54_m$ supply data identification signals $25_1$ to 25*m* corresponding to the latched data identification bits to the amplifier control circuitries $19_1$ to 19*m*. The amplifier control circuitries $19_1$ to 19*m* operate as described above.

Figure 11:
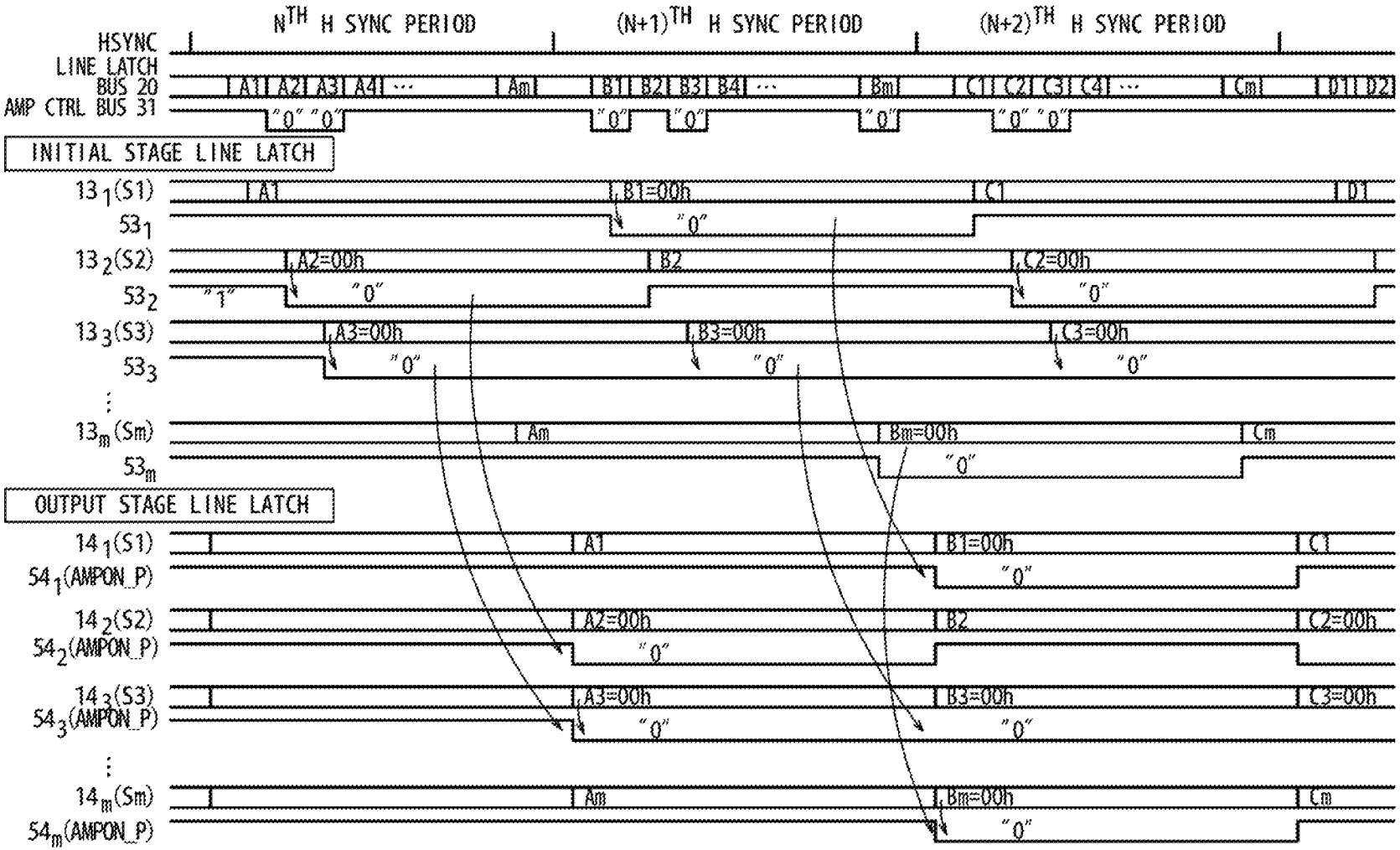
FIG. 11 is a timing chart for a display driver according to one or more embodiments.

FIG. 11 is a timing chart illustrating an example of the operation of the display driver 2 illustrated in FIG. 10. Illustrated in FIG. 11 is the operation of the display device 100 of this embodiment during the Nth to $(N+2)^{th}$ horizontal sync periods.

In the Nth horizontal sync period, image data are sequentially transferred from the image data processing circuitry 12*a* of the logic module 12 to the initial stage line latch circuitry 13 via the line latch bus 20. In FIG. 11, the image data sequentially transferred to the initial stage line latch circuitry 13 in the Nth horizontal sync period are denoted by the legends "A1" to "Am". The image data $A_1$ to Am are stored in the latches $13_1$ to 13*m* of the initial stage line latch circuitry 13.

In one or more embodiments, the data identification circuitry 12*c* identifies whether each of the image data $A_1$ to Am, which are sequentially transferred to the initial stage line latch circuitry 13, specifies the grayscale value "00h", which corresponds to black, to generate the data identification bits. The data identification circuitry 12*c* stores the data identification bits thus generated into the latches $53_1$ to 53*m*. For example, when the image data Ai transferred to the latch 13*i* specifies the grayscale value "00h", the data identification bit associated with the image data Ai is set to "0" and stored in the latch 53*i*.

In one or more embodiments, the image data $A_2$ and $A_3$ stored in the latches $13_2$ and $13_3$ of the initial stage line latch circuitry 13 in the Nth horizontal sync period specify the grayscale value "00h". In various embodiments, the image data $A_2$ and $A_3$ specify the grayscale values with respect to the drive voltages outputted from the source outputs $S_2$ and S3.

In such an embodiment, the data identification bits stored in the latches $\mathbf{53}_2$ and $\mathbf{53}_3$ of the initial stage line latch circuitry 13 are set to "0". The data identification bits stored in the remaining latches 53 are set to "1".

In the $(N+1)^{th}$ horizontal sync period, selected pixel circuits 8 are driven in response to the image data $A_1$ to Am, which have been transferred to the initial stage line latch circuitry 13 in the Nth horizontal sync period.

In one embodiment, the gate line 6 associated with the pixels 10 to be driven in the (N+1) horizontal sync period is activated and the latches $\mathbf{14}_1$ to $\mathbf{14}m$ of the output stage line latch circuitry 14 latches the image data $A_1$ to Am from the latches $\mathbf{13}_1$ to $\mathbf{13}m$ of the initial stage line latch circuitry 13, respectively. The latches $\mathbf{14}_1$ to $\mathbf{14}m$ of the output stage line latch circuitry 14 supply the image data $A_1$ to Am to the DA converters $\mathbf{15}_1$ to $\mathbf{15}m$, respectively, and the DA converters $\mathbf{15}_1$ to $\mathbf{15}m$ generate grayscale voltages corresponding to the grayscale values specified in the image data $A_1$ to Am, respectively. The grayscale voltages generated by the DA converters $\mathbf{15}_1$ to $\mathbf{15}m$ are supplied to the source amplifiers $\mathbf{16}_1$ to $\mathbf{16}m$, respectively.

In one or more embodiments, the latches $\mathbf{54}_1$ to $\mathbf{54}_m$ of the output stage line latch circuitry 14 latches the data identification bits from the latches $\mathbf{53}_1$ to $\mathbf{53}m$ of the initial stage line latch circuitry 13. This results in that the data identification signals $\mathbf{25}_2$ and $\mathbf{25}_3$ are set to "0", since the data identification bits associated with the image data $A_2$ and $A_3$, which are latched by the latches $\mathbf{54}_2$ and $\mathbf{54}_3$, are "0". The amplifier control circuitries $\mathbf{19}_2$ and $\mathbf{19}_3$ generate the individual amplifier control signals $\mathbf{27}_2$ and $\mathbf{27}_3$ so as to stop the amplifying operations of the source amplifiers $\mathbf{16}_2$ and $\mathbf{16}_3$ in response to the data identification signals $\mathbf{25}_2$ and $\mathbf{25}_3$. In other words, the amplifier turn-on signals AMPON_P and AMPON_N of the individual amplifier control signals $\mathbf{27}_2$ and $\mathbf{27}_3$, which are supplied to the source amplifiers $\mathbf{16}_2$ and $\mathbf{16}_3$, are deactivated. As described above, when the amplifier turn-on signals AMPON_P and AMPON_N are deactivated, the operations of the current sources of the differential stage 31 of the source amplifiers $\mathbf{16}_2$ and $\mathbf{16}_3$, that is, the constant current sources 38, 39 and the floating current sources 45 and 46, are stopped to stop the amplifying operations of the source amplifiers $\mathbf{16}_2$ and $\mathbf{16}_3$. FIG. 11 illustrates the values of the data identification bits stored in the latches $\mathbf{54}_2$ and $\mathbf{54}_3$ together with the waveforms of the amplifier turn-on signals AMPON_P supplied to the source amplifier $\mathbf{16}_2$ and $\mathbf{16}_3$.

Additionally, depending on whether the display panel 1 operates in the normally black mode or the normally white mode, the amplifier control circuitries 192 and 193 each activate one of the output control signals AMPOUTH_N and AMPOUTL_P for the respective individual amplifier control signals $\mathbf{27}_2$ and $\mathbf{27}_3$, respectively, and deactivate the other.

When the display panel 1 operates in the normally black mode, the amplifier control circuitries 192 and 193 output the output control signals AMPOUTH_N and AMPOUTL_P so that the drive voltages supplied from the source amplifiers $\mathbf{16}_2$ and $\mathbf{16}_3$ to the source outputs S2 and S3 are set to the circuit ground level GND. It should be noted that the grayscale voltage and the drive voltage corresponding to the grayscale value "00h", which corresponds to black, are the circuit ground level GND, when the display panel 1 operates in the normally black mode. This implies that the source amplifiers $\mathbf{16}_2$ and $\mathbf{16}_3$ are placed in the state in which the source amplifiers $\mathbf{16}_2$ and $\mathbf{16}_3$ output the drive voltages corresponding to the grayscale value "00h", while stopping the amplifying operation.

When the display panel 1 operates in the normally white mode, on the other hand, the amplifier control circuitry 192 outputs the output control signals AMPOUTH_N and AMPOUTL_P so that the drive voltage supplied from the source amplifiers 162, which is configured to output a negative drive voltage, to the source output S2 is set to the power supply voltage VSN, and the amplifier control circuitry 193 outputs the output control signals AMPOUTH_N and AMPOUTL_P so that the drive voltage supplied from the source amplifiers 163, which is configured to output a positive drive voltage, to the source output S3 is set to the power supply voltage VSP. It should be noted that, when the display panel 1 operates in the normally while mode, the positive grayscale voltage and the positive drive voltage corresponding to the grayscale value "00h", which corresponds to black, are the power supply voltage VSP, and the negative grayscale voltage and the negative drive voltage corresponding to the grayscale value "00h" are the power supply voltage VSN. Also In such an embodiment, the source amplifiers $\mathbf{16}_2$ and $\mathbf{16}_3$ are placed in the state in which the source amplifiers $\mathbf{16}_2$ and $\mathbf{16}_3$ output the drive voltages corresponding to the grayscale value "00h", while stopping the amplifying operations thereof.

The data identification signals 25 outputted from ones of the latches $\mathbf{54}_1$ to $\mathbf{54}_m$ other than the latches 542 and 543 are set to "1". Accordingly, the amplifier control circuitries 19 other than the amplifier control circuitries 192 and 193 generate the individual amplifier control signals 27 so that the associated source amplifiers 16 perform the amplifying operations. The source amplifiers 16 other than the source amplifiers $\mathbf{16}_2$ and $\mathbf{16}_3$ operate as voltage followers, and output the drive voltages having the same voltage levels as those of the grayscale voltages received from the associated DA converters 15.

In parallel to the above-described operation in the (N+1) horizontal sync period, image data are sequentially transferred to the initial stage line latch circuitry 13 from the image data processing circuitry 12*a* via the line latch bus 20. The image data sequentially transferred to the initial stage line latch circuitry 13 in the $(N+1)^{th}$ horizontal sync period are denoted by the legends "B1" to "Bm" in FIG. 11. The image data $B_1$ to Bm are stored in the latches $\mathbf{13}_1$ to $\mathbf{13}m$ of the initial stage line latch circuitry 13.

In one or more embodiments, the data identification circuitry 12*c* identifies whether each of the image data $B_1$ to Bm, which are sequentially transferred to the initial stage line latch circuitry 13, specifies the grayscale value "00h", which corresponds to black, to generate the data identification bits. The data identification circuitry 12*c* stores the data identification bits thus generated into the latches $\mathbf{53}_1$ to $\mathbf{53}m$. For example, when the image data Bi transferred to the latch $\mathbf{13}i$ specifies the grayscale value "00h", the data identification bit associated with the image data Bi is set to "0" and stored in the latch $\mathbf{53}i$.

In one or more embodiments, the image data $B_1$, $B_3$ and $B_m$ stored in the latches 131, 133 and $\mathbf{13}m$ of the initial stage line latch circuitry 13 in the $(N+1)^{th}$ horizontal sync period specify the grayscale value "00h". The image data $B_1$, $B_3$ and $B_m$ specify the grayscale values with respect to the drive voltages outputted from the source outputs $S_1$, $S_3$ and $S_m$. In such an embodiment, the data identification bits stored in the latches 531, 533 and $\mathbf{53}m$ of the initial stage line latch circuitry 13 are set to "0". The data identification bits stored in the remaining latches 53 are set to "1".

In the $(N+2)^{th}$ horizontal sync period, selected pixel circuits 8 are driven in response to the image data $B_1$ to Bm, which have been transferred to the initial stage line latch circuitry 13 in the $(N+1)^{th}$ horizontal sync period. The pixel circuits 8 are driven in the $(N+2)^{th}$ horizontal sync period similarly to the $(N+1)^{th}$ horizontal sync period, except for that the image data $B_1$ to Bm are used in place of the image data $A_1$ to Am. Since the image data $B_1$, $B_3$ and $B_m$ specify the grayscale value "00h", which corresponds to black, the amplifying operations of the source amplifiers $\mathbf{16}_1$, $\mathbf{16}_3$ and $\mathbf{16}_m$ are stopped in the $(N+2)^{th}$ horizontal sync period.

In one embodiment, since the data identification bits associated with the image data $B_1$, $B_3$ and $B_m$, that is, the data identification bits latched by the latches $\mathbf{54}_1$, $\mathbf{54}_3$ and $\mathbf{54}_m$ are "0", the data identification signals $\mathbf{25}_1$, $\mathbf{25}_3$ and $\mathbf{25}_m$ are set to "0". The amplifier control circuitries $\mathbf{19}_1$, $\mathbf{19}_3$ and $\mathbf{19}_m$ generate the individual amplifier control signals $\mathbf{27}_1$, $\mathbf{27}_3$ and $\mathbf{27}_m$ so as to stop the amplifying operations of the source amplifiers $\mathbf{16}_1$, $\mathbf{16}_3$ and $\mathbf{16}_m$ in response to the data identification signals $\mathbf{25}_1$, $\mathbf{25}_3$ and $\mathbf{25}_m$. In other words, the amplifier turn-on signals AMPON_P and AMPON_N of the individual amplifier control signals $\mathbf{27}_1$, $\mathbf{27}_3$ and $\mathbf{27}_m$, which are supplied to the source amplifiers $\mathbf{16}_1$, $\mathbf{16}_3$ and $\mathbf{16}_m$, are deactivated. As described above, when the amplifier turn-on signals AMPON_P and AMPON_N are deactivated, the operations of the current sources of the differential stage 31 of the source amplifiers $\mathbf{16}_1$, $\mathbf{16}_3$ and $\mathbf{16}_m$, that is, the constant current sources 38, 39 and the floating current sources 45 and 46, are stopped to stop the amplifying operations of the source amplifiers $\mathbf{16}_1$, $\mathbf{16}_3$ and $\mathbf{16}_m$.

In one or more embodiments, depending on whether the display panel 1 operates in the normally black mode or the normally white mode, the amplifier control circuitries $\mathbf{19}_1$, $\mathbf{19}_3$ and $\mathbf{19}_m$ each activate one of the output control signals AMPOUTH_N and AMPOUTL_P for the respective individual amplifier control signals $\mathbf{27}_1$, $\mathbf{27}_3$ and $\mathbf{27}_m$, respectively, and deactivate the other of the output control signals AMPOUTH_N and AMPOUTL_P.

When the display panel 1 operates in the normally black mode, the amplifier control circuitries $\mathbf{19}_1$, $\mathbf{19}_3$ and $\mathbf{19}_m$ output the output control signals AMPOUTH_N and AMPOUTL_P so that the drive voltages supplied from the source amplifiers $\mathbf{16}_1$, $\mathbf{16}_3$ and $\mathbf{16}_m$ to the source outputs $S_1$, $S_3$ and $S_m$ are set to the circuit ground level GND. It should be noted that the grayscale voltage and the drive voltage corresponding to the grayscale value "00h", which corresponds to black, are the circuit ground level GND, when the display panel 1 operates in the normally black mode.

When the display panel 1 operates in the normally white mode, on the other hand, the amplifier control circuitry $\mathbf{19}_1$ and $\mathbf{19}_3$ output the output control signals AMPOUTH_N and AMPOUTL_P so that the drive voltages supplied from the source amplifiers $\mathbf{16}_1$ and $\mathbf{16}_3$ to the source outputs $S_1$ and $S_3$ are set to the power supply voltage VSP, and the amplifier control circuitry $\mathbf{19}m$ outputs the output control signals AMPOUTH_N and AMPOUTL_P so that the drive voltage supplied from the source amplifiers $\mathbf{16}m$ to the source output Sm is set to the power supply voltage VSN. It should be noted that, when the display panel 1 operates in the normally while mode, the positive grayscale voltage and the positive drive voltage corresponding to the grayscale value "00h", which corresponds to black, are the power supply voltage VSP, and the negative grayscale voltage and the negative drive voltage corresponding to the grayscale value "00h" are the power supply voltage VSN.

The data identification signals 25 outputted from ones of the latches $\mathbf{54}_1$ to $\mathbf{54}_m$ other than the latches $\mathbf{54}_1$, $\mathbf{54}_3$ and $\mathbf{54}_m$ are set to "1". Accordingly, the amplifier control circuitries 19 other than the amplifier control circuitries $\mathbf{19}_1$, $\mathbf{19}_3$ and $\mathbf{19}_m$ generate the individual amplifier control signals 27 so that the associated source amplifiers 16 perform the amplifying operations. The source amplifiers 16 other than the source amplifiers $\mathbf{16}_1$, $\mathbf{16}_3$ and $\mathbf{16}_m$ operate as voltage followers, and output the drive voltages having the same voltage levels as those of the grayscale voltages received from the associated DA converters 15.

Also in the configuration and operation illustrated in FIGS. 10 and 11, the amplifying operation of a source amplifier 16 which supplies a drive voltage to a pixel circuit 8 that displays black is stopped when the drive voltage is written into the pixel circuit 8. Additionally, the source amplifier 16 is configured to output the drive voltage corresponding to black portions of the display panel when the amplifying operation thereof is stopped. This operation effectively reduces the power consumption, depending on the display image.

Figure 12A:
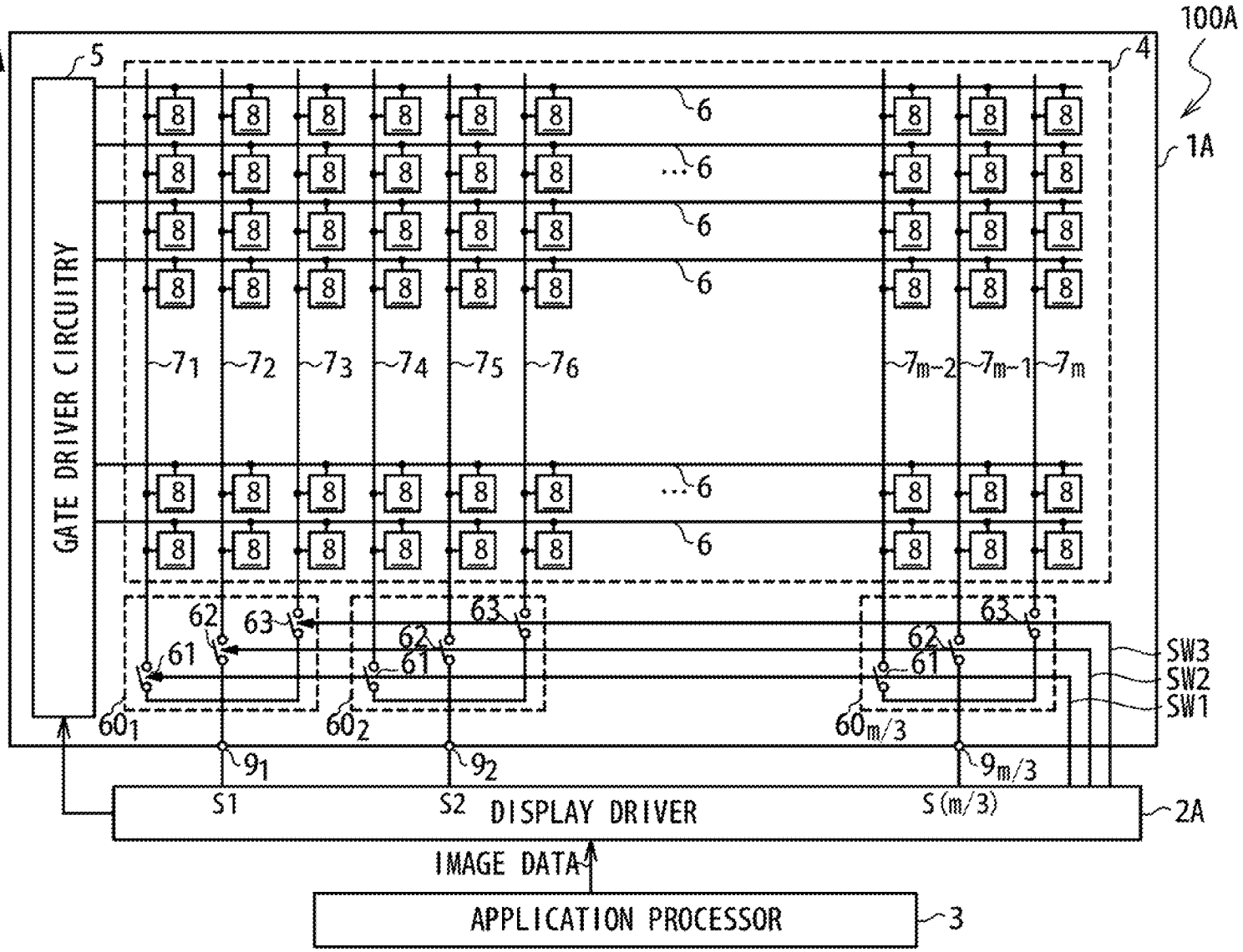
FIG. 12A is a block diagram illustrating a display device according to one or more embodiments.

FIG. 12A is a block diagram illustrating the configuration of a display device 100A in according to one or more embodiments. Also in one or more embodiments, the amplifying operation of a source amplifier 16 which supplies a drive voltage to a pixel circuit 8 that displays black is stopped when the drive voltage is written into the pixel circuit 8, and the source amplifier 16 is configured to output the drive voltage corresponding to black when the amplifying operation thereof is stopped. The display device 100A is further configured to be adapted to the so-called time-divisional drive scheme.

In one embodiment, the display driver 2A includes m/3 source outputs $S_1$ to S(m/3) and the display panel 1A includes m/3 panel input terminals $\mathbf{9}_1$ to $\mathbf{9}_{m/3}$ and m/3 switch circuitries $\mathbf{60}_1$ to $\mathbf{60}_{m/3}$, where m is the number of source lines 7 of the display panel 1A; in embodiment, m is a multiple of six. In this embodiment, the source outputs $S_1$ to S(m/3) of the display driver 2A are respectively connected to the panel input terminals $\mathbf{9}_1$ to $\mathbf{9}_{m/3}$, which are connected to the switch circuitries $\mathbf{60}_1$ to $\mathbf{60}_{m/3}$, respectively.

Figure 12B:
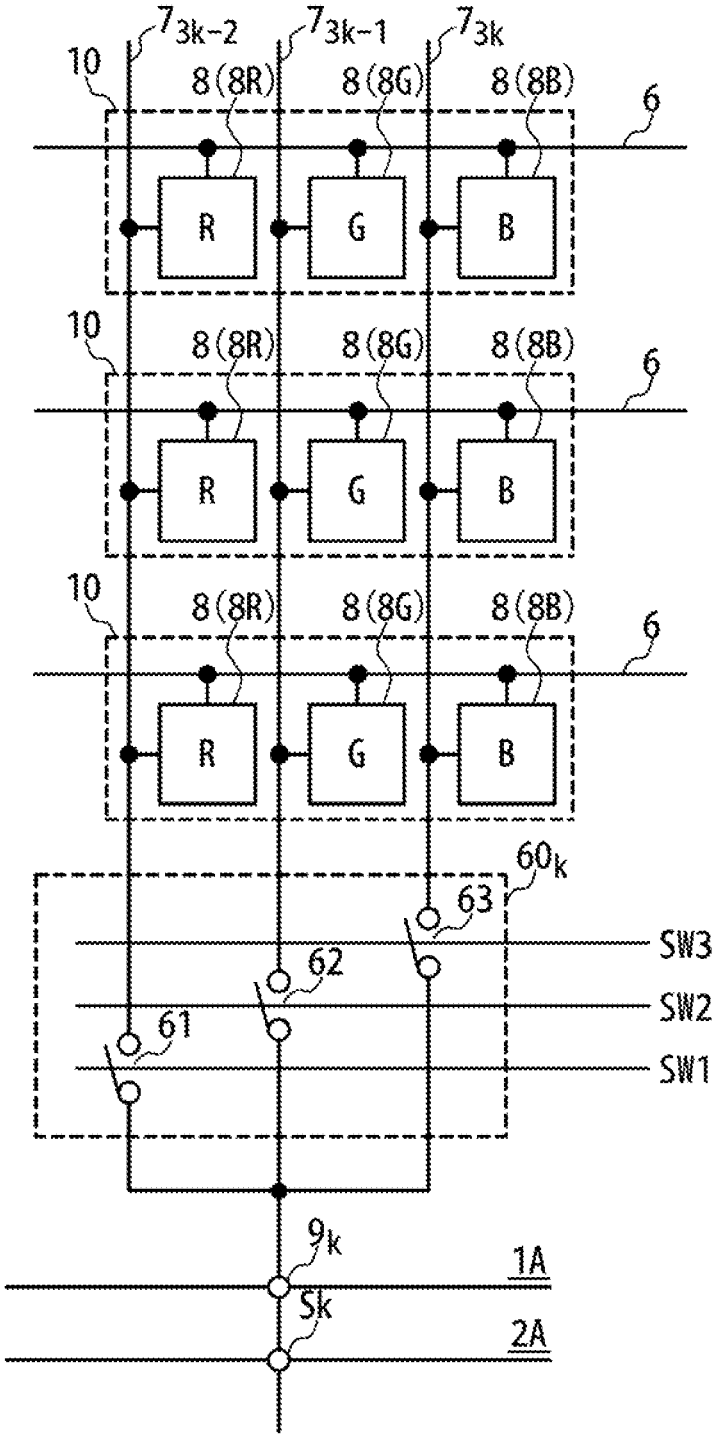
FIG. 12B is a circuit diagram of a display panel according to one or more embodiments.

As illustrated in FIG. 12B, each switch circuitry $\mathbf{60}k$ is connected to three source lines $\mathbf{7}_{3k-2}$, $\mathbf{7}_{3k-1}$ and $\mathbf{7}_{3k}$ and configured to connect a selected one of the source lines $\mathbf{7}_{3k-2}$, $\mathbf{7}_{3k-1}$ and $\mathbf{7}_{3k}$ to the panel input terminal $\mathbf{9}_k$, that is, the corresponding source output Sk, in response to control signals $SW_1$ to SW3. In this embodiment, each switch circuitry $\mathbf{60}k$ includes a switch 61 connected between the panel input terminal $\mathbf{9}_k$ and the source line $\mathbf{7}_{3k-2}$, a switch 62 connected between the panel input terminal $\mathbf{9}_k$ and the source line $\mathbf{7}_{3k-1}$, and a switch 63 connected between the panel input terminal $\mathbf{9}_k$ and the source line $\mathbf{7}_{3k}$. The switch 61 is turned on to connect the source line $\mathbf{7}_{3k-2}$ to the panel input terminal $\mathbf{9}_k$ when the control signal SW1 is activated. Similarly, the switch 62 is turned on to connect the source line $\mathbf{7}_{3k-1}$ to the panel input terminal $\mathbf{9}_k$ when the control signal SW2 is activated, and the switch 63 is turned on to connect the source line $\mathbf{7}_{3k}$ to the panel input terminal $\mathbf{9}_k$ when the control signal SW3 is activated.

In this embodiment, the $(3k-2)^{th}$ source line $\mathbf{7}_{3k-2}$ is connected to pixel circuits 8 displaying red, that is, R subpixels 8R, the $(3k-1)^{th}$ source line $\mathbf{7}_{3k-1}$ is connected to pixel circuits 8 displaying green, that is, G subpixels 8G, and the $(3k)^{th}$ source line $\mathbf{7}_{3k}$ is connected to pixel circuits 8 displaying blue, that is, B subpixels 8B, where k is any natural number equal to or less than m/3. Accordingly, the source output Sk of the display driver 2A is connected to R subpixels 8R when the control signal SW1 is activated. Similarly, the source output Sk is connected to G subpixels 8G when the control signal SW2 is activated, and the source output Sk is connected to B subpixels 8B when the control signal SW3 is activated. As described later, in this embodiment, the control signals SW1, SW2 and SW3 are sequentially activated in each horizontal sync period to achieve time-divisional driving of the R subpixels 8R, G subpixels 8G and B subpixels 8B in each horizontal sync period.

Figure 13:
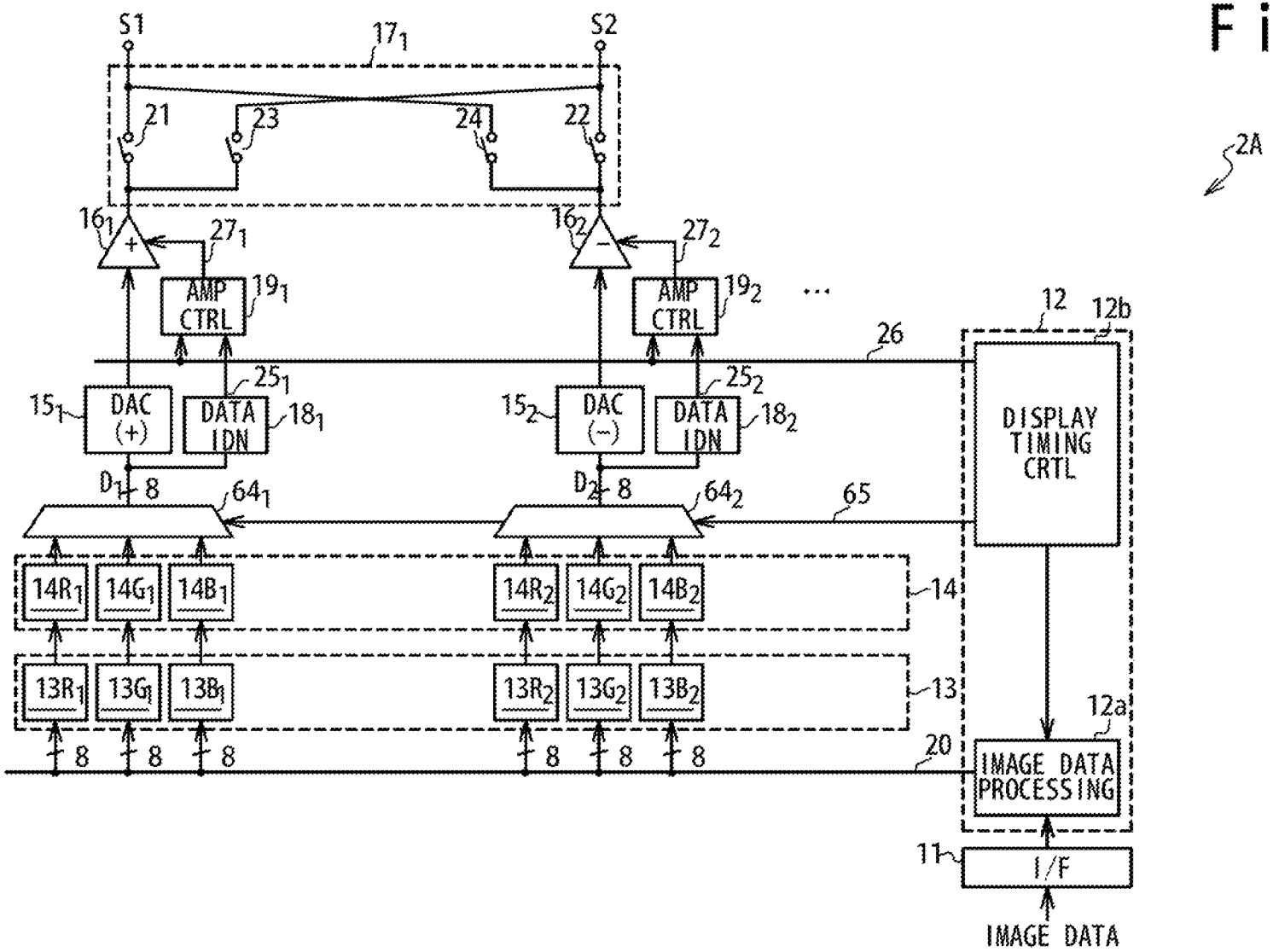
FIG. 13 is a block diagram of a display driver according to one or more embodiments.

FIG. 13 is a block diagram illustrating the configuration of the display driver 2A according to one or more embodiments. Illustrated in FIG. 13 is the configuration of circuitry related to the operation of outputting drive voltages from two source outputs S1 and S2 in the display driver 2A.

In the display driver 2A, in which the number of the source outputs is m/3, the numbers of the DA converters 15, the source amplifiers 16, the data identification circuitries 18 and the amplifier control circuitries 19 are each m/3 and the number of the output switch circuitries 17 is m/6.

In one or more embodiments, the initial stage line latch circuitry 13 includes R latches $13R_1$ to 13Rm/3, G latches $13G_1$ to 13Gm/3 and B latches $13B_1$ to 13Bm/3. Similarly, the output stage line latch circuitry 14 includes R latches $14R_1$ to 14Rm/3, G latches $14G_1$ to 14Gm/3 and B latches $14B_1$ to 14Bm/3. Illustrated in FIG. 13 are two of the R latches $13R_1$ to 13Rm/3, two of the G latches $13G_1$ to 13Gm/3, two of the B latches $13B_1$ to 13Bm/3, two of the R latches $14R_1$ to 14Rm/3, two of the G latches $14G_1$ to 14Gm/3 and two of the B latches $14B_1$ to 14Bm/3. The R latches $13R_1$ to 13Rm/3 and $14R_1$ to 14Rm/3 are used to store image data specifying the grayscale values of the R subpixels 8R. Similarly, the G latches $13G_1$ to 13Gm/3 and $14G_1$ to $14G_{m/3}$ are used to store image data specifying the grayscale values of the G subpixels 8G, and the B latches $13B_1$ to $13B_{m/3}$ and $14B_1$ to $14B_{m/3}$ are used to store image data specifying the grayscale values of the B subpixels 8B. The R latches $14R_1$ to $14R_{m/3}$, the G latches $14G_1$ to $14G_{m/3}$ and the B latches $14B_1$ to $14B_{m/3}$ of the output stage line latch circuitry 14 are connected to the R latches $13R_1$ to $13R_{m/3}$, the G latches $13G_1$ to $13G_{m/3}$ and the B latches $13B_1$ to $13B_{m/3}$ of the initial stage line latch circuitry 13.

Additionally, the display driver 2A includes RGB selectors $64_1$ to $64_{m/3}$. Each RGB selector $64_k$ connects a selected one of the R latch $14R_k$, G latch $14G_k$ and B latch $14B_k$ of the output stage line latch circuitry 14 to the DA converter $15_k$ in response to a RGB select signal 65 received from the display timing controller $12_b$. The image data stored in the latch selected by the RGB selector $64_k$ is supplied to the DA converter $15_k$. In one or more embodiments, the data identification circuitry $18_k$ identifies whether the image data supplied to the DA converter $15_k$ specifies the grayscale value "00h", which corresponds to black, and generates the data identification signal $25_k$. The amplifier control circuitry $19_k$ generates the individual amplifier control signals $27_k$ in response to the data identification signal $25_k$.

A description is then given of the operation of the display device 100A according to one or more embodiments. In one or more embodiments, the straight switches 21 and 22 of the output switch circuitries $17_1$ to $17_{m/6}$ are turned on, and the outputs of the source amplifiers $16_1$ to $16_{m/3}$ are connected to the source outputs $S_1$ to $S_{(m,3)}$, respectively. Although the output switch circuitries $17_1$ to $17m/6$ switch connections between the source amplifiers $16_1$ to $16_{m/3}$ and the source outputs $S_1$ to $S_{(m,3)}$ at a given cycle period when an inversion drive scheme is used, the execution of the inversion drive is of less importance in the technique disclosed in this specification.

Figure 14:
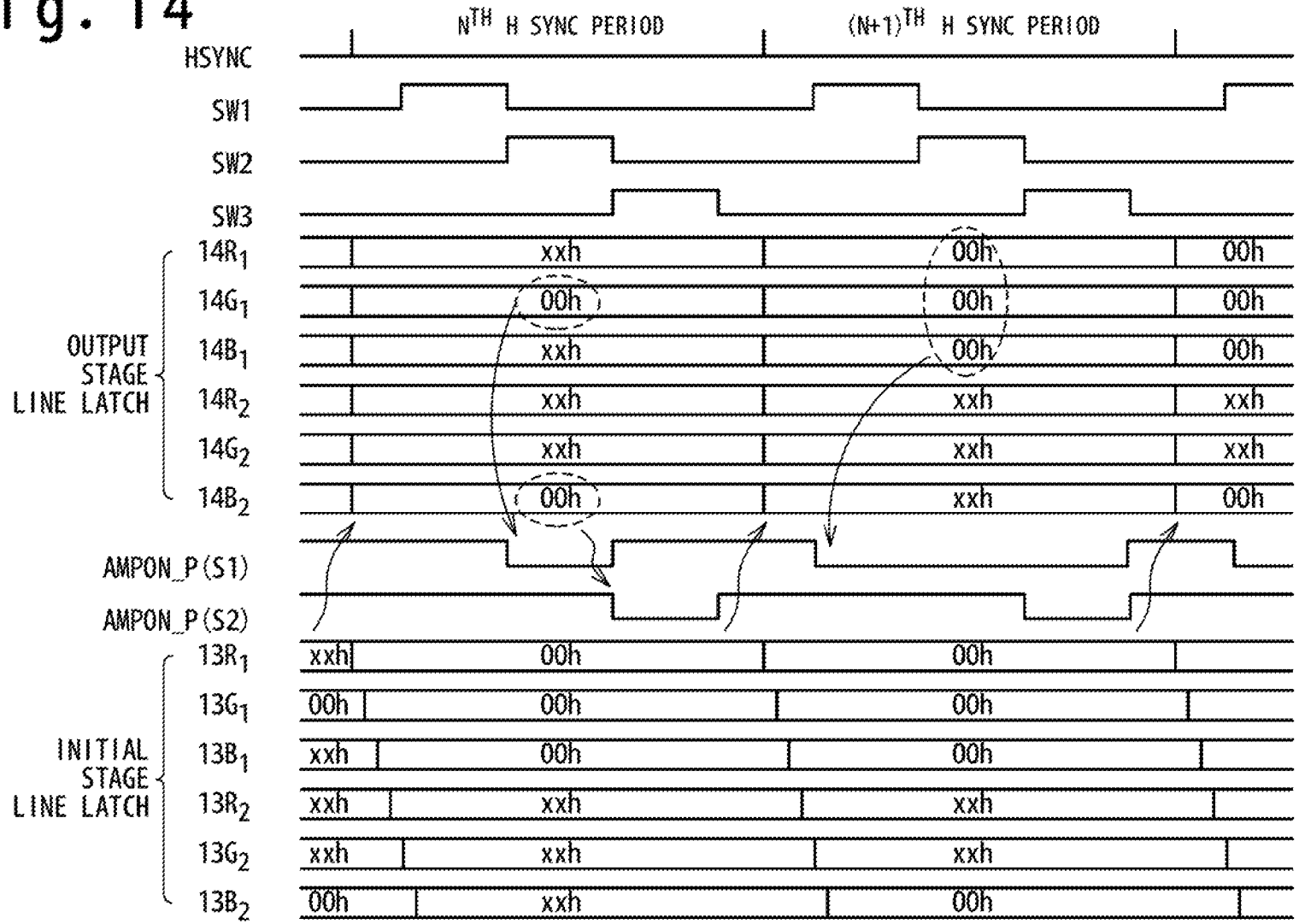
FIG. 14 is a timing chart of a display device according to one or more embodiments.

FIG. 14 is a timing chart illustrating an example of the operation of the display device 100A in according to one or more embodiments. Illustrated in FIG. 14 is the operation of circuitry associated with the source outputs S1 and S2 of the display driver 2A. At the timing immediately before the Nth horizontal sync period is started, image data specifying the grayscale value "00h", which corresponds to black, are stored in the G latch $13G_1$ and B latch $13B_2$ of the initial stage line latch circuitry 13 and image data specifying grayscale values different from the grayscale value "00h" are stored in the R latch $13R_1$, B latch $13B_1$, R latch $13R_2$ and the G latch $13G_2$ of the initial stage line latch circuitry 13. Additionally, the amplifier control signal 26 is activated by the display timing controller 12*b*.

When the Nth horizontal sync period is started, the output stage line latch circuitry 14 latches image data from the initial stage line latch circuitry 13. It should be noted that the image data specifying the grayscale value "00h", which corresponds to black, are latched by the G latch $14G_1$ and the B latch $14B_2$ of the output stage line latch circuitry 14.

Additionally, the gate line 6 associated with the pixels 10 to be driven in the Nth horizontal sync period is selected.

This is followed by driving the R subpixels 8R connected to the selected gate line 6. In one embodiment, the control signal SW1 is activated to connect the source lines 7 connected to the R subpixels 8R are connected to the source outputs $S_1$ to $S_{(m/3)}$. Furthermore, the RGB selectors 64 select the R latches $14R_1$ to $14R_{m/3}$ of the output stage line latch circuitry 14 in response to the RGB select signal 65 and connect the R latches $14R_1$ to $14R_{m/3}$ to the DA converters $15_1$ to $15_{m/3}$, respectively. The DA converters $15_1$ to $15_{m/3}$ generate grayscale voltages corresponding to the grayscale values specified by the image data received from the R latches $14R_1$ to $14R_{m/3}$, and supply the generated grayscale voltages to the source amplifiers $16_1$ to $16_{m/3}$.

In the operation illustrated in FIG. 14, none of the image data supplied from the R latches $14R_1$ to $14R_{m/3}$ to the DA converters $15_1$ to $15_{m/3}$ specifies the grayscale value "00h", which corresponds to black. Accordingly, the data identification circuitries $18_1$ to $18_{m/3}$ set the data identification signals $25_1$ to $25_{m/3}$ to "1". The amplifier control circuitries $19_1$ to $19_{m/3}$ generate the individual amplifier control signals $27_1$ to $27_{m/3}$ to allow the source amplifiers $16_1$ to $16_{m/3}$ to perform the amplifying operations. The source amplifiers $16_1$ to $16_{m/3}$ operate as voltage followers and output drive voltages having the same voltage levels as those of the grayscale voltages received from the associated DA converters $15_1$ to $15_{m/3}$.

This is followed by driving the G subpixels 8G connected to the selected gate line 6. In one embodiment, the control signal SW2 is activated to connect the source lines 7 connected to the G subpixels 8G are connected to the source outputs $S_1$ to $S_{(m/3)}$. Furthermore, the RGB selectors 64 select the G latches $14G_1$ to $14G_{m/3}$ of the output stage line latch circuitry 14 in response to the RGB select signal 65 and connect the G latches $14G_1$ to $14G_{m/3}$ to the DA converters $15_1$ to $15_{m/3}$, respectively. The DA converters $15_1$ to $15_{m/3}$ generate grayscale voltages corresponding to the grayscale values specified by the image data received from the G latches $14G_1$ to $14G_{m/3}$, and supply the generated grayscale voltages to the source amplifiers $16_1$ to $16_{m/3}$.

In the embodiment illustrated in FIG. 14, the image data supplied from the G latches $14G_1$ to the DA converters 151 specifies the grayscale value "00h", which corresponds to black, and accordingly the data identification circuitry 181 sets the data identification signal $25_1$ to "0". The amplifier control circuitry 191 generates the individual amplifier control signals 271 so as to stop the amplifying operation of the source amplifiers 161. In other words, the amplifier turn-on signals AMPON_P and AMPON_N of the individual amplifier control signals 271, which are supplied to the source amplifier 161, are deactivated. In FIG. 14, the waveform of the amplifier turn-on signal AMPON_P of the individual amplifier control signals 271 is indicated by the legend "AMPON_P(S1)".

Additionally, depending on whether the display panel 1 operates in the normally black mode or the normally white mode, the amplifier control circuitries 191 activates one of the output control signals AMPOUTH_N and AMPOUTL_P of the individual amplifier control signals 271, and deactivates the other. When the display panel 1 operates in the normally black mode, the amplifier control circuitry 191 activates the output control signal AMPOUTL_P and deactivates the output control signal AMPOUTH_N. In response to the activation of the output control signal AMPOUTL_P, the source amplifier 161 sets the drive voltage to be supplied to $S_1$ to the circuit ground level GND. When the display panel 1 operates in the normally white node, the amplifier control circuitry 191 activates the output control signal AMPOUTH_N and deactivates the output control signal AMPOUTL_P. In response to the activation of the output control signal AMPOUTH_N, the source amplifier 161, which is configured to output a positive drive voltage, sets the drive voltage to be supplied to the source output $S_1$ to the power supply voltage VSP.

Similar operations are performed with respect to the remaining DA converters 15. When an image data supplied to a DA converter 15 specifies the grayscale value "00h", which corresponds to black, the data identification circuitry 18 associated with the DA converter 15 sets the data identification signal 25 outputted therefrom to "0". This allows stopping the amplifying operation of the source amplifier 16 connected to the DA converter 15 which receives the image data specifying the grayscale value "00h". When an image data supplied to a DA converter 15 does not specify the grayscale value "00h", in contrast, the data identification circuitry 18 associated with the DA converter 15 sets the data identification signal 25 outputted therefrom to "1". This allows the source amplifier 16 connected to the DA converter 15 to operate as a voltage follower, and output a drive voltage having the same voltage level as that of the grayscale voltage received from the DA converter 15.

This is followed by driving the B subpixels 8B connected to the selected gate line 6. In one embodiment, the control signal SW3 is activated to connect the source lines 7 connected to the B subpixels 8B are connected to the source outputs $S_1$ to $S(_{m63})$. Furthermore, the RGB selectors 64 select the B latches 14$B_1$ to 14$B_{m/3}$ of the output stage line latch circuitry 14 in response to the RGB select signal 65 and connect the B latches 14$B_1$ to 14$B_{m/3}$ to the DA converters 15$_1$ to 15$_{m/3}$, respectively. The DA converters 15$_1$ to 15$_{m/3}$ generate grayscale voltages corresponding to the grayscale values specified by the image data received from the B latches 14$B_1$ to 14$B_{m/3}$, and supply the generated grayscale voltages to the source amplifiers 16$_1$ to 16$_{m/3}$.

In the operation illustrated in FIG. 14, in which the image data supplied from the B latch 1462 to the DA converter 152 specifies the grayscale value "00h", which corresponds to black, the data identification circuitry 182 sets the data identification signal 252 to "0". The amplifier control circuitry 192 generates the individual amplifier control signals 272 so as to stop the amplifying operation of the source amplifiers 162. In other words, the amplifier turn-on signals AMPON_P and AMPON_N of the individual amplifier control signals 272, which are supplied to the source amplifier 162, are deactivated. In FIG. 14, the waveform of the amplifier turn-on signal AMPON_P of the individual amplifier control signals 272 is indicated by the legend "AMPON_P(S2)".

Additionally, depending on whether the display panel 1 operates in the normally black mode or the normally white mode, the amplifier control circuitries 192 activates one of the output control signals AMPOUTH_N and AMPOUTL_P of the individual amplifier control signals 272, and deactivates the other. When the display panel 1 operates in the normally black mode, the amplifier control circuitry 192 activates the output control signal AMPOUTH_N and deactivates the output control signal AMPOUTL_P. In response to the activation of the output control signal AMPOUTH_N, the source amplifier 162 sets the drive voltage to be supplied to S2 to the circuit ground level GND. When the display panel 1 operates in the normally white node, the amplifier control circuitry 192 activates the output control signal AMPOUTL_P and deactivates the output control signal AMPOUTH_N. In response to the activation of the output control signal AMPOUTL_P, the source amplifier 162, which is configured to output a negative drive voltage, sets the drive voltage to be supplied to the source output S2 to the power supply voltage VSN.

Similar operations are performed with respect to the remaining DA converters 15. When an image data supplied to a DA converter 15 specifies the grayscale value "00h", which corresponds to black, the data identification circuitry 18 associated with the DA converter 15 sets the data identification signal 25 outputted therefrom to "0". This allows stopping the amplifying operation of the source amplifier 16 connected to the DA converter 15 which receives the image data specifying the grayscale value "00h", which corresponds to black portions of the display panel. When an image data supplied to a DA converter 15 does not specify the grayscale value "00h", in contrast, the data identification circuitry 18 associated with the DA converter 15 sets the data identification signal 25 outputted therefrom to "1". This allows the source amplifier 16 connected to the DA converter 15 to operate as a voltage follower, and output a drive voltage having the same voltage level as that of the grayscale voltage received from the DA converter 15.

In parallel to the above-described operation in the N horizontal sync period, image data are sequentially transferred from the image data processing circuitry 12*a* to the initial stage line latch circuitry 13 via the line latch bus 20. The transferred image data are stored in the R latches 13$R_1$ to 13$R_{m/3}$, G latches 13$G_1$ to 13$G_{m/3}$, and B latches 13$B_1$ to 13$B_{m/3}$ of the initial stage line latch circuitry 13. In one or more embodiments, in the $N^{th}$ horizontal sync period, image data specifying the grayscale value "00h", which corresponds to black, are transferred to the R latch 13$R_1$, G latch 13$G_1$, B latch 13$B_1$ and B latch 13$B_2$ of the initial stage line latch circuitry 13, and image data specifying grayscale values different from the grayscale value "00h" are transferred to the R latch 13$R_2$, G latch 13$G_2$.

In the $(N+1)^{th}$ horizontal sync period, pixel circuits 8 are driven in response to the image data which have been transferred to the initial stage line latch circuitry 13 in the $N^{th}$ horizontal sync period. The pixel circuits 8 are driven in the $(N+1)^{th}$ horizontal sync period similarly to the $N^{th}$ horizontal sync period, except for that the image data which have been transferred in the $N^{th}$ horizontal sync period are used. Since the image data specifying the grayscale value "00h", which corresponds to black portions of a display, have been transferred to the R latch 13$R_1$, G latch 13$G_1$ and B latch $13B_1$ of the initial stage line latch circuitry 13 in the $N^{th}$ horizontal sync period, the amplifying operation of the source amplifier $16_1$ connected to the source output S1 is stopped in the operation of the $(N+1)^{th}$ horizontal sync period, when drive voltages are supplied to the R subpixel 8R, G subpixel 8G and B subpixel 8B.

In one embodiment, for all of the associated R subpixel 8R, G subpixel 8G and B subpixel 8B, the data identification circuitry $18_1$ sets to the data identification signal $25_1$ to "0" and the amplifier control circuitry $19_1$ generates the individual amplifier control signals $27_1$ so as to stop the source amplifier $16_1$ in response to the data identification signal $25_1$. In other words, the amplifier turn-on signals AMPON_P and AMPON_N of the individual amplifier control signals $27_1$ supplied to the source amplifier $16_1$ are deactivated. As described above, the amplifying operation of the source amplifier $16_1$ is stopped when the amplifier turn-on signals AMPON_P and AMPON_N are deactivated.

In one or more embodiments, depending on whether the display panel 1 operates in the normally black mode or the normally white mode, the amplifier control circuitry $19_1$ activate one of the output control signals AMPOUTH_N and AMPOUTL_P of the individual amplifier control signals $27_1$, and deactivate the other of the output control signals AMPOUTH_N and AMPOUTL_P. When the display panel 1 operates in the normally black mode, the amplifier control circuitry $19_1$ activates the output control signal AMPOUTL_P and deactivates the output control signal AMPOUTH_N. In response to the activation of the output control signal AMPOUTL_P, the source amplifier $16_1$ sets the drive voltage outputted to the source output S1 to the circuit ground level GND. When the display panel 1 operates in the normally while mode, on the other hand, the amplifier control circuitry $19_1$ activates the output control signal AMPOUTH_N and deactivates the output control signal AMPOUTL_P. In response to the activation of the output control signal AMPOUTH_N, the source amplifier $16_1$ sets the drive voltage outputted to the source output $S_1$ to the power supply voltage VSP.

Also in the operation illustrated in FIG. 14, the amplifying operation of a source amplifier 16 which supplies a drive voltage to a pixel circuit 8 that display black, when the drive voltage is written into the pixel circuit 8. Additionally, the source amplifier 16 is configured to output the drive voltage corresponding to black when the amplifying operation thereof is stopped. This operation effectively reduces the power consumption while addressing the problem of the difference in the brightness level of "black".

The logic module 12 may be configured to identify whether or not each image data specifies the grayscale value corresponding to black, also in this embodiment.

Figure 15:
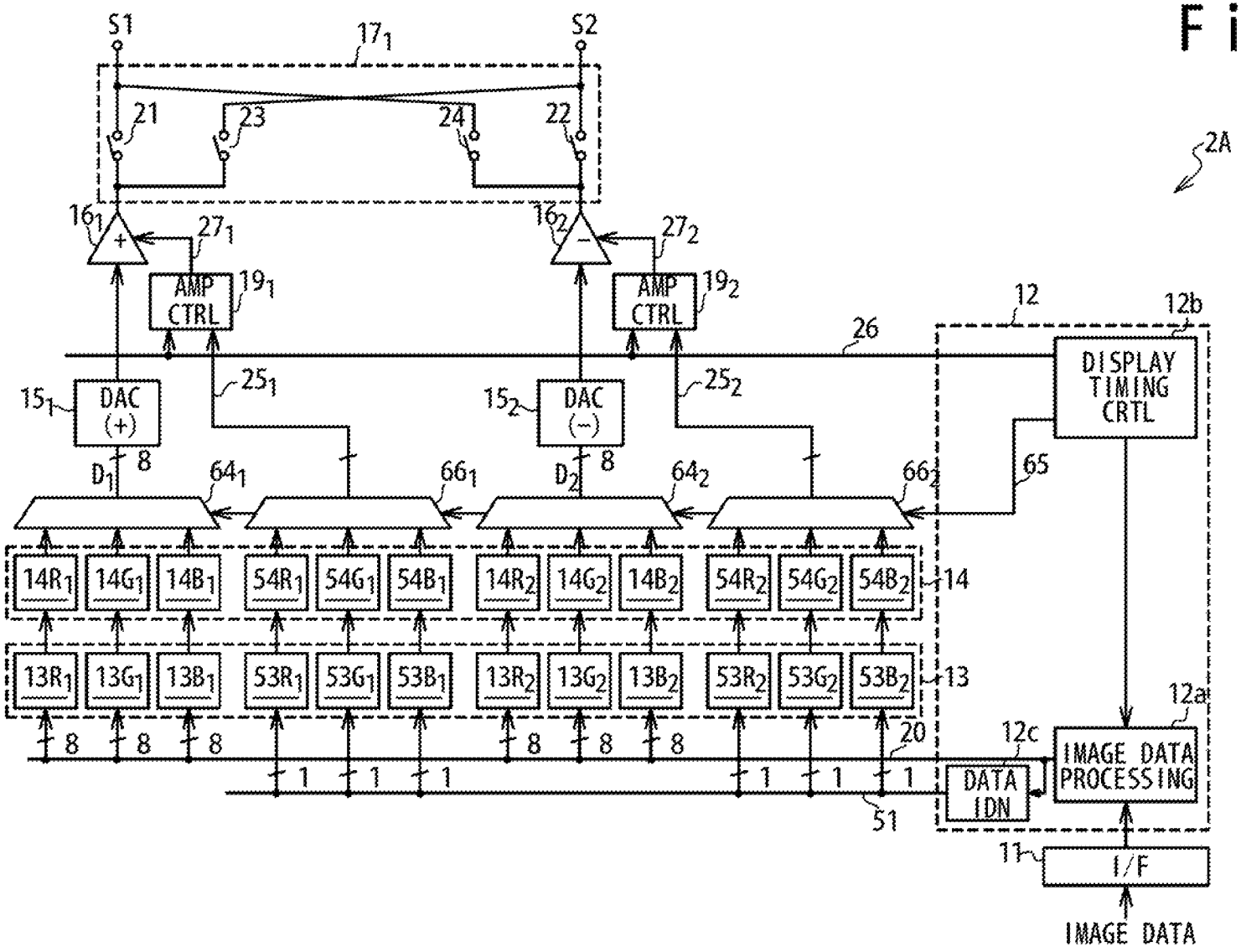
FIG. 15 is a block diagram of a display driver according to one or more embodiments.

FIG. 15 is a block diagram illustrating the configuration of the display driver 2A, in which the logic module 12 is configured to identify whether or not each image data specifies the grayscale value "00h", which corresponds to black. In the configuration illustrated in FIG. 15, the data identification circuitries $18_1$ to $18_{m/3}$ are removed and a data identification circuitry 12*c* is provided in the logic module 12 instead. The initial stage line latch circuitry 13 includes R latches $53R_1$ to $53R_{m/3}$, G latches $53G_1$ to $53G_{m/3}$ and B latches $53B_1$ to $53B_{m/3}$ to store data identification bits, and the output stage line latch circuitry 14 includes R latches $54R_1$ to $54R_{m/3}$, G latches $54G_1$ to $54G_{m/3}$ and B latches $54B_1$ to $54B_{m/3}$ to store data identification bits.

The data identification circuitry 12*c* is connected to the R latches $53R_1$ to $53R_{m/3}$, G latches $53G_1$ to $53G_{m/3}$ and B latches $53B_1$ to $53B_{m/3}$ of the initial stage line latch circuitry 13 via an amplifier control bus 51 and the R latches $53R_1$ to $53R_{m/3}$, G latches $53G_1$ to $53G_{m/3}$ and B latches $53B_1$ to $53B_{m/3}$ are connected to the R latches $54R_1$ to $54R_{m/3}$, G latches $54G_1$ to $54G_{m/3}$ and B latches $54B_1$ to $54B_{m/3}$ of the output stage line latch circuitry 14, respectively.

The display driver 2A illustrated in FIG. 15 further includes RGB selectors $66_1$ to $66_{m/3}$ which have outputs connected to the amplifier control circuitries $19_1$ to $19_{m/3}$, respectively. Each RGB selector $66_k$ connects a selected one of the R latch $54R_k$, G latch $54G_k$ and B latch $54B_k$ of the output stage line latch circuitry 14 to the amplifier control circuitry $19_k$ in response to the RGB select signal 65 received from the display timing controller 12*b*. The output signal of the one of the R latch $54R_k$, G latch $54G_k$ and B latch $54B_k$ selected by the RGB selector $66_k$ is supplied to the amplifier control circuitry $19_k$ as the data identification signal $25_k$. The amplifier control circuitry $19_k$ generates the individual amplifier control signals $27_k$ in response to the data identification signal $25_k$.

The display driver 2A configured as illustrated in FIG. 15 operates as follows. The data identification circuitry 12*c* identifies whether respective image data specify the grayscale value "00h", which corresponds to black, when the image data are sequentially transferred to the initial stage line latch circuitry 13 via the line latch bus 20 and outputs a data identification bit for each of the transferred image data. Each of the data identification bits is a one-bit data indicating whether the associated image data specifies the grayscale value "00h". The data identification bits are transferred to the initial stage line latch circuitry 13 via the amplifier control bus 51 and stored in the R latches $53R_1$ to $53R_{m/3}$, the G latches $53G_1$ to $53G_{m/3}$ and the B latches $53B_1$ to $53B_{m/3}$. The data identification bits which indicate whether the image data stored in the R latches $13R_1$ to $13R_{m/3}$ specify the grayscale value "00h" are stored in the R latches $53R_1$ to $53R_{m/3}$, respectively. Similarly, the data identification bits which indicate whether the image data stored in the G latches $13G_1$ to $13G_{m/3}$ specify the grayscale value "00h" are stored in the G latches $53G_1$ to $53G_{m/3}$, respectively, and the data identification bits which indicate whether the image data stored in the B latches $13B_1$ to $13B_{m/3}$ specify the grayscale value "00h" are stored in the B latches $53B_1$ to $53B_{m/3}$, respectively.

The data identification bits stored in the R latches $53R_1$ to $53R_{m/3}$, G latches $53G_1$ to $53G_{m/3}$ and B latches $53B_1$ to $53B_{m/3}$ are latched by the R latches $54R_1$ to $54R_{m/3}$, G latches $54G_1$ to $54G_{m/3}$ and B latches $54B_1$ to $54B_{m/3}$ of the output stage line latch circuitry 14.

When R subpixels 8R are driven in each horizontal sync period, the control signal SW1 is activated. Additionally, in response to the RGB select signal 65, the RGB selectors $64_1$ to $64_{m/3}$ are set to select the R latches $14R_1$ to $14R_{m/3}$, respectively, and the RGB selectors $66_1$ to $66_{m/3}$ are set to select the R latches $54R_1$ to $54R_{m/3}$.

The DA converters $15_1$ to $15_{m/3}$ receive image data from the selected R latches $14R_1$ to $14R_{m/3}$, generate grayscale voltages corresponding to the grayscale values specified by the received image data and supply the grayscale voltages to the source amplifiers $16_1$ to $16_{m/3}$. The source amplifiers $16_1$ to $16_{m/3}$ output drive voltages corresponding to the grayscale voltages received from the DA converters $15_1$ to $15_{m/3}$.

In one or more embodiments, the output signals of the R latches $54R_1$ to $54R_{m/3}$, which are selected by the RGB selectors $66_1$ to $66_{m/3}$, are supplied to the amplifier control circuitries $19_1$ to $19_{m/3}$ as the data identification signals $25_1$ to $25_{m/3}$. The amplifier control circuitries $19_1$ to $19_{m/3}$ generate the individual amplifier control signals $27_1$ to $27_{m/3}$ in response to the data identification signals $25_1$ to $25_{m/3}$. When the data identification signal $25_k$ is "0", that is, when the image data supplied to the DA converter 15*k* specifies the grayscale value "00h", which corresponds to black, the amplifier control circuitry $19_k$ generates the individual amplifier control signals $27_k$ so as to stop the amplifying operation of the source amplifier 16*k*. In other words, the amplifier turn-on signals AMPON_P and AMPON_N of the individual amplifier control signals $27_k$ supplied to the source amplifier 16*k* are deactivated. As described above, the amplifying operation of the source amplifier 16*k* is stopped when the amplifier turn-on signals AMPON_P and AMPON_N are deactivated.

In one or more embodiments, depending on whether the display panel 1A operates in the normally black mode or the normally white mode, the amplifier control circuitries $19_k$ activates one of the output control signals AMPOUTH_N and AMPOUTL_P of the individual amplifier control signals $27_k$, and deactivates the other. When the display panel 1A operates in the normally black mode, the amplifier control circuitry $19_k$ outputs the output control signals AMPOUTH_N and AMPOUTL_P so that the drive voltage supplied from the source amplifier $16_k$ to the source outputs Sk is set to the circuit ground level GND. When the display panel 1A operates in the normally white mode, on the other hand, the amplifier control circuitry $19_k$, if the source amplifier $16_k$ is configured to output a positive drive voltage, outputs the output control signals AMPOUTH_N and AMPOUTL_P so that the drive voltage supplied to the source output Sk is set to the power supply voltage VSP, and if the source amplifier $16_k$ is configured to output a negative drive voltage, the amplifier control circuitry $19_k$ outputs the output control signals AMPOUTH_N and AMPOUTL_P so that the drive voltage supplied to the source output Sk is set to the power supply voltage VSN.

The G subpixels 8G are driven similarly to the R subpixels 8R in each horizontal sync period, except for that the control signal SW2 is activated, the RGB selectors $64_1$ to $64_{m/3}$ respectively select the G latches $14G_1$ to $14G_{m/3}$ in response to the RGB select signal 65, and the RGB selectors $66_1$ to $66_{m/3}$ respectively select the G latches $54G_1$ to $54G_{m/3}$ in response to the RGB select signal 65.

The DA converters $15_1$ to $15_{m/3}$ receive image data from the selected G latches $14G_1$ to $14G_{m/3}$, generate grayscale voltages corresponding to the grayscale values specified by the received image data and supply the grayscale voltages to the source amplifiers $16_1$ to $16_{m/3}$. The source amplifiers $16_1$ to $16_{m/3}$ output drive voltages corresponding to the grayscale voltages received from the DA converters $15_1$ to $15_{m/3}$.

In one or more embodiments, the output signals of the G latches $54G_1$ to $54G_{m/3}$, which are selected by the RGB selectors $66_1$ to $66_{m/3}$, are supplied to the amplifier control circuitries $19_1$ to $19_{m/3}$ as the data identification signals $25_1$ to $25_{m/3}$. The amplifier control circuitries $19_1$ to $19_{m/3}$ generate the individual amplifier control signals $27_1$ to $27_{m/3}$ in response to the data identification signals $25_1$ to $25_{m/3}$. When the data identification signal $25_k$ is "0", the amplifier control circuitry $19_k$ generates the individual amplifier control signals $27_k$ so as to stop the amplifying operation of the source amplifier 16*k*.

In one or more embodiments, depending on whether the display panel 1A operates in the normally black mode or the normally white mode, the amplifier control circuitries $19_k$ activates one of the output control signals AMPOUTH_N and AMPOUTL_P of the individual amplifier control signals $27_k$, and deactivates the other.

Furthermore, the B subpixels 8B are driven similarly to the R subpixels 8R and G subpixels 8G in each horizontal sync period, except for that the control signal SW3 is activated, the RGB selectors $64_1$ to $64_{m/3}$ respectively select the B latches $14B_1$ to $14B_{m/3}$ in response to the RGB select signal 65, and the RGB selectors $66_1$ to $66_{m/3}$ respectively select the B latches $54B_1$ to $54B_{m/3}$ in response to the RGB select signal 65.

The DA converters $15_1$ to $15_{m/3}$ receive image data from the selected B latches $14B_1$ to $14B_{m/3}$, generate grayscale voltages corresponding to the grayscale values specified by the received image data and supply the grayscale voltages to the source amplifiers $16_1$ to $16_{m/3}$. The source amplifiers $16_1$ to $16_{m/3}$ output drive voltages corresponding to the grayscale voltages received from the DA converters $15_1$ to $15_{m/3}$.

In one or more embodiments, the output signals of the B latches $54B_1$ to $54B_{m/3}$, which are selected by the RGB selectors $66_1$ to $66_{m/3}$, are supplied to the amplifier control circuitries $19_1$ to $19_{m/3}$ as the data identification signals $25_1$ to $25_{m/3}$. The amplifier control circuitries $19_1$ to $19_{m/3}$ generate the individual amplifier control signals $27_1$ to $27_{m/3}$ in response to the data identification signals $25_1$ to $25_{m/3}$. When the data identification signal $25_k$ is "0", the amplifier control circuitry $19_k$ generates the individual amplifier control signals $27_k$ so as to stop the amplifying operation of the source amplifier $16_k$.

In one or more embodiments, depending on whether the display panel 1A operates in the normally black mode or the normally white mode, the amplifier control circuitry $19_k$ activates one of the output control signals AMPOUTH_N and AMPOUTL_P of the individual amplifier control signals $27_k$, and deactivates the other.

Also in the display driver 2A illustrated in FIG. 15, the amplifying operation of a source amplifier 16 which supplies a drive voltage to a pixel circuit 8 that display black, when the drive voltage is written into the pixel circuit 8. Additionally, the source amplifier 16 is configured to output the drive voltage corresponding to black when the amplifying operation thereof is stopped. This operation effectively reduces the power consumption, depending on the display image.

Figure 16:
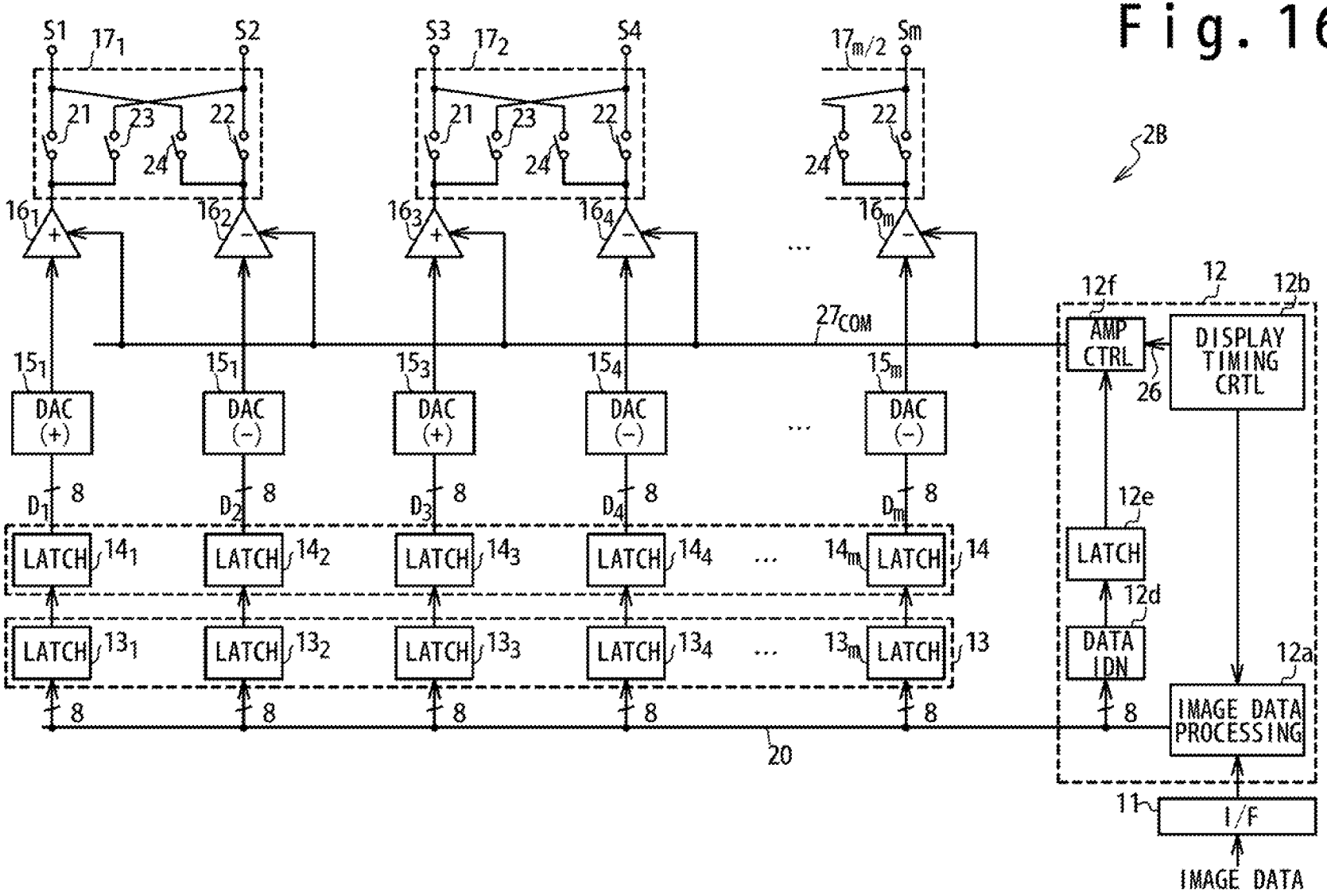
FIG. 16 is a block diagram illustrating the a display driver according to one or more embodiments.

FIG. 16 is a block diagram illustrating the configuration of a display driver 2B according to one or more embodiments. In one or more embodiments, the display driver 2B is configured similarly to the display driver 2 of FIG. 2, and adapted to drive the display panel 1 illustrated in FIG. 2. The difference is as follows.

In one or more embodiments, the display driver 2B is configured to supply common amplifier control signals $27_{COM}$ to all of the source amplifiers $16_1$ to $16_m$ and the execution and stop of the amplifying operations of the source amplifiers $16_1$ to $16_m$ are controlled. In this embodiment, those configured to output a positive drive voltage out of the source amplifiers $16_1$ to 16*m* are configured as illustrated in FIG. 7A and those configured to output a negative drive voltage out of the source amplifiers $16_1$ to $16_m$ are configured as illustrated in FIG. 7B. In such an embodiment, the common amplifier control signals $27_{COM}$ include the amplifier turn-on signal AMPON_P and AMPON_N and the output control signals AMPOUTH_N and AMPOUTL_P.

Additionally, the logic module 12 is configured to identify whether all of the image data supplied to the DA converters $15_1$ to $15_m$ specify the grayscale value "00h", which corresponds to black, in each horizontal sync period, to generate the common amplifier control signals $27_{COM}$.

In one embodiment, the logic module 12 includes a data identification circuitry 12*d*, a latch 12*e* and an amplifier control circuitry 12*f*. The data identification circuitry 12*d* is configured to identify whether each of image data sequentially transferred from the image data processing circuitry 12*a* to the latches $\mathbf{13}_1$ to $\mathbf{13}_m$ of the initial stage line latch circuitry 13 specifies the grayscale value "00h", which corresponds to black, and sequentially output data identification bits. The latch 12*e* stores therein the data identification bits received from the data identification circuitry 12*d*.

The amplifier control circuitry 12*f* generates the common amplifier control signals $\mathbf{27}_{COM}$ in response to the data identification bits stored in the latch 12*e* and the amplifier control signal 26 received from the display timing controller 12*b*. The amplifier control signal 26 received from the display timing controller 12*b* is used to totally stop the amplifying operations of all of the source amplifiers $\mathbf{16}_1$ to $\mathbf{16}_m$.

When the amplifying operations of all of the source amplifiers $\mathbf{16}_1$ to $\mathbf{16}_m$ are stopped at the same time for some reason, the display timing controller 12*b* deactivates the amplifier control signal 26. In such an embodiment, the amplifier control circuitry 12*f* generates the common amplifier control signals $\mathbf{27}_{COM}$ so as to stop the amplifying operations of all of the source amplifiers $\mathbf{16}_1$ to $\mathbf{16}_m$, independently of the data identification bits received from the data identification circuitry 12*d*.

When the display panel 1 is driven to display an image, the display timing controller 12*b* activates the amplifier control signal 26. In such an embodiment, the amplifier control circuitry 12*f* generates the common amplifier control signals $\mathbf{27}_{COM}$ in response to the data identification bits stored in the latch 12*e*, to thereby control the execution and stop of the amplifying operations of the source amplifiers $\mathbf{16}_1$ to $\mathbf{16}_m$. The amplifier control circuitry 12*f* determines whether all of the image data supplied to the DA converters $\mathbf{15}_1$ to 15, specify the grayscale value "00h", which corresponds to black, in each horizontal sync period.

When at least one of the image data supplied to the DA converters $\mathbf{15}_1$ to 15, does not specify the grayscale value "00h", the amplifier control circuitry 12*f* generates the common amplifier control signals $\mathbf{27}_{COM}$ so as to allow all of the source amplifiers $\mathbf{16}_1$ to 16, to perform the amplifying operations. The amplifier control circuitry 12*f* activates the amplifier turn-on signals AMPON_P and AMPON_N of the common amplifier control signals $\mathbf{27}_{COM}$.

When all of the image data supplied to the DA converters $\mathbf{15}_1$ to 15*m* specify the grayscale value "00h", the amplifier control circuitry 12*f* generates the common amplifier control signals $\mathbf{27}_{COM}$ so as to stop the amplifying operations of all of the source amplifiers $\mathbf{16}_1$ to $\mathbf{16}_m$. To stop the amplifying operations of the source amplifiers $\mathbf{16}_1$ to $\mathbf{16}_m$, the amplifier control circuitry 12*f* deactivates the amplifier turn-on signals AMPON_P and AMPON_N of the common amplifier control signals $\mathbf{27}_{COM}$.

Additionally, depending on whether the display panel 1 operates in the normally black mode or the normally white mode, the amplifier control circuitry 12*f* activates one of the output control signals AMPOUTH_N and AMPOUTL_P of the common amplifier control signals $\mathbf{27}_{COM}$, and deactivates the other. When the display panel 1 operates in the normally black mode, the amplifier control circuitry 12*f* outputs the output control signals AMPOUTH_N and AMPOUTL_P so that the drive voltages outputted from the source amplifier $\mathbf{16}_1$ to 16, are set to the circuit ground level GND. When the display panel 1 operates in the normally white mode, the amplifier control circuitry 12*f* outputs the output control signals AMPOUTH_N and AMPOUTL_P so that the drive voltages outputted from ones of the source amplifier $\mathbf{16}_1$ to 16, configured to output positive drive voltages are set to the power supply voltage VSP, and the drive voltages outputted from ones of the source amplifier $\mathbf{16}_1$ to 16, configured to output negative drive voltages are set to the power supply voltage VSN.

Figure 17:
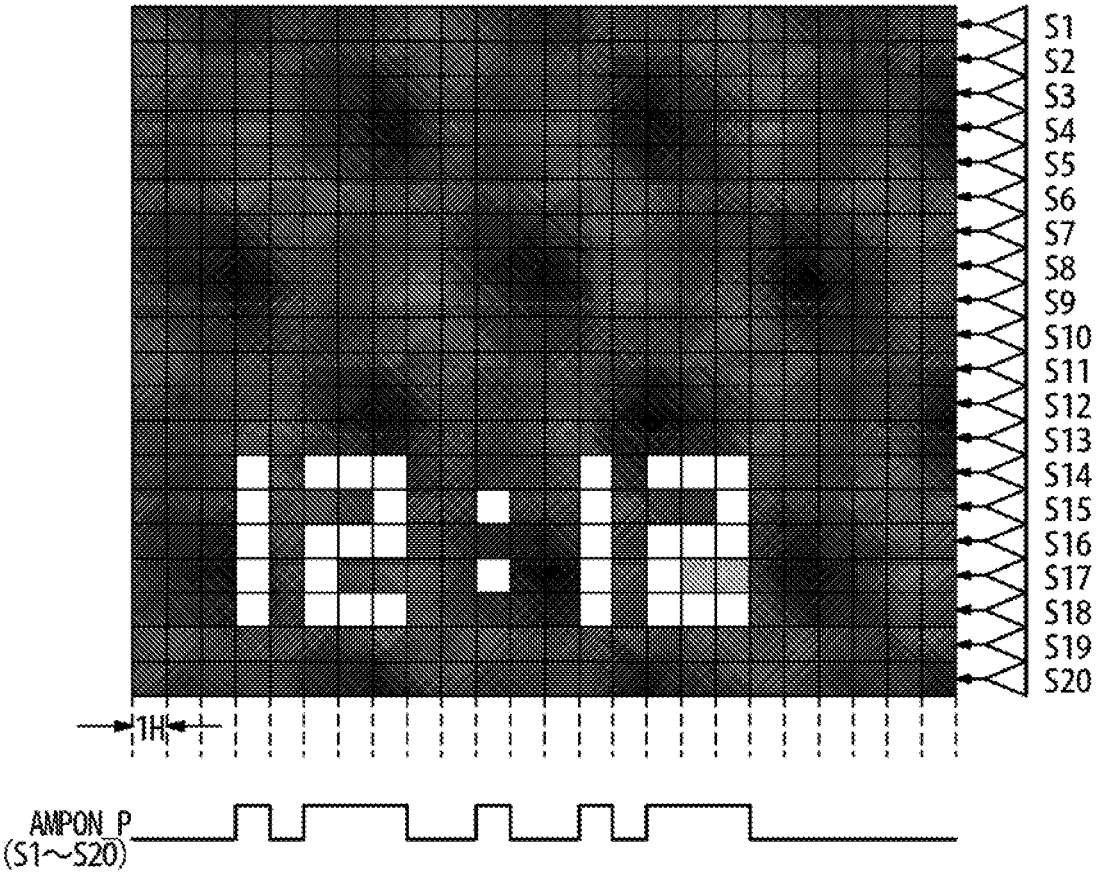
FIG. 17 illustrates the waveform of an amplifier turn-on signal according to one or more embodiments.

FIG. 17 schematically illustrates the correspondence between an image displayed by the display device incorporating the display driver 2B of this embodiment and the waveforms of the amplifier turn-on signal AMPON_P supplied to the source amplifiers 16. For easiness of understanding, the operation of the display device 100 is illustrated under an assumption that the number m of the source outputs, that is, the number of the source amplifiers 16, is 20. In the example illustrated in FIG. 17, the image displayed on the display panel 1 includes characters "12:12".

The upper part of FIG. 17 illustrates the association of the image and the source outputs $S_1$ to S20, that is, the pixel circuits 8 of the display panel 1 and the source outputs $S_1$ to S20. The lower part of FIG. 17 illustrates the state of the amplifier turn-on signal AMPON_P supplied to the source amplifiers 16 at the timing when the respective pixel circuits 8 of the display panel 1 are driven. In FIG. 17, the waveform of the amplifier turn-on signal AMPON_P of the common amplifier control signals $\mathbf{27}_{COM}$ is illustrated under an assumption that the pixel circuits 8 are sequentially driven from left to right of the image. The legend "1H" in FIG. 17 represents one horizontal sync period.

In the first to third horizontal sync periods, in which all of the selected pixel circuits 8 display black, the amplifier turn-on signal AMPON_P of the common amplifier control signals $\mathbf{27}_{COM}$ is deactivated to stop the amplifying operations of all of the source amplifiers 16.

In the fourth horizontal sync period, in which pixel circuits 8 connected to the source outputs S14 to S18 do not display black, the amplifier turn-on signal AMPON_P of the common amplifier control signals $\mathbf{27}_{COM}$ is activated to allow the amplifying operations of all of the source amplifiers 16.

In the fifth horizontal sync periods, in which all of the selected pixel circuits 8 display black, the amplifier turn-on signal AMPON_P of the common amplifier control signals $\mathbf{27}_{COM}$ is deactivated to stop the amplifying operations of all of the source amplifiers 16.

Subsequently, a similar operation is performed to display the image including the characters "12:12".

As described above, the display device 100 of this embodiment is configured so that the amplifying operations of all of the source amplifiers 16 are stopped in a horizontal sync period, when all of the selected pixel circuits 8 display black in the horizontal sync period. Additionally, in the display device 100 of this embodiment, the source amplifiers $\mathbf{16}_1$ to $\mathbf{16}_m$ are each configured to output the drive voltage corresponding to black when the amplifying operation thereof is stopped. In this embodiment, "black" displayed on the display panel 1 includes "black" displayed in the state in which the corresponding source amplifier is operated and "black" displayed in the state in which the amplifying operation of the corresponding source amplifier is stopped. To address this, the source amplifiers are configured to output the power supply voltage (VSP or VSN) or the circuit ground level (GND) corresponding to black portions of the display panel, even when the source amplifiers are operated. This operation effectively reduces the power consumption, while addressing the above-described problem of the difference in the brightness level of "black".

Figure 18:
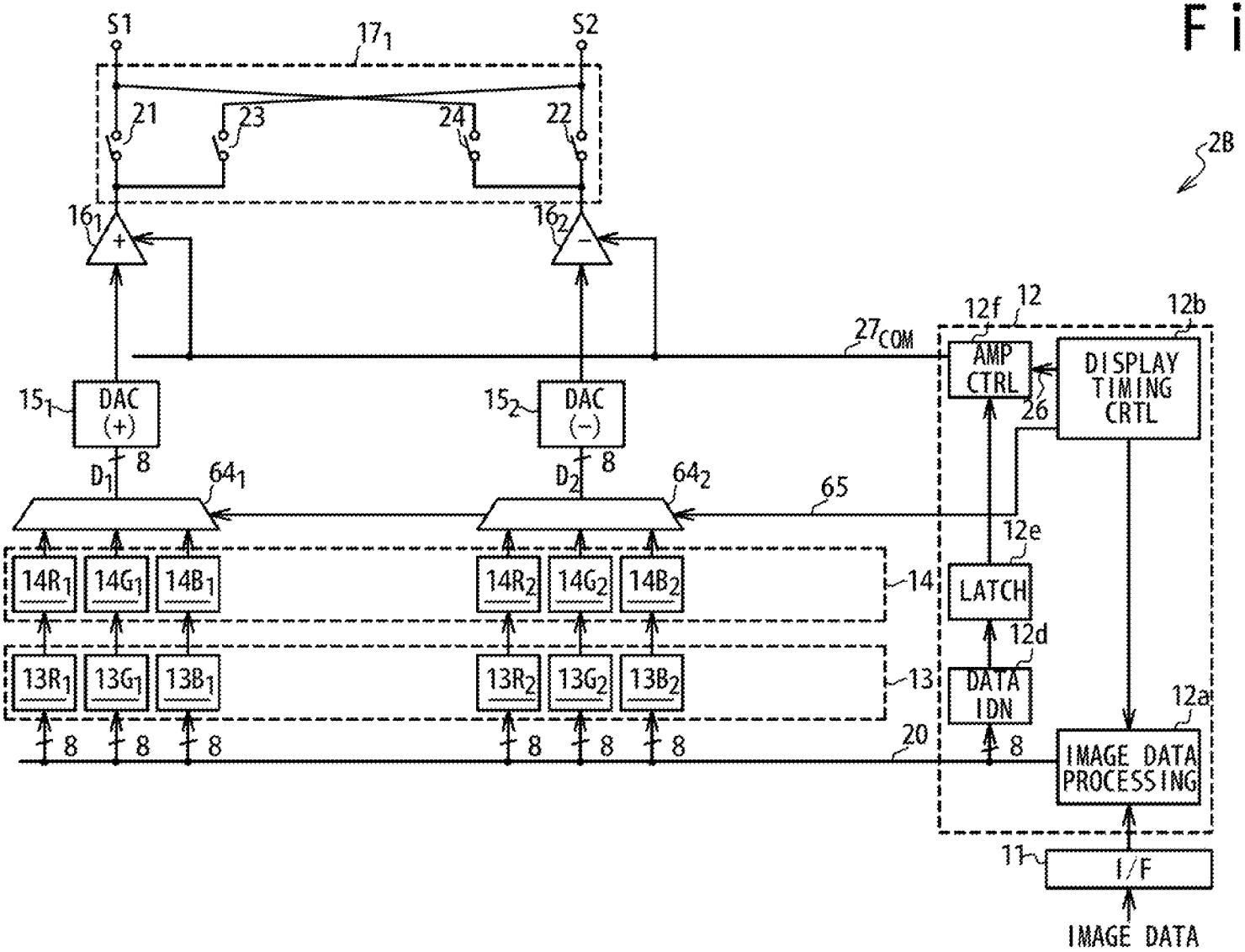
FIG. 18 is a block diagram of a display driver according to one or more embodiments.

In this embodiment, in which the common amplifier control signals $27_{COM}$ are supplied to all of the source amplifiers $16_1$ to $16_m$ to control the execution and stop of the amplifying operations of the source amplifiers $16_1$ to $16_m$, a time-divisional drive scheme may be implemented. FIG. 18 is a block diagram illustrating the configuration of the display driver 2B in this case. Illustrated in FIG. 18 is the configuration of circuitry related to the operation of outputting drive voltages from two source outputs S1 and S2 in the display driver 2B. When a time-divisional drive scheme is implemented, the display panel 1A illustrated in FIG. 12A may be used for example.

The display driver 2B illustrated in FIG. 18 is configured similarly to the display driver 2A illustrated in FIG. 13. The number of the source outputs is m/3 also in the display driver 2B illustrated in FIG. 18, and accordingly the numbers of the DA converters 15 and the source amplifiers 16 are m/3 and the number of output switch circuitries 17 is m/6.

In the display driver 2B illustrated in FIG. 18, the initial stage line latch circuitry 13 includes R latches $13R_1$ to $13R_{m/3}$, G latches $13G_1$ to $13G_{m/3}$ and B latches $13B_1$ to $13B_{m/3}$. Similarly, the output stage line latch circuitry 14 includes R latches $14R_1$ to $14R_{m/3}$, G latches $14G_1$ to $14G_{m/3}$ and B latches $14B_1$ to $14B_{m/3}$. Illustrated in FIG. 18 are two of the R latches $13R_1$ to $13R_{m/3}$, two of the G latches $13G_1$ to $13G_{m/3}$, two of the B latches $13B_1$ to $13B_{m/3}$, two of the R latches $14R_1$ to $14R_{m/3}$, two of the G latches $14G_1$ to $14G_{m/3}$ and two of the B latches $14B_1$ to $14B_{m/3}$.

Additionally, the display driver 2B includes RGB selectors $64_1$ to $64_{m/3}$. Each RGB selector $64_k$ connects a selected one of the R latch $14R_k$, G latch $14G_k$ and B latch $14B_k$ of the output stage line latch circuitry 14 to the DA converter $15_k$ in response to a RGB select signal 65 received from the display timing controller $12_b$. The image data stored in the latch selected by the RGB selector $64_k$ is supplied to the DA converter $15_k$.

The display driver 2B illustrated in FIG. 18 operates as follows. When image data are sequentially transferred to the initial stage line latch circuitry 13 via the line latch bus 20, the data identification circuitry $12_d$ identifies whether each of image data specifies the grayscale value "00h", which corresponds to black, and to output a data identification bit for each of the image data. Each data identification bit is a one-bit data indicative of whether or not the corresponding image data specifies the grayscale value "00h". The data identification bits are stored in the latch 12*e*.

When R subpixels 8R are driven in each horizontal sync period, the control signal SW1 is activated and the RGB selectors $64_1$ to $64_{m/3}$ select the R latches $14R_1$ to $14R_{m/3}$ in response to the RGB select signal 65.

The DA converters $15_1$ to $15_{m/3}$ receive image data from the selected R latches $14R_1$ to $14R_{m/3}$, generate grayscale voltages corresponding to the grayscale values specified by the received image data and supply the grayscale voltages to the source amplifiers $16_1$ to $16_{m/3}$. The source amplifiers $16_1$ to $16_{m/3}$ output drive voltages corresponding to the grayscale voltages received from the DA converters $15_1$ to $15_{m/3}$.

In one or more embodiments, the amplifier control circuitry 12*f* identifies whether or not all of the image data supplied from the R latches $14R_1$ to $14R_{m/3}$ to the DA converters $15_1$ to $15_{m/3}$ specify the grayscale value "00h", which corresponds to black, on the basis of the data identification bits stored in the latch 12*e*. When all of the image data supplied to the DA converters $15_1$ to $15_{m/3}$ specify the grayscale value "00h", the amplifier control circuitry 12*f* generates the common amplifier control signals $27_{COM}$ so as to stop the amplifying operations of all of the source amplifiers $16_1$ to $16_{m/3}$. In other words, the amplifier turn-on signals AMPON_P and AMPON_N of the common amplifier control signals $27_{COM}$ supplied to the source amplifiers $16_1$ to $16_{m/3}$ are deactivated. As described above, the amplifying operations of the source amplifiers $16_1$ to $16_{m/3}$ are stopped when the amplifier turn-on signals AMPON_P and AMPON_N are deactivated.

In one or more embodiments, depending on whether the display panel 1 operates in the normally black mode or the normally white mode, the amplifier control circuitry 12*f* activates one of the output control signals AMPOUTH_N and AMPOUTL_P of the common amplifier control signals $27_{COM}$, and deactivates the other. When the display panel 1 operates in the normally black mode, the amplifier control circuitry 12*f* outputs the output control signals AMPOUTH_N and AMPOUTL_P so that the drive voltages outputted from the source amplifier $16_1$ to $16_{m/3}$ are set to the circuit ground level GND. When the display panel 1 operates in the normally white mode, the amplifier control circuitry 12*f* outputs the output control signals AMPOUTH_N and AMPOUTL_P so that the drive voltages outputted from ones of the source amplifier $16_1$ to $16_{m/3}$ configured to output positive drive voltages are set to the power supply voltage VSP, and the drive voltages outputted from ones of the source amplifier $16_1$ to $16_{m/3}$ configured to output negative drive voltages are set to the power supply voltage VSN.

The G subpixels 8G are driven similarly to the R subpixels 8R in each horizontal sync period, except for that the control signal SW2 is activated, and the RGB selectors $64_1$ to $64_{m/3}$ respectively select the G latches $14G_1$ to $14G_{m/3}$ in response to the RGB select signal 65.

The DA converters $15_1$ to $15_{m/3}$ receive image data from the selected G latches $14G_1$ to $14G_{m/3}$, generate grayscale voltages corresponding to the grayscale values specified by the received image data and supply the grayscale voltages to the source amplifiers $16_1$ to $16_{m/3}$. The source amplifiers $16_1$ to $16_{m/3}$ output drive voltages corresponding to the grayscale voltages received from the DA converters $15_1$ to $15_{m/3}$.

In one or more embodiments, the amplifier control circuitry 12*f* identifies whether or not all of the image data supplied from the G latches $14G_1$ to $14G_{m/3}$ to the DA converters $15_1$ to $15_{m/3}$ specify the grayscale value "00h", which corresponds to black, on the basis of the data identification bits stored in the latch 12*e*. When all of the image data supplied to the DA converters $15_1$ to $15_{m/3}$ specify the grayscale value "00h", the amplifier control circuitry 12*f* generates the common amplifier control signals $27_{COM}$ so as to stop the amplifying operations of all of the source amplifiers $16_1$ to $16_{m/3}$. In other words, the amplifier turn-on signals AMPON_P and AMPON_N of the common amplifier control signals $27_{COM}$ supplied to the source amplifiers $16_1$ to $16_{m/3}$ are deactivated. As described above, the amplifying operations of the source amplifiers $16_1$ to $16_{m/3}$ are stopped when the amplifier turn-on signals AMPON_P and AMPON_N are deactivated.

In one or more embodiments, depending on whether the display panel 1 operates in the normally black mode or the normally white mode, the amplifier control circuitry 12*f* activates one of the output control signals AMPOUTH_N and AMPOUTL_P of the common amplifier control signals $27_{COM}$, and deactivates the other.

The B subpixels 8B are driven similarly to the R subpixels 8R and G subpixels 8G in each horizontal sync period, except for that the control signal SW3 is activated, and the RGB selectors $64_1$ to $64_{m/3}$ respectively select the B latches $14B_1$ to $14B_{m/3}$ in response to the RGB select signal 65.

The DA converters $15_1$ to $15_{m/3}$ receive image data from the selected B latches $14B_1$ to $14B_{m/3}$, generate grayscale voltages corresponding to the grayscale values specified by the received image data and supply the grayscale voltages to the source amplifiers $16_1$ to $16_{m/3}$. The source amplifiers $16_1$ to $16_{m/3}$ output drive voltages corresponding to the grayscale voltages received from the DA converters $15_1$ to $15_{m/3}$.

In one or more embodiments, the amplifier control circuitry 12*f* identifies whether or not all of the image data supplied from the B latches $14B_1$ to $14B_{m/3}$ to the DA converters $15_1$ to $15_{m/3}$ specify the grayscale value "00h", which corresponds to black, on the basis of the data identification bits stored in the latch 12*e*. When all of the image data supplied to the DA converters $15_1$ to $15_{m/3}$ specify the grayscale value "00h", the amplifier control circuitry 12*f* generates the common amplifier control signals $27_{COM}$ so as to stop the amplifying operations of all of the source amplifiers $16_1$ to $16_{m/3}$. In other words, the amplifier turn-on signals AMPON_P and AMPON_N of the common amplifier control signals $27_{COM}$ supplied to the source amplifiers $16_1$ to $16_{m/3}$ are deactivated. As described above, the amplifying operations of the source amplifiers $16_1$ to $16_{m/3}$ are stopped when the amplifier turn-on signals AMPON_P and AMPON_N are deactivated.

As described above, in the configuration illustrated in FIG. 18, when all of the image data supplied from the R latches $14R_1$ to $14R_{m/3}$ to the DA converters $15_1$ to $15_{m/3}$ specify the grayscale value "00h", which corresponds to black, in a horizontal sync period, the amplifying operations of all of the source amplifiers $16_1$ to $16m$ are stopped in driving R subpixels 8R selected in the horizontal sync period. Similarly, when all of the image data supplied from the G latches $14G_1$ to $14G_{m/3}$ to the DA converters $15_1$ to $15_{m/3}$ specify the grayscale value "00h" in a horizontal sync period, the amplifying operations of all of the source amplifiers $16_1$ to $16m$ are stopped in driving G subpixels 8G selected in the horizontal sync period. Furthermore, when all of the image data supplied from the B latches $14B_1$ to $14B_{m/3}$ to the DA converters $15_1$ to $15_{m/3}$ specify the grayscale value "00h" in a horizontal sync period, the amplifying operations of all of the source amplifiers $16_1$ to $16_m$ are stopped in driving B subpixels 8B selected in the horizontal sync period. Additionally, in the display device 100 of this embodiment, the source amplifiers $16_1$ to $16m$ are each configured to output the drive voltage corresponding to black portions of the display when the amplifying operation thereof is stopped. The source amplifiers are configured to output the power supply voltage (VSP or VSN) or the circuit ground level (GND) to display black even when the source amplifiers are operated, similarly to the case when the amplifying operations of the source amplifiers are stopped. This operation effectively reduces the power consumption, while addressing the above-described problem of the difference in the brightness level of "black".

In one or more embodiments, the display device is configured similarly to the display device 100 as illustrated in FIG. 2. In one embodiment, an OLED (organic light emitting diode) display panel is used as the display panel 1.

Figure 19A:
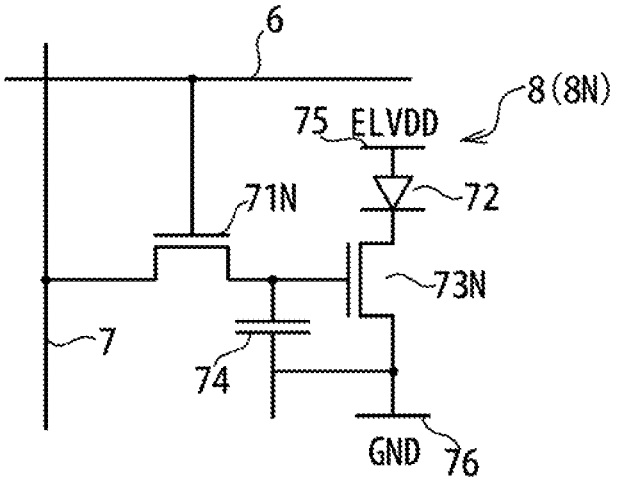
FIG. 19A is a circuit diagram of an NMOS pixel circuit according to one or more embodiments.
Figure 19B:
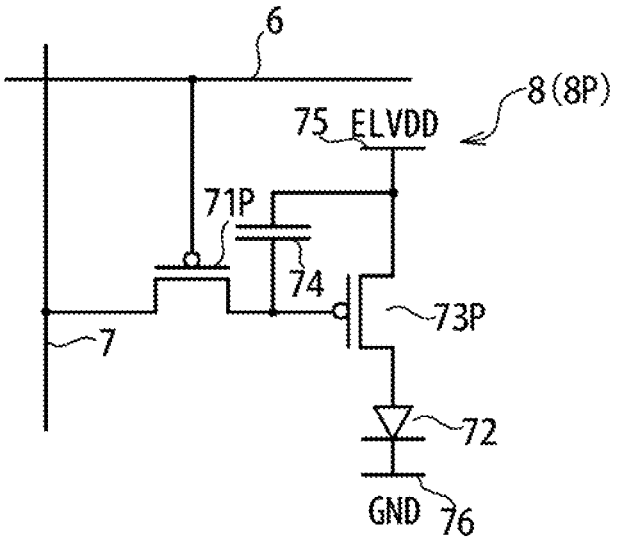
FIG. 19B is a circuit diagram of a PMOS pixel circuit according to one or more embodiments.

FIGS. 19A and 19B are circuit diagrams illustrating examples of the configuration of the pixel circuits 8 when an OLED display panel is used as the display panel 1. The pixel circuit 8 illustrated in FIG. 19A, which incorporates an NMOS transistor as a drive transistor, is hereinafter referred to as NMOS pixel circuit 8N.

The NMOS pixel circuit 8N includes a select transistor 71N, an OLED element 72, a drive transistor 73N and a storage capacitor 74. NMOS TFTs (thin film transistors) are used for both of the select transistor 71N and the drive transistor 73N. The select transistor 71N has a source connected to a source line 7, a drain connected to the gate of the drive transistor 73N and a gate connected to a gate line 6. The OLED element 72 has an anode connected to a power line 75 and a cathode connected to the drain of the drive transistor 73N. The power line 75 is supplied with a power supply voltage ELVDD. The drive transistor 73N has a drain connected to the cathode of the OLED element 72, a source connected to a ground line 76 and a gate connected to the drain of the select transistor 71N. The ground line 76 is supplied with the circuit ground level GND. The storage capacitor 74 is connected between the gate and source of the drive transistor 73N. The drive voltage written in the NMOS pixel circuit 8N is held across the storage capacitor 74.

The pixel circuit 8 illustrated in FIG. 19B, which incorporates a PMOS transistor as a drive transistor, is hereinafter referred to as PMOS pixel circuit 8P.

The PMOS pixel circuit 8P includes a select transistor 71P, an OLED element 72, a drive transistor 73P and a storage capacitor 74. PMOS TFTs are used as the select transistor 71P and the drive transistor 73P. The select transistor 71P has a source connected to a source line 7, a drain connected to the gate of the drive transistor 73P and a gate connected to a gate line 6. The OLED element 72 has an anode connected to the drain of the drive transistor 73P and a cathode connected to a ground line 76. The drive transistor 73P has a source connected to a power line 75, a drain connected to the cathode of the OLED element 72 and a gate connected to the drain of the select transistor 71P. The storage capacitor 74 is connected between the gate and source of the drive transistor 73P. The drive voltage written into the PMOS pixel circuit 8P is held across the storage capacitor 74.

Figure 20:
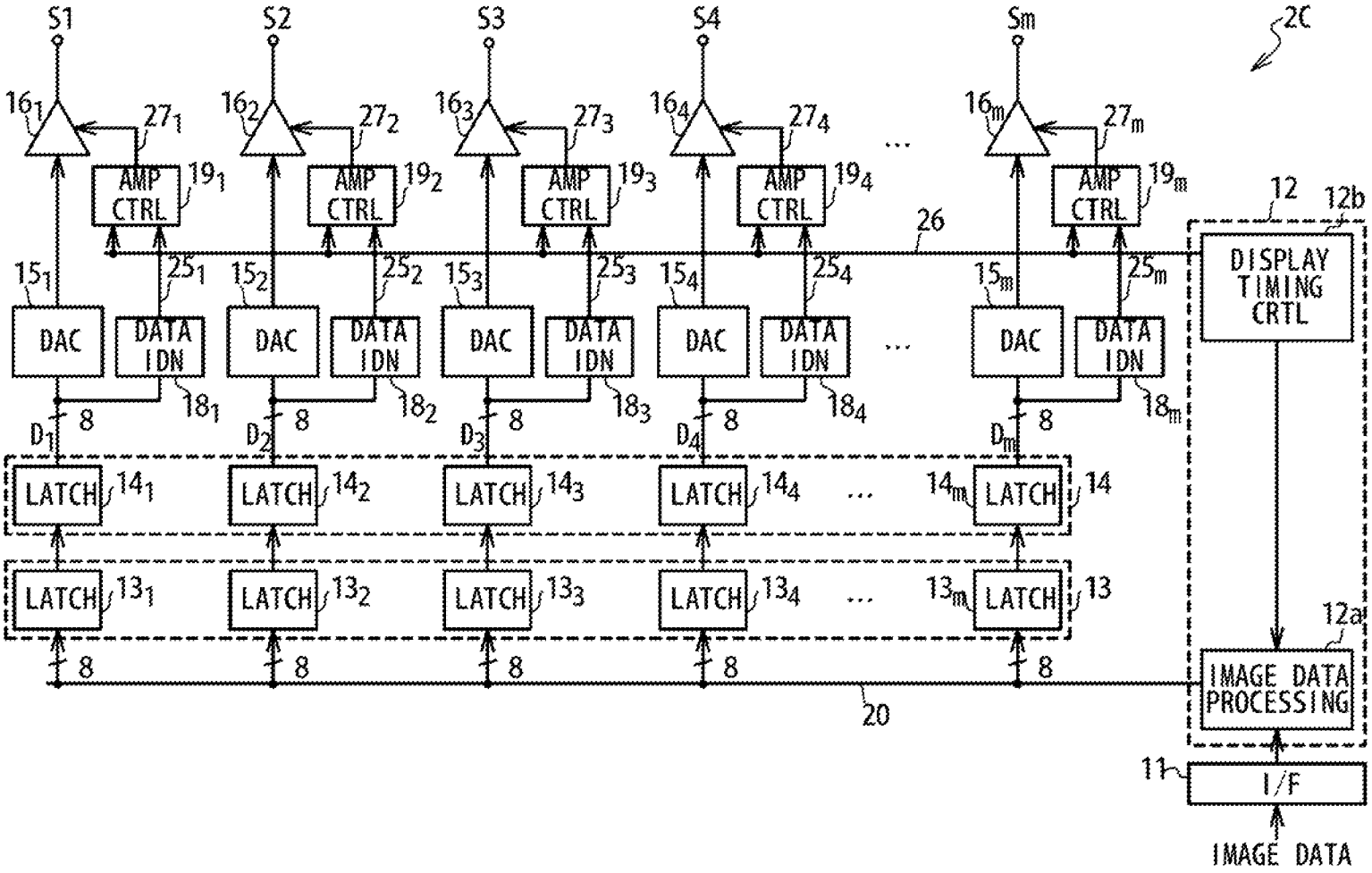
FIG. 20 is a block diagram illustrating a display driver according to one or more embodiments.

FIG. 20 is a block diagram illustrating a display driver 2C used to drive the OLED display panel in this embodiment. The display driver 2C of this embodiment is configured similarly to the display driver 2 of the embodiment illustrated in FIG. 5. The inversion drive is not performed in driving the OLED display panel, and therefore the output switch circuitries $17_1$ to $17_{m/2}$ are removed; the source amplifiers $16_1$ to $16_m$ are connected to the source outputs $S_1$ to Sm, respectively. All the DA converters $15_1$ to $15_m$ are configured to output positive grayscale voltages and all the source amplifiers $16_1$ to $16_m$ are configured to output positive drive voltages. The source amplifiers $16_1$ to $16_m$ may be configured as illustrated in FIG. 7A, for example. In such an embodiment, the power supply voltage ELVDD is supplied in place of the power supply voltage VSP.

FIG. 21A illustrates a table indicating the correspondence relationship between the grayscale values specified by image data and the grayscale voltages outputted from the DA converters 15 for the case when the NMOS pixel circuits 8N are used in this embodiment, that is, the drive voltages to be written into the NMOS pixel circuits 8N. When NMOS pixel circuits 8N are used, the grayscale voltage corresponding to the grayscale value "00h", which corresponds to black, is set to the circuit ground level GND. The voltage levels of the respective grayscale voltages are defined so that the voltage levels of the grayscale voltages are increased as the grayscale values specified by image data are increased.

FIG. 21B illustrates a table indicating the correspondence relationship between the grayscale values specified by image data and the grayscale voltages outputted from the DA converters 15 for the case when the PMOS pixel circuits 8P are used in this embodiment, that is, the drive voltages to be written into the PMOS pixel circuits 8P. When PMOS pixel circuits 8P are used, the grayscale voltage corresponding to the grayscale value "00h", which corresponds to black, is set to the power supply voltage ELVDD, which is supplied to the power line 75 of each PMOS pixel circuit 8P of the OLED display panel. The voltage levels of the respective grayscale voltages are defined so that the voltage levels of the grayscale voltages are decreased as the grayscale values specified by image data are increased.

The display driver 2C illustrated in FIG. 20 operates similarly to the display driver 2 illustrated in FIG. 5, except for that all of the DA converters $\mathbf{15}_1$ to $\mathbf{15}_m$ output positive grayscale voltages, and all of the source amplifiers $\mathbf{16}_1$ to $\mathbf{16}_m$ output positive drive voltages.

Also in this embodiment, the amplifying operation of a source amplifier 16 that supplies a drive voltage to a pixel circuit 8 which displays black is stopped, when the drive voltage is written into the pixel circuit 8. The stopping of the amplifying operation is achieved by stopping the operations of current sources included in the source amplifier 16, in this embodiment, the constant current sources 38, 39 and the floating current sources 45 and 46. This operation effectively reduces the power consumption when portions of the display are black.

Additionally, the source amplifier 16 is configured to output the drive voltage corresponding to black, when the amplifying operation of the source amplifier 16 is stopped. When NMOS pixel circuits 8N are used, the drive voltage corresponding to black is the circuit ground level GND, and, In such an embodiment, the source amplifier 16 outputs the circuit ground level GND when the amplifying operation thereof is stopped. When PMOS pixel circuits 8P are used, the drive voltage corresponding to black portions of the display panel is the power supply voltage ELVDD, and, In such an embodiment, the source amplifier 16 outputs the power supply voltage ELVDD when the amplifying operation thereof is stopped.

Also in this embodiment, the logic module 12 may be configured to identify whether each of the image data supplied to the DA converters 15 specifies the grayscale value corresponding to black, instead of providing the data identification circuitries 18 which identifies whether each image data specifies the grayscale value corresponding to black, similarly to the display driver 2 illustrated in FIG. 10.

Figure 22:
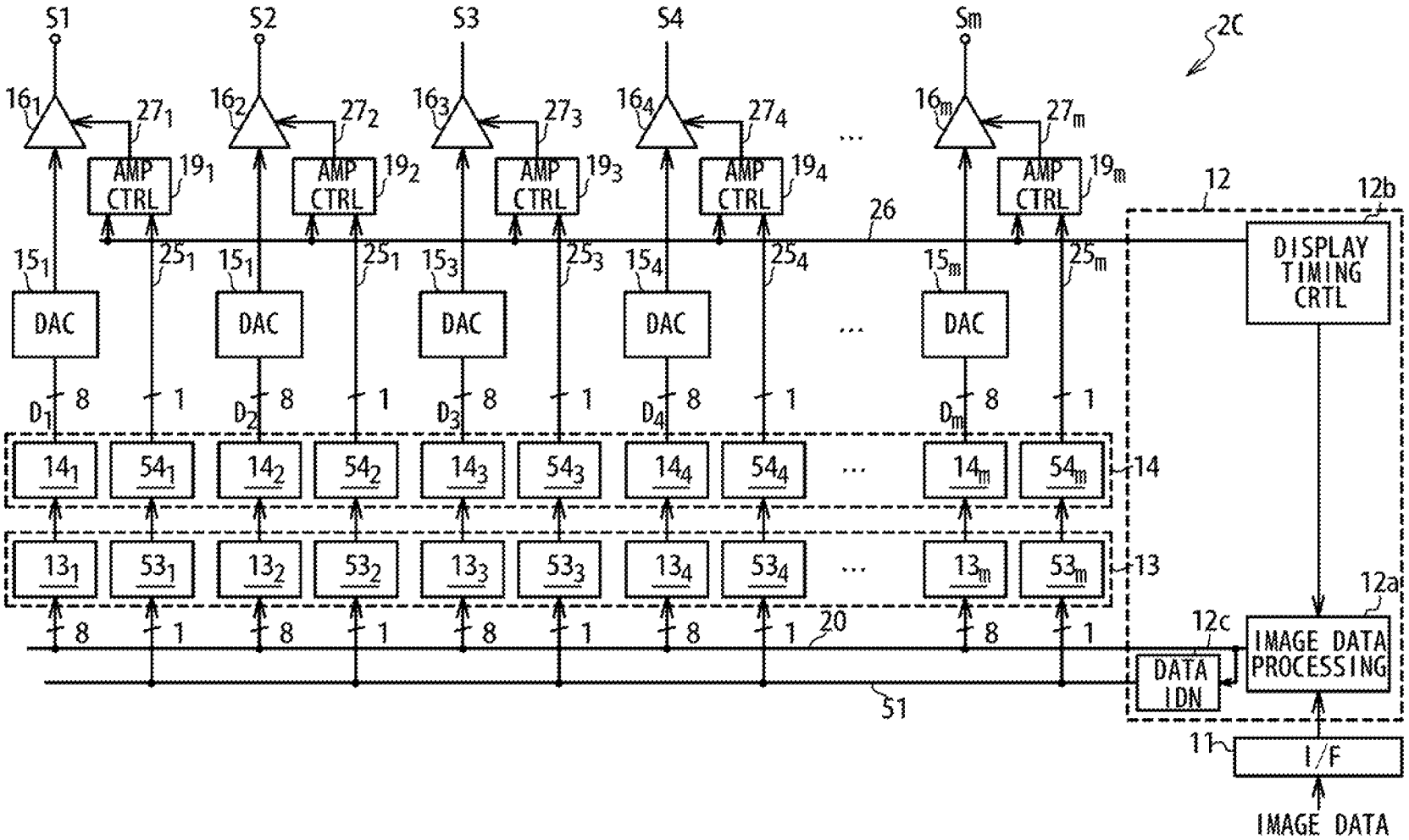
FIG. 22 is a block diagram illustrating a display driver according to one or more embodiments.

FIG. 22 is a block diagram illustrating the display driver 2C thus configured. The display driver 2C illustrated in FIG. 22 is configured similarly to the display driver 2 illustrated in FIG. 10. The output switch circuitries $\mathbf{17}_1$ to $\mathbf{17}_{m/2}$ are removed and the source amplifiers $\mathbf{16}_1$ to $\mathbf{16}_m$ are connected to the source outputs $S_1$ to Sm, respectively. All the DA converters $\mathbf{15}_1$ to $\mathbf{15}_m$ are configured to output positive grayscale voltages and all the source amplifiers $\mathbf{16}_1$ to $\mathbf{16}_m$ are configured to output positive drive voltages. The source amplifiers $\mathbf{16}_1$ to $\mathbf{16}_m$ may be configured as illustrated in FIG. 7A, for example. In such an embodiment, the power supply voltage ELVDD is supplied in place of the power supply voltage VSP.

The display driver 2C illustrated in FIG. 22 operates similarly to the display driver 2 illustrated in FIG. 10, except for that all of the DA converters $\mathbf{15}_1$ to $\mathbf{15}_m$ output positive grayscale voltages, and all of the source amplifiers $\mathbf{16}_1$ to $\mathbf{16}_m$ output positive drive voltages.

Also in this embodiment, the common amplifier control signals $\mathbf{27}_{COM}$ may be supplied to all of the source amplifiers $\mathbf{16}_1$ to $\mathbf{16}_m$ to control the execution and stop of the amplifying operations of the source amplifiers $\mathbf{16}_1$ to $\mathbf{16}_m$, similarly to the display driver 2B illustrated in FIG. 16.

Figure 23:
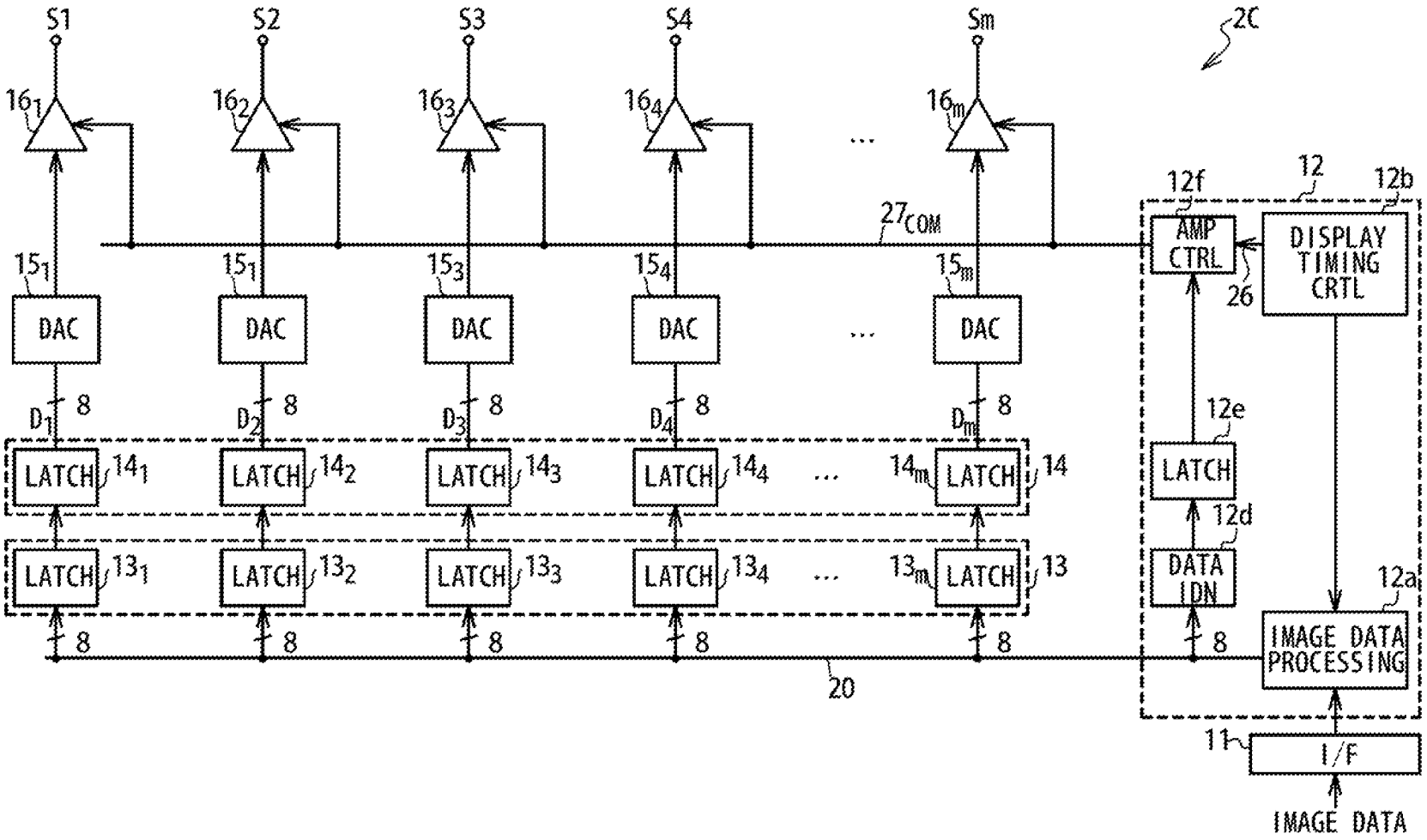
FIG. 23 is a block diagram illustrating a display driver according to one or more embodiments.

FIG. 23 is a block diagram illustrating the display driver 2C thus configured. The display driver 2C illustrated in FIG. 23 is configured similarly to the display driver 2 illustrated in FIG. 16. The output switch circuitries $\mathbf{17}_1$ to $\mathbf{17}_{m/2}$ are removed and the source amplifiers $\mathbf{16}_1$ to $\mathbf{16}_m$ are connected to the source outputs $S_1$ to Sm, respectively. All of the DA converters $\mathbf{15}_1$ to $\mathbf{15}_m$ are configured to output positive grayscale voltages and all of the source amplifiers $\mathbf{16}_1$ to $\mathbf{16}_m$ are configured to output positive drive voltages. The source amplifiers $\mathbf{16}_1$ to $\mathbf{16}_m$ may be configured as illustrated in FIG. 7A, for example. In such an embodiment, the power supply voltage ELVDD is supplied in place of the power supply voltage VSP.

The display driver 2C illustrated in FIG. 23 operates similarly to the display driver 2B illustrated in FIG. 16, except for that all of the DA converters $\mathbf{15}_1$ to $\mathbf{15}_m$ output positive grayscale voltages, and all of the source amplifiers $\mathbf{16}_1$ to $\mathbf{16}_m$ output positive drive voltages.

Although embodiments of the present disclosure have been specifically described in the above, a person skilled in the art would appreciate that the technologies disclosed in the present disclosure may be implemented with various modifications. It should be also noted that the above-described embodiments may be combined in an actual implementation as long as no technological inconsistency occurs.

What is claimed is:

1. A display driver comprising:

a plurality of source amplifiers, each of the plurality of source amplifiers configured to drive an associated one of a plurality of source lines of a display panel with a first drive voltage corresponding to a grayscale value specified by associated image data; and an amplifier control system comprising:

data identification circuitries, each of the data identification circuitries paired with a respective one of the plurality of source amplifiers, each of the data identification circuitries configured to process the image data associated with the paired source amplifier; and amplifier control circuitries, each of the amplifier control circuitries paired with a respective one of the data identification circuitries, each of the amplifier control circuitries configured to control execution and stop of an amplifying operation of the paired source amplifier based on the processed image data received from the paired data identification circuitry.

2. The display driver according to claim 1, wherein each of the plurality of source amplifiers comprises a current source configured to generate a bias current, the first drive voltage is based on the bias current, and wherein, in response to stopping the amplifying operation thereof, each of the plurality of source amplifiers is configured to:

stop generating the bias current with the current source; and output the first drive voltage corresponding to a greyscale value corresponding to black portions of the display panel.

3. The display driver according to claim 1, wherein each of the amplifier control circuitries is further configured to:

stop the amplifying operation of the paired source amplifier in response to the image data associated with the paired source amplifier specifying a grayscale value corresponding to a black portion of the display panel.

4. The display driver according to claim 1, wherein each of the amplifier control circuitries is further configured to:

stop the amplifying operation of paired source amplifier in response to the image data associated with the paired source amplifier specifying a grayscale value corresponding to a black portion of the display panel; and execute the amplifying operation of the paired source amplifier in response to the image data associated with the paired source amplifier not specifying the greyscale value corresponding to the black portion of the display panel.

5. The display driver according to claim 1, wherein the display driver further comprises:

first digital to analog (DA) converters configured to:

respectively receive image data associated with the plurality of source amplifiers; and respectively output grayscale voltages corresponding to grayscale values specified by the received image data, and wherein each of the plurality of source amplifiers is connected to a respective one of the DA converters, and is configured to output the first drive voltage in response to the grayscale voltages received from the respective one of the DA converters.

6. The display driver according to claim 5, wherein the each of data identification circuitries is paired with a respective one of the DA converters, and wherein processing the image data comprises identifying whether the image data supplied to the paired DA converter specifies the grayscale value corresponding to a black portion of the display panel.

7. The display driver according to claim 1, wherein the display driver further comprises:

a line latch bus;

an amplifier control bus;

a line latch circuitry comprising latches configured to respectively receive the image data associated with the plurality of source amplifiers via the line latch bus; and digital to analog (DA) converters configured to output grayscale voltages corresponding to grayscale values specified by the image data received from the latches, wherein the plurality of source amplifiers is connected to respective ones of the DA converters, and configured to output the first drive voltages in response to the grayscale voltages received from the respective ones of the DA converters, wherein the data identification circuitries are configured to supply, to the line latch circuitry, data identification bits indicating whether the image data associated with the plurality of source amplifiers specifies the grayscale value corresponding to black portions of the display panel, via the amplifier control bus, wherein the line latch circuitry further comprises data identification bit latches configured to store respective ones of the data identification bits, and wherein each of the amplifier control circuitries is configured to control execution and stop of the amplifying operation of the paired source amplifier in response to the data identification bits stored in the data identification bit latches.

8. The display driver according to claim 1, wherein each of the amplifier control circuitries is further configured to:

stop amplifying operations of the paired source amplifier in a corresponding horizontal sync period in response to all of the image data associated with the plurality of source amplifiers specifying grayscale values corresponding to black portions of the display driver in a specific horizontal sync period.

9. The display driver according to claim 1, wherein the display panel includes a liquid crystal display panel configured to operate in a normally black mode, and wherein a voltage level of a second drive voltage corresponding to black portions of the display panel is a circuit ground level of the display driver.

10. The display driver according to claim 1, wherein the display panel includes a liquid crystal display panel configured to operate in a normally white mode, wherein the plurality of source amplifiers comprises:

a positive side source amplifier configured to output a positive drive voltage with respect to a circuit ground of the display driver; and a negative side source amplifier configured to output a negative drive voltage with respect to the circuit ground of the display driver, wherein a second drive voltage corresponding to black portions of the display panel with respect to the positive side source amplifier is a first power supply voltage supplied to the positive side source amplifier, the first power supply voltage being positive with respect to the circuit ground of the display driver, and wherein the second drive voltage corresponding to black portions of the display panel with respect to the positive side source amplifier is a second power supply voltage supplied to the negative side source amplifier, the second power supply voltage being negative with respect to the circuit ground of the display driver.

11. The display driver according to claim 1, wherein the display panel comprises an organic light emitting diode (OLED) display panel comprising a plurality of NMOS pixel circuits connected to the plurality of source lines, wherein each of the plurality of NMOS pixel circuits comprises:

a drive transistor configured as an NMOS transistor;

an OLED element; and a storage capacitor connected between a gate and source of the drive transistor, a drive voltage outputted from an associated one of the plurality of source amplifiers being written into the storage capacitor, wherein the drive transistor and the OLED element are connected in series between a power line supplied with a power supply voltage and a ground line supplied with a circuit ground level of the display driver, and wherein a second drive voltage corresponding to black portions of the display panel is the circuit ground level of the display driver.

12. The display driver according to claim 1, wherein the display panel comprises an organic light emitting diode (OLED) display panel comprising a plurality of PMOS pixel circuits connected to the plurality of source lines, wherein each of the plurality of PMOS pixel circuits comprises:

a drive transistor configured as a PMOS transistor;

an OLED element; and a storage capacitor connected between a gate and source of the drive transistor and configured to store the first drive voltage outputted from an associated one of the plurality of source amplifiers, wherein the drive transistor and the OLED element is connected in series between a power line supplied with a power supply voltage and a ground line supplied with a circuit ground level of the display driver, and wherein a second drive voltage corresponding to black portions of the display panel is the power supply voltage.

13. A display device comprising:

a display panel comprising a plurality of source lines; and a display driver comprising:

a plurality of source amplifiers, wherein each of the plurality of source amplifiers is configured to:

drive an associated one of the source lines with a first drive voltage corresponding to a grayscale value specified by associated image data; and an amplifier control system comprising:

data identification circuitries, each of the data identification circuitries paired with a respective one of the plurality of source amplifiers, each of the data identification circuitries configured to process the image data associated with the paired source amplifier; and amplifier control circuitries, each of the amplifier control circuitries paired with a respective one of the data identification circuitries, each of the amplifier control circuitries configured to control execution and stop of an amplifying operation of the paired source amplifier based on the processed image data received from the paired data identification circuitry.

14. The display device according to claim 13, wherein each of plurality of the source amplifiers comprises a current source configured to generate a bias current used for generating the first drive voltage, and wherein, in response to stopping the amplifying operation thereof, each of the plurality of source amplifiers is further configured to:

stop generating the bias current with the current source; and output a second drive voltage corresponding to black portions of the display panel.

15. The display device according to claim 13, wherein each of the amplifier control circuitries is further configured to:

stop the amplifying operation of the paired source amplifier in response to the image data associated with the paired source amplifier specifying a grayscale value corresponding to a black portion of the display panel.

16. The display device according to claim 13, wherein each of the amplifier control circuitries is further configured to:

stop the amplifying operation of the paired source amplifier in response to the image data associated with the paired source amplifier specifying a grayscale value corresponding to a black portion of the display panel, execute the amplifying operation of the paired source amplifier in response to the image data associated with the paired source amplifier not specifying the greyscale value corresponding to the black portion of the display panel.

17. The display device according to claim 13, wherein the display panel includes a liquid crystal display panel configured to operate in a normally black mode, and wherein a voltage level of a second drive voltage corresponding to black portions of the display panel is a circuit ground level of the display driver.

18. The display device according to claim 13, wherein the display panel includes a liquid crystal display panel configured to operate in a normally white mode, wherein the plurality of source amplifiers comprises:

a positive side source amplifier configured to output a positive drive voltage with respect to a circuit ground of the display driver; and a negative side source amplifier configured to output a negative drive voltage with respect to the circuit ground of the display driver, wherein a drive voltage corresponding to black portions of the display panel with respect to the positive side source amplifier is a first power supply voltage supplied to the positive side source amplifier, the first power supply voltage being positive with respect to the circuit ground of the display driver, and wherein the drive voltage corresponding to black portions of the display panel with respect to the positive side source amplifier is a second power supply voltage supplied to the negative side source amplifier, the second power supply voltage being negative with respect to the circuit ground of the display driver.

19. A method comprising:

driving, based on image data, a plurality of source lines of a display panel, wherein each of the plurality of source lines is paired with a respective one of a plurality of source amplifiers;

processing, via data identification circuitries, the image data associated with each of the source amplifiers, wherein each of the source amplifiers is paired with a respective one of the data identification circuitries; and controlling, via amplifier control circuitries, execution and stopping of an amplifying operation of each of the source amplifiers independently based on the processed image data associated with each of the source amplifiers, wherein each of the data identification circuitries is paired with a respective one of the amplifier control circuitries.

20. The method according to claim 19, wherein each of the source amplifiers comprises a current source configured to generate a bias current used for generating a drive voltage, wherein stopping the amplifying operation is achieved by stopping the generation of the bias current with the current source.

* * * * *